US006872515B2

(12) United States Patent
Tsukada et al.

(10) Patent No.: US 6,872,515 B2
(45) Date of Patent: Mar. 29, 2005

(54) SILVER HALIDE PHOTOGRAPHIC LIGHT-SENSITIVE MATERIAL

(75) Inventors: Yoshihisa Tsukada, Minami-ashigara (JP); Terukazu Yanagi, Minami-ashigara (JP); Kouichi Yokota, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/427,969

(22) Filed: May 2, 2003

(65) Prior Publication Data

US 2004/0048209 A1 Mar. 11, 2004

(30) Foreign Application Priority Data

May 2, 2002 (JP) ..... 2002-130800

(51) Int. Cl.[7] ..... G03C 1/38; G03C 1/85

(52) U.S. Cl. ..... 430/528; 430/529; 430/523; 430/634; 430/636

(58) Field of Search ..... 430/528, 529, 430/523, 634, 636, 539

(56) References Cited

U.S. PATENT DOCUMENTS

| | | | | | |
|---|---|---|---|---|---|
| 4,347,308 | A | * | 8/1982 | Takeuchi et al. | 430/529 |
| 4,367,283 | A | * | 1/1983 | Nakayama et al. | 430/528 |
| 4,847,187 | A | * | 7/1989 | Ono et al. | 430/529 |
| 4,968,599 | A | * | 11/1990 | Pitt et al. | 430/528 |
| 5,503,967 | A | * | 4/1996 | Furlan et al. | 430/529 |
| 6,589,723 | B2 | * | 7/2003 | Yamanouchi et al. | 430/529 |
| 6,803,180 | B2 | * | 10/2004 | Nagahara et al. | 430/530 |
| 2003/0138745 | A1 | * | 7/2003 | Yanagi et al. | 430/527 |
| 2003/0211430 | A1 | * | 11/2003 | Ikeda et al. | 430/523 |
| 2004/0002024 | A1 | * | 1/2004 | Yanagi et al. | 430/529 |

* cited by examiner

*Primary Examiner*—Richard L. Schilling
(74) *Attorney, Agent, or Firm*—Sughrue Mion, PLLC

(57) ABSTRACT

A silver halide photographic light-sensitive material having one or more layers including at least one light-sensitive silver halide emulsion layer on a support, wherein at least one of the layers contains at least one compound represented by $R^1$-$Z^1$ ($R^1$ is an unsubstituted or hydroxy-substituted alkyl having 6–24 carbon atoms or an unsubstituted alkenyl group having 6–24 carbon atoms, and $Z^1$ is $OSO_3M$ or $SO_3M$, where M is a cation) and a fluorine-containing surfactant. There is provided a silver halide photographic light-sensitive material that shows superior antistatic property and can be stably produced.

19 Claims, No Drawings

SILVER HALIDE PHOTOGRAPHIC LIGHT-SENSITIVE MATERIAL

TECHNICAL FIELD

The present invention relates to a silver halide photographic light-sensitive material, in particular, a silver halide photographic light-sensitive material that shows superior antistatic property and shows reduced repellency during high speed coating and so forth, and can be stably produced.

RELATED ART

Compounds having a fluorinated alkyl chain are conventionally known as surfactants. Such surfactants can modify various surface properties by the unique properties of the fluorinated alkyl chain (e.g., water and oil repelling properties, lubricity, antistatic property etc.), and they are used for surface treatment of base materials of a wide range such as fibers, cloth, carpets and resins. Further, if a surfactant having a fluorinated alkyl chain (henceforth referred to as a "fluorine-containing surfactant") is added to a solution of any of various substrates in an aqueous medium, not only a uniform coating film can be formed without repellency upon coating, but also a surfactant-adsorbed layer can be formed on a substrate surface, and thus the unique properties provided by the fluorinated alkyl chain can be imparted to the surface of coating.

Also in photographic light-sensitive materials, various surfactants are used and play important roles. Photographic light-sensitive materials are usually produced by individually coating a plurality of coating solutions including an aqueous solution of a hydrophilic colloid binder (e.g., gelatin) on a support to form multiple layers. Multiple hydrophilic colloid layers are often simultaneously coated as stacked layers. These layers include antistatic layer, undercoat layer, antihalation layer, silver halide emulsion layer, intermediate layer, filter layer, protective layer and so forth, and various materials for exerting functions of the layers are added to the layers. Further, polymer latex may also be added to the hydrophilic colloid layer in some cases in order to improve physical properties of film. Furthermore, in order to add functional compounds hardly soluble in water such as color couplers, ultraviolet absorbers, fluorescent brightening agents and lubricants to the hydrophilic colloid layer, these materials are sometimes emulsion-dispersed in a hydrophilic colloid solution as they are or as a solution in a high boiling point organic solvent such as phosphoric acid ester compounds and phthalic acid ester compounds for the preparation of a coating solution. As described above, photographic light-sensitive materials are generally constituted by various hydrophilic colloid layers, and in the production of them, it is required to uniformly coat coating solutions containing various materials at a high speed without defects such as repelling and uneven coating. In order to meet such requirements, a surfactant is often added to a coating solution as a coating aid.

Meanwhile, photographic light-sensitive materials are brought into contact with various materials during production, light exposure and development thereof. For example, if a light-sensitive material is in a rolled shape in processing steps, a back layer formed on the back surface of the support may contact with the surface layer. Further, when it is transported during processing steps, it may contact with stainless steel rollers, rubber rollers etc. When they are brought into contact with these materials, surfaces (gelatin layer) of light-sensitive materials are likely to be positively charged, and they may undesirably cause discharge as the case maybe. Therefore, there may remain undesirable traces of light exposure (called static marks) on the light-sensitive materials. In order to reduce this electrification property of gelatin, a compound containing a fluorine atom is effective, and a fluorine-containing surfactant is often added.

While a fluorine-containing surfactant has an advantage that it is oriented on a surface of a photographic light-sensitive material and thereby shows marked effect of controlling electrification as described above, it also has a drawback that it is dissolved in water, a hydrophilic organic solvent or the like only in an extremely small amount. For this reason, for the purpose of solubilizing the fluorine-containing surfactant, a hydrocarbon surfactant is often simultaneously added.

As described above, surfactants, especially fluorine-containing surfactants, are used as materials having both of the function as coating aids for providing uniformity of coated films and the function for imparting antistatic property to photographic light-sensitive materials. Specific examples thereof are disclosed in, for example, Japanese Patent Laid-open Publication (Kokai, henceforth referred to as JP-A) No. 49-46733, JP-A-51-32322, JP-A-57-64228, JP-A-64-536, JP-A-2-141739, JP-A-3-95550, JP-A-4-248543 and so forth. However, these materials do not necessarily have performance satisfying the demands for higher sensitivity and coating at higher speed required for recent photographic light-sensitive materials, and it is desired to further improve fluorine-containing surfactants. At the same time, it is also desired to develop a hydrocarbon type surfactant that solubilizes fluorine-containing surfactants.

An object of the present invention is to provide a silver halide photographic light-sensitive material that can be stably produced and shows superior antistatic property.

SUMMARY OF THE INVENTION

The present invention provides the followings.

<1> A silver halide photographic light-sensitive material having one or more layers including at least one light-sensitive silver halide emulsion layer on a support, wherein at least one of the layers contains at least one kind of a compound represented by the following formula (1) and a fluorine-containing surfactant.

$$R^1\text{-}Z^1 \qquad \text{Formula (1)}$$

In the formula, $R^1$ represents an unsubstituted alkyl group having 6–24 carbon atoms, a hydroxy-substituted alkyl group having 6–24 carbon atoms or an unsubstituted alkenyl group having 6–24 carbon atoms, and $Z^1$ represents $OSO_3M$ or $SO_3M$, where M represents a cation.

<2> The silver halide photographic light-sensitive material according to <1>, which has a light-insensitive hydrophilic colloid layer as an outermost layer and contains at least one kind of a compound represented by the aforementioned formula (1) and a fluorine-containing surfactant in the outermost layer.

<3> The silver halide photographic light-sensitive material according to <1> or <2>, wherein the fluorine-containing surfactant is a compound represented by the following formula (2A), (2B), (2C) or (2D).

Formula (2A)

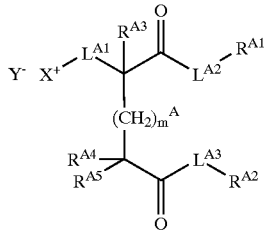

In the formula, $R^{A1}$ and $R^{A2}$ each represent a substituted or unsubstituted alkyl group provided that at least one of $R^{A1}$ and $R^{A2}$ represents an alkyl group substituted with one or more fluorine atoms. $R^{A3}$, $R^{A4}$ and $R^{A5}$ each independently represent a hydrogen atom or a substituent, $L^{A1}$, $L^{A2}$ and $L^{A3}$ each independently represent a single bond or a divalent bridging group, and $X^+$ represents a cationic substituent. $Y^-$ represents a counter anion, but $Y^-$ may not be present when the intramolecular charge is 0 without $Y^-$. $m^A$ represents 0 or 1.

Formula (2B)

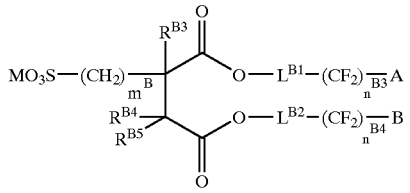

In the formula, $R^{B3}$, $R^{B4}$ and $R^{B5}$ each independently represent a hydrogen atom or a substituent. A and B each independently represent a fluorine atom or a hydrogen atom. $n^{B3}$ and $n^{B4}$ each independently represent an integer of 4–8. $L^{B1}$ and $L^{B2}$ each independently represent a substituted or unsubstituted alkylene group, a substituted or unsubstituted alkyleneoxy group or a divalent bridging group consisting of a combination of these. $m^B$ represents 0 or 1. M represents a cation.

Formula (2C)

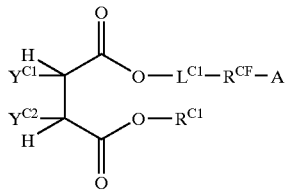

In the formula, $R^{C1}$ represents a substituted or unsubstituted alkyl group, and $R^{CF}$ represents a perfluoroalkylene group. A represents a hydrogen atom or a fluorine atom, and $L^{C1}$ represents a substituted or unsubstituted alkylene group, a substituted or unsubstituted alkyleneoxy group or a divalent bridging group consisting of a combination of these. One of $Y^{C1}$ and $Y^{C2}$ represents a hydrogen atom, and the other represents $-L^{C2}-SO_3M$, where $L^{C2}$ represents a single bond or a substituted or unsubstituted alkylene group and M represents a cation.

$[Rf^D-(L^D)_{nD}]_{mD}-W$ Formula (2D)

In the formula, $Rf^D$ represents a perfluoroalkyl group, $L^D$ represents an alkylene group, W represents a group having an anionic, cationic or betaine group or nonionic polar group required for imparting surface activity. $n^D$ represents 0 or 1, and $m^D$ represents an integer of 1–3.

<4> The silver halide photographic light-sensitive material according to <1> or <2>, wherein the fluorine-containing surfactant is a compound represented by the aforementioned formula (2A) or (2B).

<5> The silver halide-photographic light-sensitive material according to <1> or <2>, wherein the fluorine-containing surfactant is a compound represented by the following formula (2A-3) or (2B-2).

Formula (2A-3)

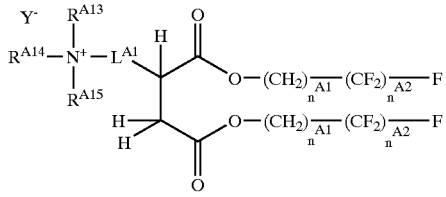

In the formula, $n^{A1}$ represents an integer of 1–6, and $n^{A2}$ represents an integer of 3–8, provided that $2(n^{A1}+n^{A2})$ is 19 or less. $R^{A13}$, $R^{A14}$ and $R^{A15}$ each independently represent a substituted or unsubstituted alkyl group. $Y^-$ represents a counter anion, but $Y^-$ may not be present when the intramolecular charge is 0 without $Y^-$.

Formula (2B-2)

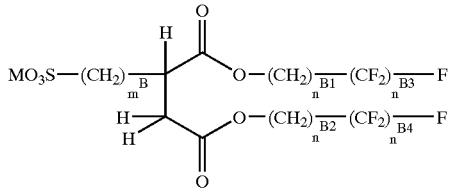

In the formula, $n^{B1}$ and $n^{B2}$ each independently represent an integer of 1–6, and $n^{B3}$ and $n^{B4}$ each independently represent an integer of 4–8. $m^B$ represents 0 or 1. M represents a cation.

BEST MODE FOR CARRYING OUT THE INVENTION

Hereafter, the present invention will be explained in detail. In the present specification, ranges indicated with "–" mean ranges including the numerical values before and after "–" as the minimum and maximum values.

First, the compounds represented by the following formula (1) used for the present invention will be explained. The compounds represented by the following formula (1) can function as anionic surfactants.

$R^1-Z^1$ Formula (1)

In the formula, $R^1$ represents an unsubstituted alkyl group having 6–24 carbon atoms, a hydroxy-substituted alkyl group having 6–24 carbon atoms or an unsubstituted alkenyl group having 6–24 carbon atoms, and $Z^1$ represents $OSO_3M$ or $SO_3M$, where M represents a cation.

In the aforementioned formula (1), the carbon atom number of $R^1$ is preferably 6–22, more preferably 6–20, particularly preferably 8–18. Although the alkyl group and alkenyl group may have a cyclic structure, an alkyl group and alkenyl group having a chain structure are more preferred. The alkyl group and alkenyl group having a chain structure may be linear or branched. The position of the double bond of the alkenyl group is not particularly limited.

In the aforementioned formula (1), $Z^1$ preferably represents $SO_3M$. Examples of the cation represented by M include, for example, alkali metal ions (lithium ion, sodium ion, potassium ion etc.), alkaline earth metal ions (barium ion, calcium ion etc.), ammonium ions and so forth. Among these, particularly preferred are lithium ion, sodium ion, potassium ion and ammonium ions.

Specific examples of the compound represented by the aforementioned formula (1) are shown below. However, the present invention is not limited by the following specific examples at all.

WS-1: $CH_3(CH_2)_{11}CH{=}CH{-}SO_3Na$
WS-2: $CH_3(CH_2)_{10}CH{=}CHCH_2{-}SO_3Na$
WS-3: $CH_3(CH_2)_9CH{=}CHCH_2CH_2{-}SO_3Na$
WS-4: $CH_3(CH_2)_8CH{=}CH(CH_2)_3{-}SO_3Na$
WS-5: $CH_3(CH_2)_7CH{=}CH(CH_2)_4{-}SO_3Na$
WS-6: $CH_3(CH_2)_3CH{=}CH(CH_2)_8{-}SO_3Na$
WS-7: $CH_3(CH_2)_{12}CH{=}CHCH_2{-}SO_3Na$
WS-8: $CH_3(CH_2)_{14}CH{=}CHCH_2{-}SO_3Na$
WS-9: $CH_3(CH_2)_2CH{=}CHCH_2{-}SO_3K$
WS-10: $CH_3(CH_2)_4CH{=}CHCH_2{-}SO_3Li$
WS-11: $CH_3(CH_2)_6CH{=}CHCH_2{-}SO_3NH_4$
WS-12: $CH_3(CH_2)_{16}CH{=}CHCH_2{-}SO_3Na$
WS-13: $CH_3(CH_2)_{18}CH{=}CHCH_2{-}SO_3Na$
WS-14: $CH_3(CH_2)_{20}CH{=}CHCH_2{-}SO_3Na$
WS-15: $C_{12}H_{25}{-}OSO_3Na$
WS-16: $C_{14}H_{29}{-}OSO_3K$
WS-17: $C_{16}H_{33}{-}OSO_3NH_4$
WS-18: $C_{10}H_{21}{-}OSO_3Na$
WS-19: $C_{20}H_{41}{-}OSO_3Na$
WS-20: $C_{24}H_{49}{-}OSO_3Na$
WS-21: $CH_3(CH_2)_7CH{=}CH(CH_2)_8{-}OSO_3Na$
WS-22: $CH_3(CH_2)_{10}CH(OH)CH_2CH_2{-}SO_3Na$
WS-23: $CH_3(CH_2)_{11}CH(OH)CH_2{-}SO_3Na$
WS-24: $CH_3(CH_2)_9CH(OH)CH_2CH_2CH_2{-}SO_3Na$
WS-25: $CH_3(CH_2)_7CH_2CH(OH)CH(CH_3){-}SO_3Na$
WS-26: $CH_3(CH_2)_{16}CH(OH)CH_2CH_2{-}SO_3Na$
WS-27: $CH_3(CH_2)_{20}CH(OH)CH_2CH_2{-}SO_3Na$

The compounds represented by the aforementioned formula (1) can be synthesized by a method of converting a long-chain alcohol into a halogenated derivative and sulfonating the halogenated derivative with sodium sulfite or a method of reacting a long-chain alcohol with chlorosulfonic acid. In addition, they can also be synthesized by the methods described in Journal of the Society of Chemical Industry, Japan, 72, 2248 (1969); and Journal of the Society of Chemical Industry, Japan, 74, 706 (1971). Further, alpha-olefinsulfonates that can be purchased from LION Co., Ltd. (tradename: Lipolan) and so forth are also preferred, and Lipolan PJ-400 is particularly preferred.

The compounds of the aforementioned formula (1) will be specifically explained with reference to the following synthetic examples. However, the present invention is not limited by the following specific examples at all.

SYNTHESIS EXAMPLE 1

Synthesis of WS-6

9-Tetradecen-1-ol (84.95 g, 0.40 mol) and pyridine (38.8 mL, 0.48 mol) were dissolved in toluene (400 mL) and added dropwise with thionyl chloride (35.0 mL, 0.48 mol) at room temperature over 30 minutes. After the addition, the mixture was refluxed with heating for 10 hours. The reaction mixture was transferred to a separating funnel, added with 6 N hydrochloric acid (40 mL) and washed 4 times with saturated brine (500 mL). The organic solvent was evaporated under reduced pressured to obtain light yellow oil. The oil was dissolved in isopropyl alcohol (400 mL) and added with a solution of sodium sulfite (100.83 g, 0.80 mol) dissolved in water (800 mL). After the reaction mixture was refluxed with heating for 7 days, it was transferred to a separating funnel and washed 3 times with hexane (500 mL). Further, the washed reaction mixture was heated to 55° C. and added with sodium chloride until the reaction mixture separated into two layers, and the upper isopropyl alcohol solution in the separating funnel was separated and added to acetone (1500 mL) to deposit white solid. The solid was separated by suction filtration and dried under reduced pressure to obtain the target substance (89.5 g, yield: 75%).

SYNTHESIS EXAMPLE 2

Synthesis of WS-15

1-Dodecanol (74.54 g, 0.40 mol) was dissolved in chloroform (500 mL) and added dropwise with a solution of chlorosulfonic acid (48.9 g, 0.42 mol) dissolved in chloroform (100 mL) over 30 minutes under ice cooling. Then, the reaction mixture was added with a solution of sodium hydroxide (82.0 g, 0.82 mol) dissolved in ethanol (1500 mL).

The reaction mixture was concentrated under reduced pressure and added to acetonitrile (4500 mL) to deposit solid. The solid was separated by suction filtration and dried under reduced pressure to obtain the target substance (100.4 g, yield: 87%).

In the present invention, at least one kind of the compound represented by the aforementioned formula (1) is contained in a layer containing the fluorine-containing surfactant. The compound represented by the aforementioned formula (1) is preferably used in a coating aid for a layer containing the fluorine-containing surfactant, and it is contained in an amount of preferably 60 weight % or more, more preferably 75 weight % or more, particularly preferably 90 weight % or more, with respect to the coating aid in a layer containing the fluorine-containing surfactant. Besides the compound represented by the aforementioned general formula (1), other compounds that can function as anionic surfactants may be contained in the same layer. When other compounds are used, the total amount of anionic surfactants (total amount of the compound represented by the aforementioned general formula (1) and the other compound(s)) is preferably in the aforementioned range.

Anionic surfactants that can be used together with the compounds represented by the aforementioned formula (1) are exemplified below.

WSA-1

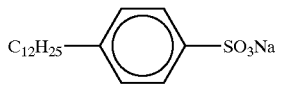

WSA-2

$C_{10}H_{21}O{-}(CH_2CH_2O)_n(CH_2)_4{-}SO_3Na$ n = 1

WSA-3

$C_{10}H_{21}O{-}(CH_2CH_2O)_n{-}CH_2CH_2SO_3Na$ n = 2

WSA-4

$C_{10}H_{21}OCH_2CH_2CH_2CH_2SO_3Na$

-continued

WSA-5

$C_{14}H_{29}O—(CH_2CH_2O)_n—CH_2CH_2CH_2CH_2SO_3Na$ n = 3

WSA-6

$C_{16}H_{33}O—(CH_2CH_2O)_n—SO_3Na$ n = 4

WSA-7

$C_{11}H_{23}COO—(CH_2CH_2O)_n—SO_3K$ n = 3

WSA-8

$C_8H_{17}—CH=CH—(CH_2)_7CON(CH_3)CH_2CH_2SO_3Na$

WSA-9

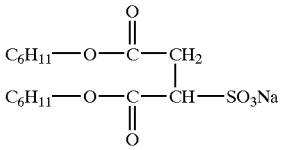

WSA-10

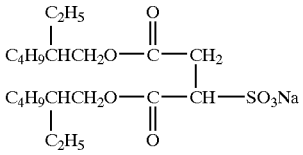

WSA-11

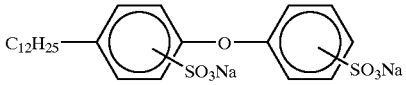

WSA-12

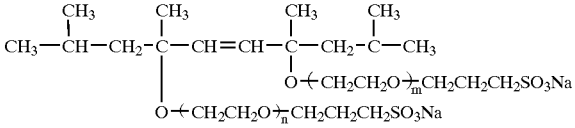

n + m = 10

WSA-13

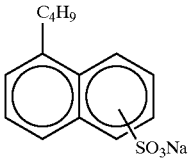

WSA-14

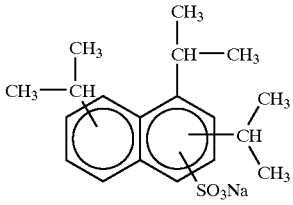

Hereafter, the fluorine-containing surfactants that can be used for the present invention will be explained in detail. Examples of the fluorine-containing surfactants include the compounds represented by the following formulas (2A) to (2D).

Hereafter, the formulas (2A) to (2D) will be explained in detail.

Formula (2A)

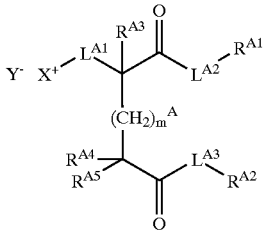

In the formula, $R^{A1}$ and $R^{A2}$ each represent a substituted or unsubstituted alkyl group, provided that at least one of $R^{A1}$ and $R^{A2}$ represents an alkyl group substituted with one or more fluorine atoms. $R^{A3}$, $R^{A4}$ and $R^{A5}$ each independently represent a hydrogen atom or a substituent, $L^{A1}$, $L^{A2}$ and $L^{A3}$ each independently represent a single bond or a divalent bridging group, and $X^+$ represents a cationic substituent. $Y^-$ represents a counter anion, but $Y^-$ may not be present when the intramolecular charge is 0 without $Y^-$. $m^A$ is 0 or 1.

In the aforementioned formula (2A), $R^{A1}$ and $R^{A2}$ each represent a substituted or unsubstituted alkyl group. The alkyl group contains one or more carbon atoms and may be a straight, branched or cyclic alkyl group. Examples of the substituent include a halogen atom, an alkenyl group, an aryl group, an alkoxyl group, a halogen atom other than fluorine, a carboxylic acid ester group, a carbonamido group, a carbamoyl group, an oxycarbonyl group, a phosphoric acid ester group and so forth. However, at least one of $R^{A1}$ and $R^{A2}$ represents an alkyl group substituted with one or more fluorine atoms (an alkyl group substituted with one or more fluorine atoms is referred to as "Rf" hereinafter).

Rf is an alkyl group having one or more carbon atoms and substituted with at least one fluorine atom. It is sufficient that Rf should be substituted with at least one fluorine atom, and it may have any of straight, branched and cyclic structures. It may be further substituted with a substituent other than fluorine atom or substituted with only fluorine atom or atoms. Examples of the substituent of Rf other than fluorine atom include an alkenyl group, an aryl group, an alkoxyl group, a halogen atom other than fluorine, a carboxylic acid ester group, a carboneamido group, a carbamoyl group, an oxycarbonyl group, a phosphoric acid ester group and so forth.

Rf is preferably a fluorine-substituted alkyl group having 1–16 carbon atoms, more preferably 1–12 carbon atoms, further preferably 4–10 carbon atoms. Preferred examples of Rf include the followings.

$—(CH_2)_2—(CF_2)_4F$,
$—(CH_2)_2—(CF_2)_6F$,
$—(CH_2)_2—(CF_2)_8F$,
$—CH_2—(CF_2)_4H$,
$—CH_2—(CF_2)_6H$,
$—CH_2—(CF_2)_8H$,
$—(CH_2)_3—(CF_2)_4F$,
$—(CH_2)_6—(CF_2)_4F$,
$—CH(CF_3)—CF_3$

Rf is more preferably an alkyl group having 4–10 carbon atoms and substituted with a trifluoromethyl group at its end, particularly preferably an alkyl group having 3–10 carbon atoms represented as $—(CH_2)_\alpha—(CF_2)_\beta F$ ($\alpha$ represents an integer of 1–6, and $\beta$ represents an integer of 3–8). Specific examples thereof include the followings.

$—CH_2—(CF_2)_2F$,
$—(CH_2)_6—(CF_2)_4F$, $—(CH_2)_3—(CF_2)_4F$,
$—CH_2—(CF_2)_3F$,
$—(CH_2)_2—(CF_2)_4F$,
$—(CH_2)_3—(CF_2)_4F$,
$—(CH_2)_6—(CF_2)_4F$,
$—(CH_2)_2—(CF_2)_6F$,
$—(CH_2)_3—(CF_2)_6F$
$—(CH_2)_2—(CF_2)_6F$

Among these, $—(CH_2)_2—(CF_2)_4F$ and $—(CH_2)_2—(CF_2)_6F$ are particularly preferred.

In the aforementioned formula (2A), it is preferred that both of $R^{A1}$ and $R^{A2}$ represent Rf.

When $R^{A1}$ and $R^{A2}$ represent an alkyl group other than Rf, i.e., an alkyl group that is not substituted with a fluorine atom, the alkyl group is preferably a substituted or unsubstituted alkyl group having 1–24 carbon atoms, more preferably a substituted or unsubstituted alkyl group having 6–24 carbon atoms. Preferred examples of the unsubstituted alkyl group having 6–24 carbon atoms include n-hexyl group, n-heptyl group, n-octyl group, tert-octyl group, 2-ethylhexyl group, n-nonyl group, 1,1,3-trimethylhexyl group, n-decyl group, n-dodecyl group, cetyl group, hexadecyl group, 2-hexyldecyl group, octadecyl group, eicosyl group, 2-octyldodecyl, docosyl group, tetracosyl group, 2-decyltetradecyl group, tricosyl group, cyclohexyl group, cycloheptyl group and so forth. Further, preferred examples of the substituted alkyl group having a total carbon number of 6–24 include 2-hexenyl group, oleyl group, linoleyl group, linolenyl group, benzyl group, β-phenethyl group, 2-methoxyethyl group, 4-phenylbutyl group, 4-acetoxyethyl group, 6-phenoxyhexyl group, 12-phenyldodecyl group, 18-phenyloctadecyl group, 12-(p-chlorophenyl)dodecyl group, 2-(diphenyl phosphate)ethyl group and so forth.

The alkyl group other than Rf represented by $R^{A1}$ or $R^{A2}$ is more preferably a substituted or unsubstituted alkyl group having 6–18 carbon atoms. Preferred examples of the unsubstituted alkyl group having 6–18 carbon atoms include n-hexyl group, cyclohexyl group, n-heptyl group, n-octyl group, 2-ethylhexyl group, n-nonyl group, 1,1,3-trimethylhexyl group, n-decyl group, n-dodecyl group, cetyl group, hexadecyl group, 2-hexyldecyl group, octadecyl group, 4-tert-butylcyclohexyl group and so forth. Further, preferred examples of the substituted alkyl group having a total carbon number of 6–18 include phenethyl group, 6-phenoxyhexyl group, 12-phenyldodecyl group, oleyl group, linoleyl group, linolenyl group and so forth.

The alkyl group other than Rf represented by $R^{A1}$ or $R^{A2}$ is particularly preferably n-hexyl group, cyclohexyl group, n-heptyl group, n-octyl group, 2-ethylhexyl group, n-nonyl group, 1,1,3-trimethylhexyl group, n-decyl group, n-dodecyl group, cetyl group, hexadecyl group, 2-hexyldecyl group, octadecyl group, oleyl group, linoleyl group or linolenyl group, most preferably a straight, cyclic or branched unsubstituted alkyl group having a carbon number of 8–16.

In the aforementioned formula (2A), $R^{A3}$, $R^{A4}$ and $R^{A5}$ each independently represent a hydrogen atom or a substituent. As the substituent, Substituent T described later may be used.

$R^{A3}$, $R^{A4}$ and $R^{A5}$ preferably represent an alkyl group or a hydrogen atom, more preferably an alkyl group having 1–12 carbon atoms or a hydrogen atom, further preferably methyl group or a hydrogen atom, particularly preferably a hydrogen atom.

In the aforementioned formula (2A), $L^{A1}$ and $L^{A2}$ each independently represent a single bond or a divalent bridging group. Although it is not particularly limited so long as it is a single bond or a divalent bridging group, it is preferably an arylene group, —O—, —S—, $—NR^{A100}—$ ($R^{A100}$ represents a hydrogen atom or a substituent, and the substituent may be any of the groups exemplified later as Substituent T. $R^{A100}$ is preferably an alkyl group, the group Rf mentioned above or a hydrogen atom, more preferably a hydrogen atom) or a group consisting a combination of these groups, more preferably —O—, —S— or $—NR^{A100}—$. $L^{A1}$ and $L^{A2}$ more preferably represent —O— or $—NR^{A100}—$, further preferably —O— or —NH—, particularly preferably —O—.

In the aforementioned formula (2A), $L^{A3}$ represents a single bond or a divalent bridging group. Although it is not particularly limited so long as it is a single bond or a divalent bridging group, it is preferably an alkylene group, an arylene group, —C(=O)—, —O—, —S—, —S(=O)—, $—S(=O)_2—$, $—NR^{A100}—$ ($R^{A100}$ represents a hydrogen atom or a substituent, the substituent may be any of the groups exemplified later as Substituent T, and $R^{A100}$ is preferably an alkyl group or a hydrogen atom, more preferably a hydrogen atom) or a group consisting a combination of these groups, more preferably an alkylene group having 1–12 carbon atoms, an arylene group 6–12 carbon atoms, —C(=O)—, —O—, —S—, —S(=O)—, $—S(=O)_2—$, $—NR^{A100}—$ or a group consisting a combination of the foregoing groups. $L^{A3}$ is more preferably an alkylene group having 1–8 carbon atoms, —C(=O)—, —O—, —S—, —S(=O)—, $—S(=O)_2—$, $—NR^{A100}—$ or a group consisting a combination of these groups, and examples thereof include the followings.

$—(CH_2)_2—S—$,
$—(CH_2)_2—NH—$,
$—(CH_2)_3—NH—$,
$—(CH_2)_2—C(=O)—NH—$,
$—(CH_2)_2—S—CH_2—$,
$—(CH_2)_2—NHCH_2—$,
$—(CH_2)_3—NH—CH_2—$

In the aforementioned formula (2A) $X^+$ represents a cationic substituent, preferably an organic cationic substituent, more preferably an organic cationic substituent containing a nitrogen or phosphorus atom. It is further preferably a pyridinium cation or ammonium cation, and it is particularly preferably a trialkylammonium cation represented by the following formula (3).

Formula (3)

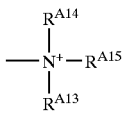

In the aforementioned formula (3), $R^{13A}$, $R^{14A}$ and $R^{15A}$ each independently represent a substituted or unsubstituted alkyl group. As the substituent, those exemplified later as Substituent T can be used. Further, if possible, $R^{13A}$, $R^{14A}$ and $R^{15A}$ may bond to each other to form a ring. $R^{13A}$, $R^{14A}$ and $R^{15A}$ preferably represent an alkyl group having 1–12 carbon atoms, more preferably an alkyl group having 1–6 carbon atoms, further preferably methyl group or ethyl group, particularly preferably methyl group.

In the aforementioned formula (3), $Y^-$ represents a counter anion, and it may be an inorganic anion or an organic anion. When the charge is 0 within the molecule without $Y^-$, there may not be $Y^-$. The inorganic anion is preferably iodide ion, bromide ion, chloride ion or the like, and the organic ion is preferably p-toluenesulfonate ion, benzenesulfonate ion or the like. $Y^-$ is more preferably iodide ion, p-toluenesulfonate ion, or benzenesulfonate ion, particularly preferably p-toluenesulfonate ion.

In the aforementioned formula (2A), $m^A$ represents 0 or 1, preferably 0.

Among the compounds represented by the aforementioned formula (2A), compounds represented by the following formula (2A-1) are preferred.

Formula (2A-1)

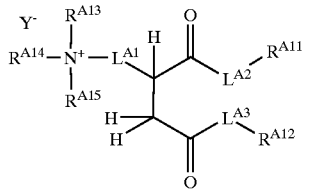

In the formula (2A-1), $R^{A11}$ and $R^{A12}$ each represent a substituted or unsubstituted alkyl group, provided that at least one of $R^{A11}$ and $R^{A12}$ represents an alkyl group substituted with one or more fluorine atoms, and the total carbon atom number of $R^{A11}$ and $R^{A12}$ is 19 or less. $L^{A2}$ and $L^{A3}$ each independently represent —O—, —S— or —$NR^{100}$— where $R^{100}$ represents a hydrogen atom or a substituent, and $L^{A1}$ represents a single bond or a divalent bridging group. $L^{A1}$ and $Y^-$ have the same meanings as defined in the aforementioned formula (2A), respectively, and preferred ranges thereof are also the same as those explained for them in the formula (2A). $R^{13A}$, $R^{14A}$ and $R^{15A}$ have the same meanings as defined in the aforementioned formula (3), respectively, and preferred ranges thereof are also the same as those explained for them in the formula (3).

In the formula (2A-1), $L^{A2}$ and $L^{A3}$ each represent —O—, —S— or —$NR^{100}$— ($R^{A100}$ represents a hydrogen atom or a substituent, and the substituent may be any of the groups exemplified later as Substituent T. $R^{100}$ is preferably an alkyl group, the aforementioned Rf or a hydrogen atom, more preferably a hydrogen atom). $L^{A2}$ and $L^{A3}$ more preferably represent —O— or —NH—, further preferably —O—.

In the aforementioned formula (2A-1), $R^{A11}$ and $R^{21}$ have the same meanings as $R^{A1}$ and $R^{A2}$ in the formula (2A-1), respectively, and the preferred ranges thereof are also the same as those of $R^{A1}$ and $R^{A2}$. However, the total carbon atom number of $R^{A11}$ and $R^{A12}$ is 19 or less.

Among the compounds represented by the aforementioned formula (2), compounds represented by the following formula (2A-2) are more preferred.

Formula (2A-2)

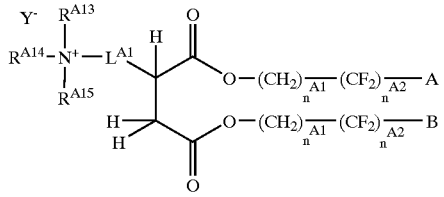

In the aforementioned formula (2A-2), $R^{13A}$, $R^{14A}$, $R^{15A}$, $L^{A1}$ and $Y^-$ have the same meanings as those mentioned in the formulas (2A) and (3), and preferred ranges thereof are also the same. A and B each independently represent a fluorine atom or a hydrogen atom. It is preferred that both of A and B represent a fluorine atom or both of A and B represent a hydrogen atom, and it is more preferred that both of A and B represent a fluorine atom.

In the formula (2A-2), $n^{A1}$ represents an integer of 1–6, and $n^{A2}$ represents an integer of 3–8.

Among the compounds represented by the aforementioned formula (2A), compounds represented by the following formula (2A-3) are further preferred.

Formula (2A-3)

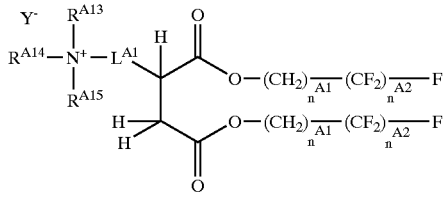

In the formula (2A-3), $n^{A1}$ represents an integer of 1–6, and $n^{A2}$ represents an integer of 3–8, provided that $2(n^{A1}+n^{A2})$ is 19 or less. $R^{13A}$, $R^{14A}$, $R^{15A}$, $L^{A1}$ and $Y^-$ have the same meanings as those mentioned in the formulas (2A) and (3), and preferred ranges thereof are also the same.

$n^{A1}$ represents an integer of 1–6, preferably an integer of 1–3, further preferably 2 or 3, most preferably 2. $n^{A2}$ represents an integer of 3–8, more preferably 3–6, further preferably 4–6. As for preferred combination of $n^{A1}$ and $n^{A2}$, it is preferred that $n^{A1}$ is 2 or 3, and $n^{A2}$ is 4 or 6.

Specific examples of the compounds represented by the aforementioned formula (2A) are mentioned below. However, the present invention is not limited by the following specific examples at all. The alkyl groups and perfluoroalkyl groups mentioned in the structures of the following exemplary compounds have straight chain structures unless otherwise indicated. The abbreviations "2EH" and "2BO" in the following structures indicate 2-ethylhexyl and 2-butyloctyl, respectively.

FS-101

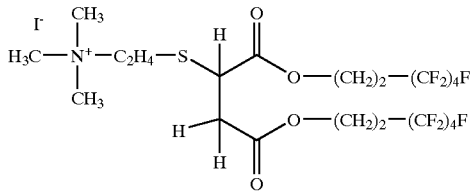

FS-102

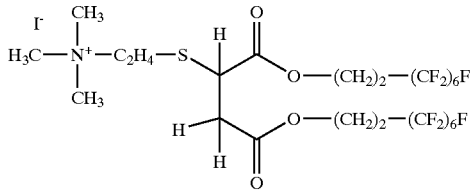

FS-103

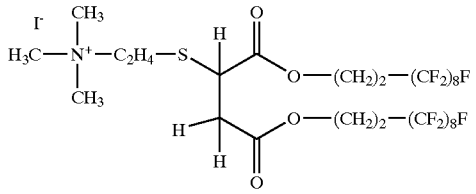

-continued
FS-104
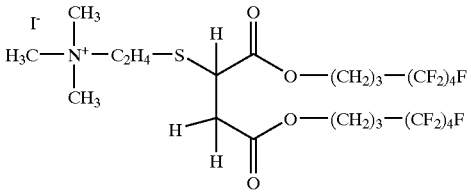
FS-105
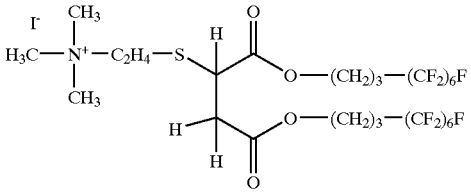
FS-106
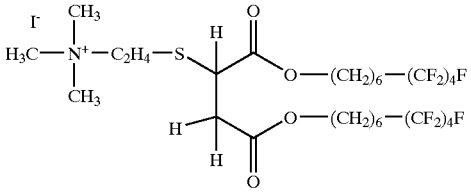
FS-107
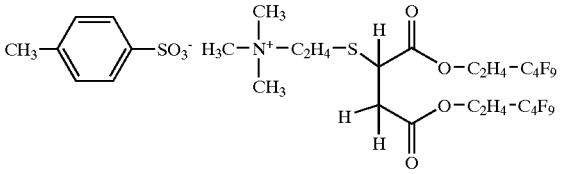
FS-108
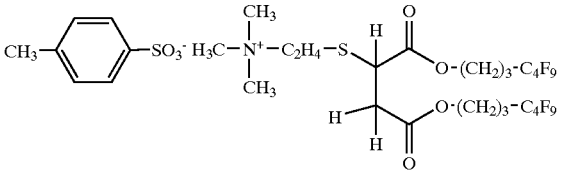
FS-109
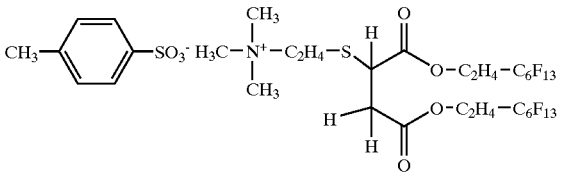
FS-110
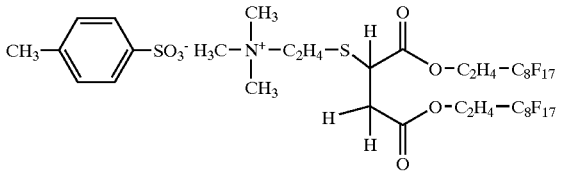
-continued
FS-111
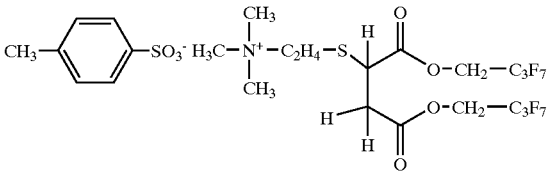
FS-112
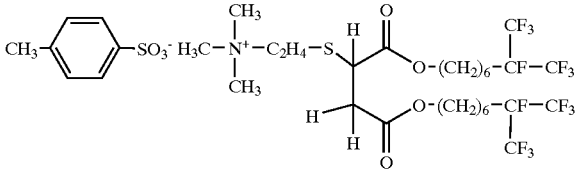
FS-113
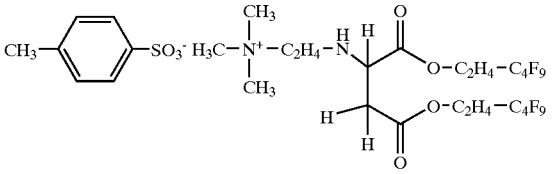
FS-114
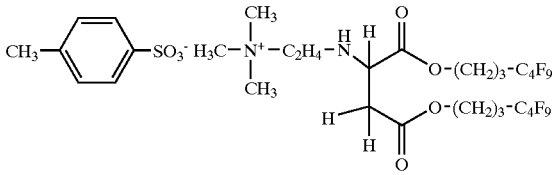
FS-115
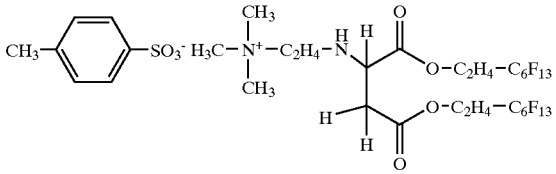
FS-116
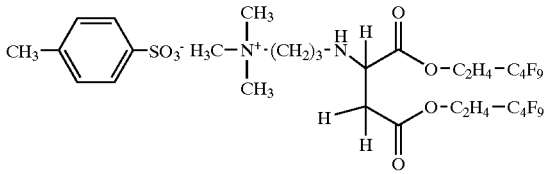
FS-117
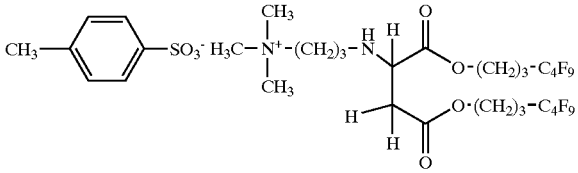
FS-118
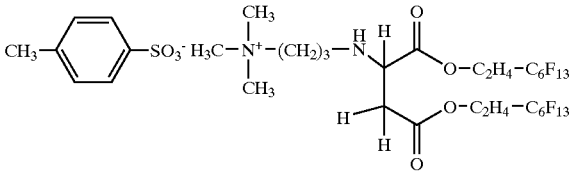

-continued
FS-119
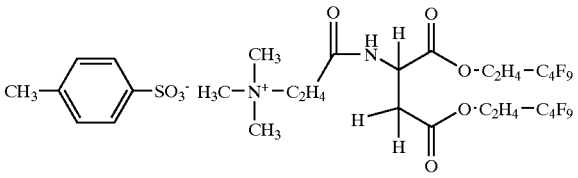
FS-120
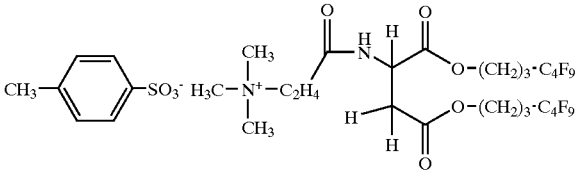
FS-121
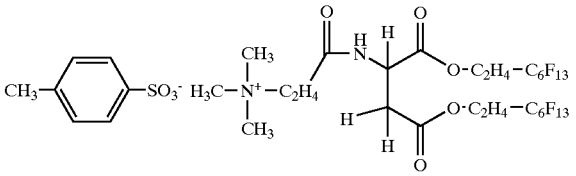
FS-122
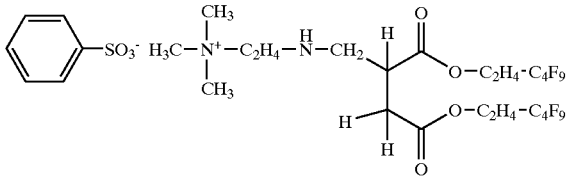
FS-123
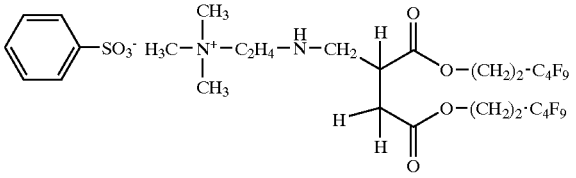
FS-124
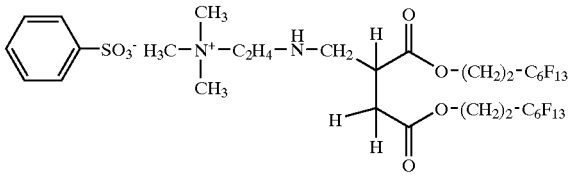
FS-125
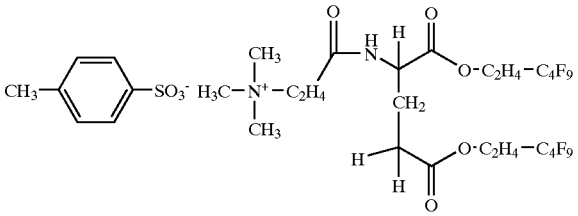
-continued
FS-126
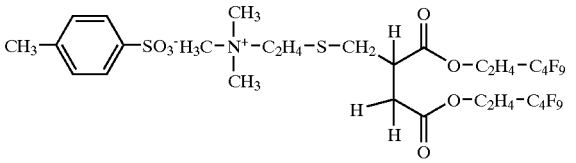
FS-127
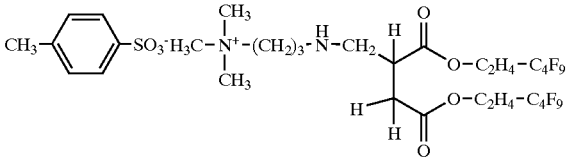
FS-128
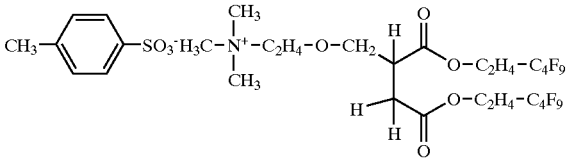
FS-129
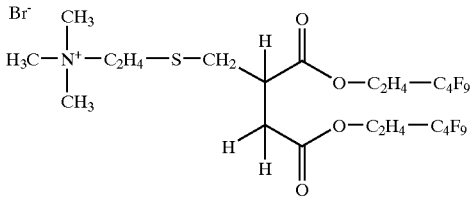
FS-130
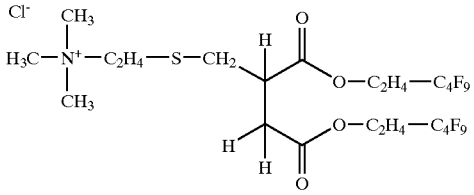
FS-131
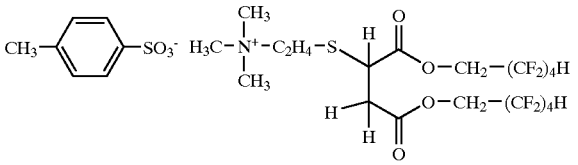
FS-132
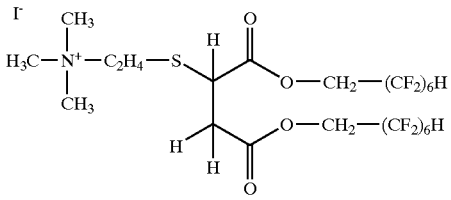
FS-133
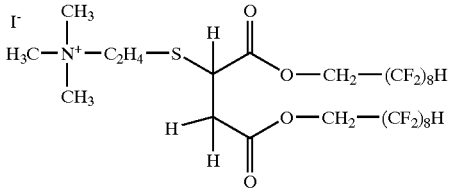

-continued
FS-134
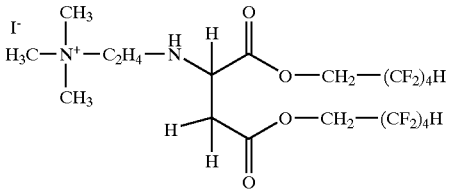
FS-135
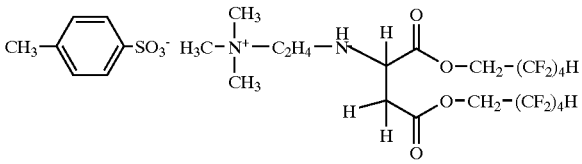
FS-136
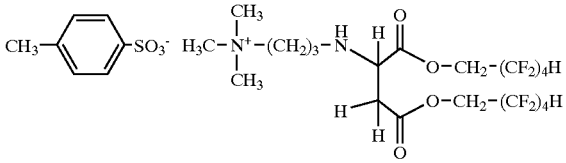
FS-137
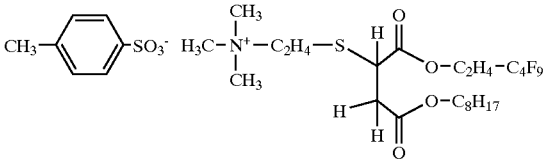
FS-138
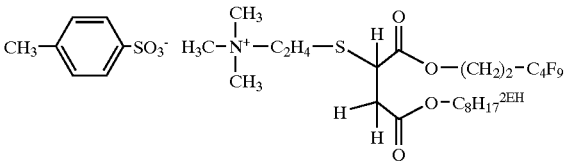
FS-139
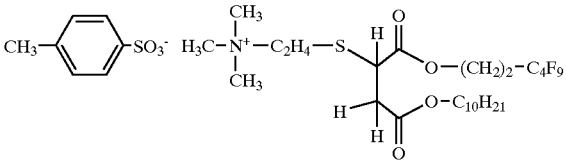
FS-140
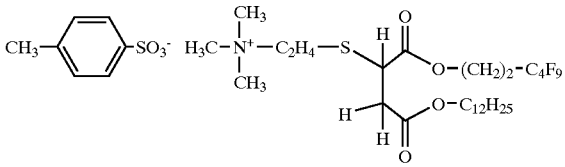
FS-141
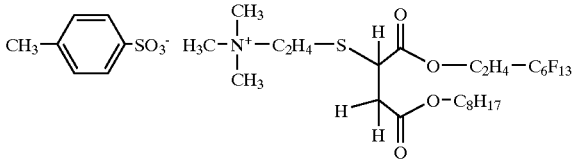
-continued
FS-142
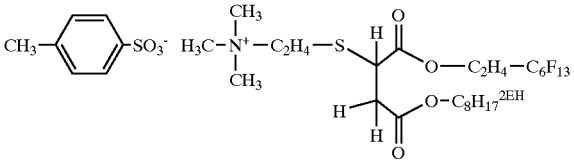
FS-143
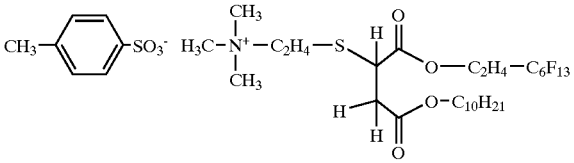
FS-144
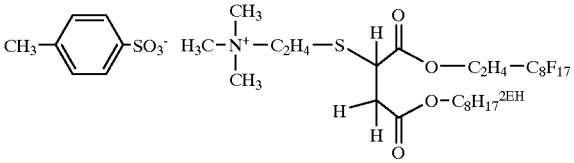
FS-145
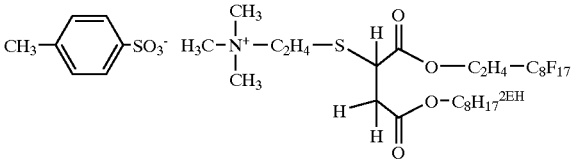
FS-146
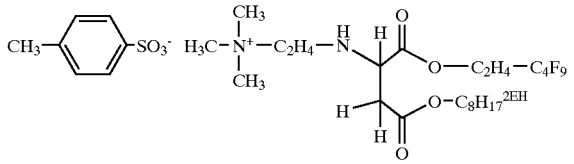
FS-147
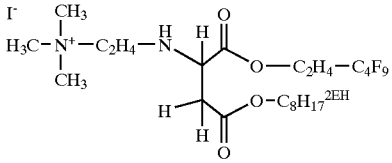
FS-148
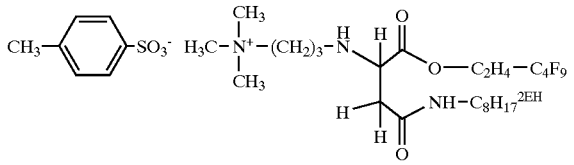
FS-149
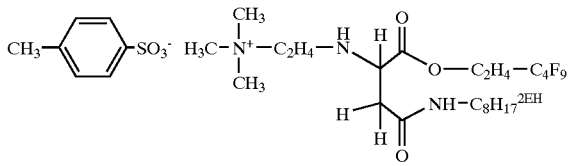

-continued
FS-150
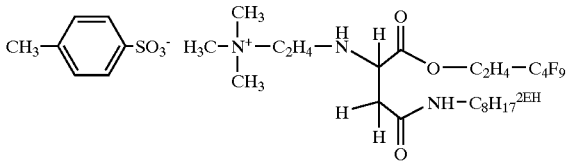
FS-151
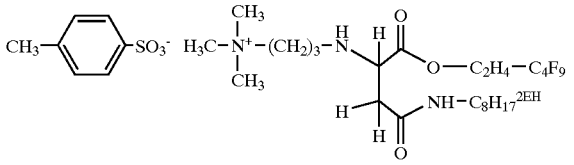
FS-152
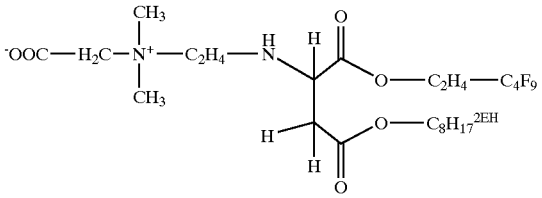
FS-153
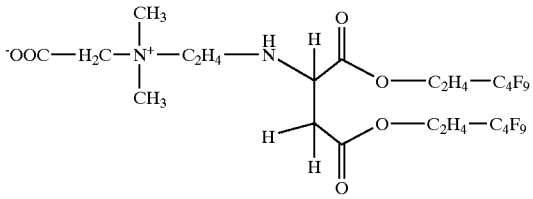
FS-154
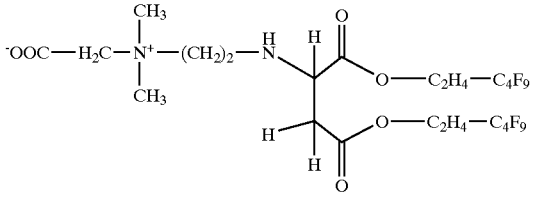
FS-155
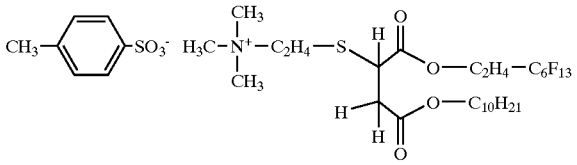
FS-156
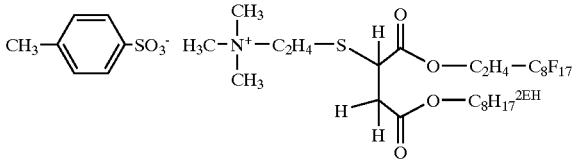
-continued
FS-157
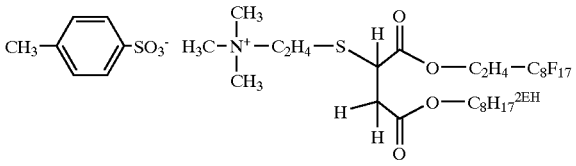
FS-158
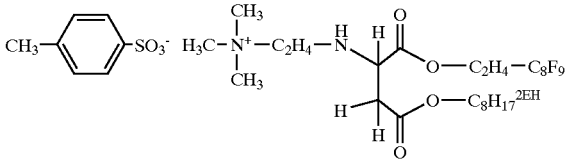
FS-159
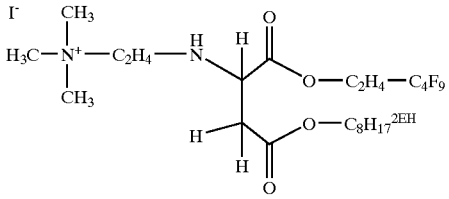
FS-160
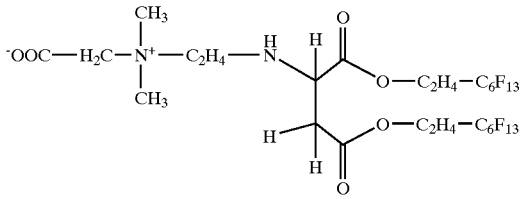
FS-161
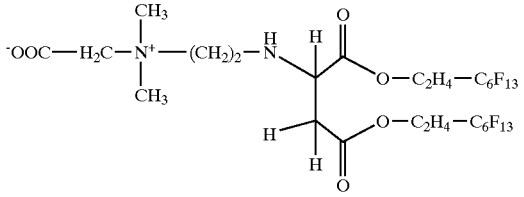
FS-162
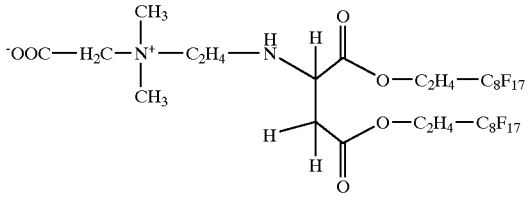
FS-163
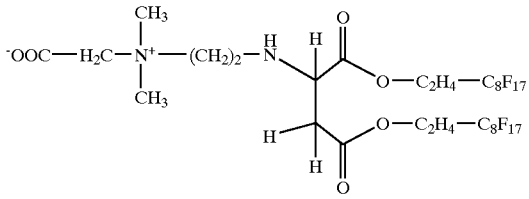

-continued

FS-164

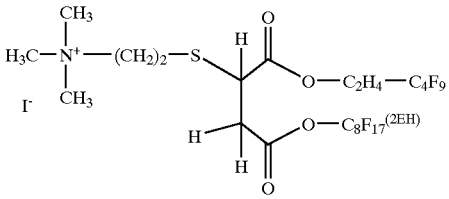

FS-165

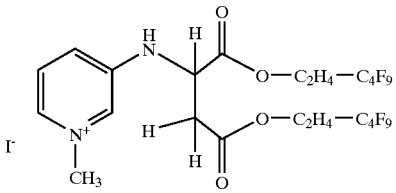

FS-166

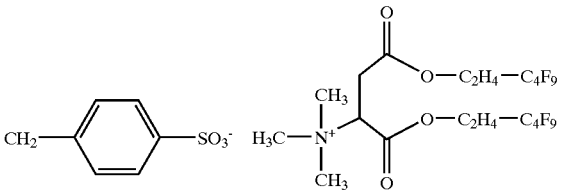

FS-167

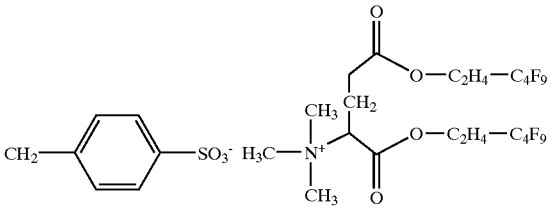

FS-168

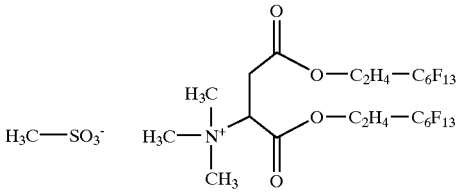

FS-169

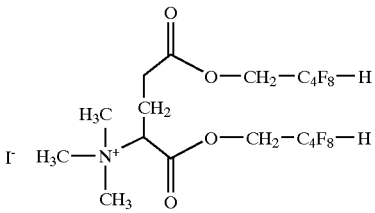

FS-170

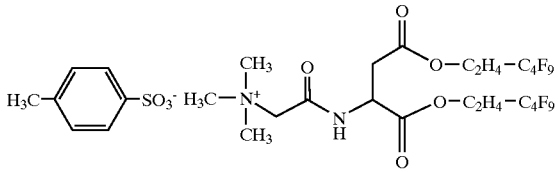

-continued

FS-171

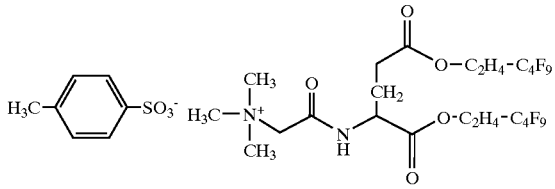

FS-172

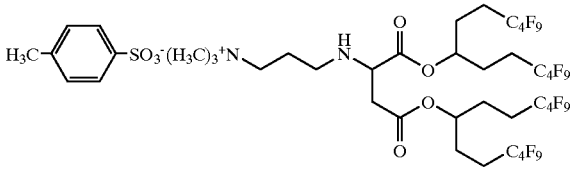

FS-173

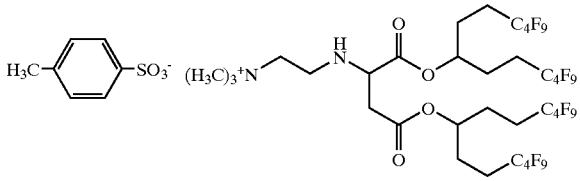

FS-174

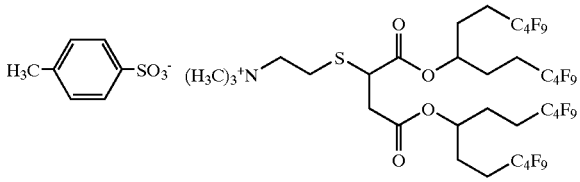

FS-175

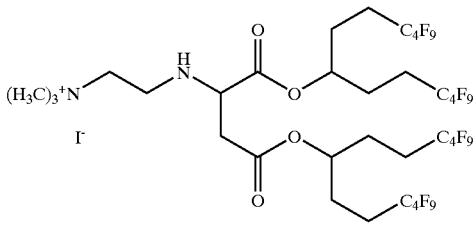

FS-176

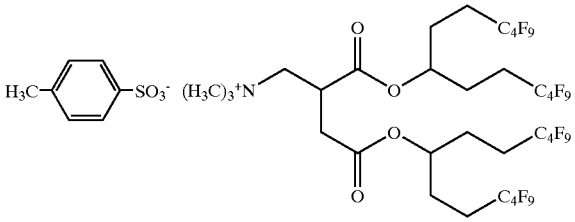

The compounds represented by the aforementioned formula (2A) can be synthesized from a fumaric acid derivative, maleic acid derivative, itaconic acid derivative, glutamic acid derivative, aspartic acid derivative or the like used as a starting material. For example, when a fumaric acid derivative, maleic acid derivative or itaconic acid derivative is used as a starting material, they can be synthesized by performing the Michael addition reaction for a double bond of the starting material using a nucleophilic species and then making the product into a cation using an alkylating agent.

The compounds of the aforementioned formula (2A) will be specifically explained with reference to the following synthetic examples. However, the present invention is not limited by the following specific examples at all.

SYNTHESIS EXAMPLE 3

Synthesis of FS-113

3-1 Synthesis of 1,4-di(3,3,4,4,5,5,6,6,6-nonafluorohexyl) 2-(2-(N,N-dimethylamino) ethylamino)succinate 1,4-di(3,3,4,4,5,5,6,6,6-nonafluorohexyl) succinate (500 g, 0.82 mol), N,N-dimethylaminoethylamine (79.5 g, 0.90 mol) and potassium carbonate (11.3 g, 0.08 mol) were dissolved in acetonitrile (500 mL) and refluxed with heating for 45 minutes. Then, the reaction mixture was transferred to a separating funnel and added with ethyl acetate (2 L). The organic phase was washed with an aqueous solution of sodium chloride (1.5 L) and collected, and the organic solvent was evaporated under reduced pressure to obtain the target compound (453 g, yield: 79%) as light yellow oil.

3-2 Synthesis of FS-113

The above compound (380 g, 0.55 mol), methyl p-toluenesulfonate (101.6 g, 0.55 mmol) and ethyl acetate (1500 mL) were mixed and refluxed for 2 hours with heating, and then the insoluble matter was removed by filtration. The filtrate was cooled on an ice bath with stirring. After awhile, crystals deposited from the filtrate. The obtained crystals were collected by filtration, washed with ethyl acetate and dried under reduced pressure at 80° C. for 2 hours. The target compound was obtained as colorless transparent solid (300 g, yield: 62%).

The $^1$H-NMR data of the obtained compound are as follows.

$^1$H-NMR (DMSO-$d_6$): δ 2.50 (s, 3H), 2.61–2.73 (br, 8H), 3.07 (s, 9H), 3.33 (m, 2H), 3.66 (m, 1H), 4.30–4.40 (m, 4H), 7.11 (d, 2H), 7.48 (d, 2H).

Hereafter, the compound represented by the following formula (2B) will be explained in detail.

Formula (2B)

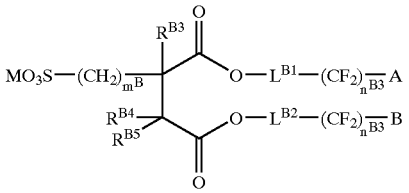

In the aforementioned formula (2B), $R^{B3}$, $R^{B4}$ and $R^{B5}$ each independently represent a hydrogen atom or a substituent. A and B each independently represent a fluorine atom or a hydrogen atom. $n^{B3}$ and $n^{B4}$ each independently represent an integer of 4–8. $L^{B1}$ and $L^{B2}$ each independently represent a substituted or unsubstituted alkylene group, a substituted or unsubstituted alkyleneoxy group or a divalent bridging group consisting of a combination of these. $m^B$ represents 0 or 1. M represents a cation.

In the aforementioned formula (2B), $R^{B3}$, $R^{B4}$ and $R^{B5}$ each independently represent a hydrogen atom or a substituent. As the substituent, Substituent T described later may be used. $R^{B3}$, $R^{B4}$ and $R^{B5}$ preferably represent an alkyl group or a hydrogen atom, more preferably an alkyl group having 1–12 carbon atoms or a hydrogen atom, further preferably methyl group or a hydrogen atom, particularly preferably a hydrogen atom.

In the aforementioned formula (2B), A and B each independently represent a fluorine atom or a hydrogen atom. It is preferred that both of A and B represent a fluorine atom or both of A and B represent a hydrogen atom, and it is more preferred that both of A and B represent a fluorine atom.

In the aforementioned formula (2B), $n^{B3}$ and $n^{B4}$ each independently represent an integer of 4–8. It is preferred that $n^{B3}$ and $n^{B4}$ represent an integer of 4–6 and $n^{B3}=n^{B4}$, it is more preferred that $n^{B3}$ and $n^{B4}$ represent an integer of 4 or 6 and $n^{B3}=n^{B4}$, and it is further preferred that $n^{B3}=n^{B4}=4$.

In the aforementioned formula (2B), $m^B$ represents 0 or 1, and both are similarly preferred.

In the aforementioned formula (2B), $L^{B1}$ and $L^{B2}$ each independently represent a substituted or unsubstituted alkylene group, a substituted or unsubstituted alkyleneoxy group or a divalent bridging group consisting of a combination of these. As the substituent, Substituent T described later may be used. $L^{B1}$ and $L^{B2}$ each preferably have 4 or less carbon atoms, and preferably represent an unsubstituted alkylene group.

M represents a cation and has the same meaning as M mentioned in the aforementioned formula (1). M is preferably lithium ion, sodium ion, potassium ion or ammonium ion, more preferably lithium ion, sodium ion or potassium ion, further preferably sodium ion.

Among the compounds represented by the aforementioned formula (2B), compounds represented by the following formula (2B-1) are preferred.

Formula (2B-1)

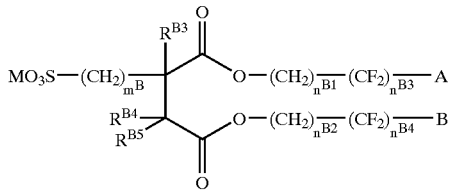

In the aforementioned formula (2B-1), $R^{B3}$, $R^{B4}$, $R^{B5}$, $n^{B3}$, $n^{B4}$, $m^B$, A, B and M have the same meanings as those defined in the aforementioned formula (2B), and the preferred ranges are also the same. $n^{B1}$ and $n^{B2}$ each independently represent an integer of 1–6.

In the aforementioned formula (2B-1), $n^{B1}$ and $n^{B2}$ each independently represent an integer of 1–6. It is preferred that $n^{B1}$ and $n^{B2}$ represents an integer of 1–6 and $n^{B1}=n^{B2}$, it is more preferred that $n^{B1}$ and $n^{B2}$ represents an integer of 2 or 3 and $n^{B1}=n^{B2}$, and it is still more preferred that $n^{B1}=n^{B2}=2$.

Among the compounds represented by the aforementioned formula (2B), compounds represented by the following formula (2B-2) are more preferred.

Formula (2B-2)

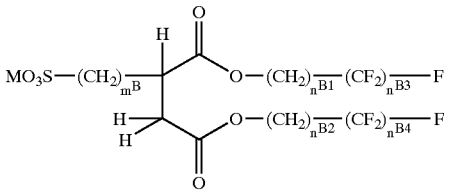

In the aforementioned formula (2B-2), $n^{B3}$, $n^{B4}$, $m^{B}$ and M have the same meanings as those defined in the aforementioned formula (2B), and the preferred ranges are also the same. In the aforementioned formula (2B-2), $n^{B1}$ and $n^{B2}$ have the same meanings as those defined in the aforementioned formula (2B) and the preferred ranges are also the same.

Among the compounds represented by the aforementioned formula (2B), compounds represented by the following formula (2B-3) are still more preferred.

Formula (2B-3)

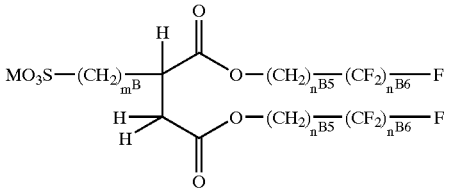

In the aforementioned formula (2B-3), $n^{B5}$ represents 2 or 3, and $n^{B6}$ represents an integer of 4–6. $m^{B}$ represents 0 or 1, and both are similarly preferred. M has the same meaning as M mentioned in the aforementioned formula (2B), and the preferred range is also the same.

Specific examples of the compounds represented by the aforementioned formula (2B) are shown below. However, the present invention is not limited by the following specific examples at all.

FS-201

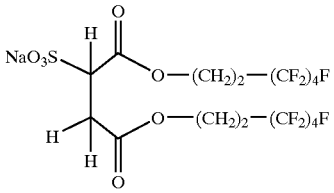

FS-202

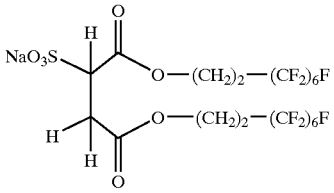

-continued

FS-203

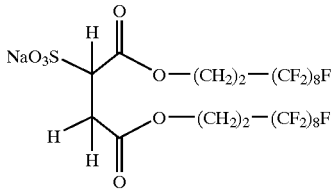

FS-204

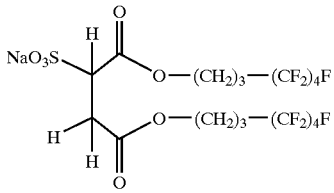

FS-205

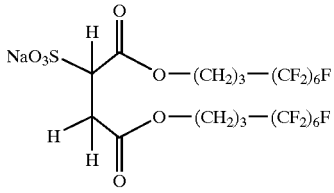

FS-206

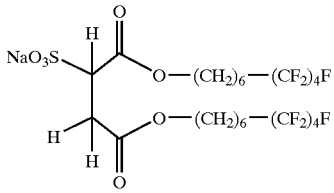

FS-207

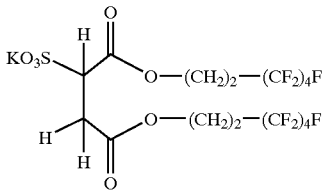

FS-208

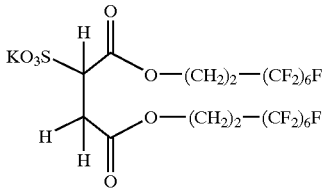

FS-209

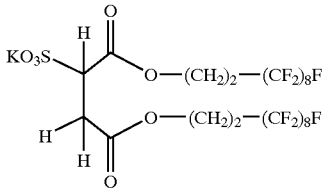

FS-210

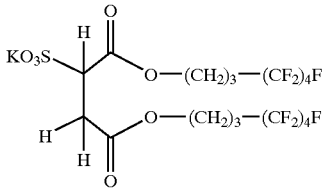

-continued
FS-211
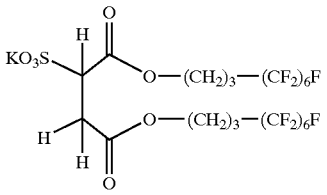
FS-212
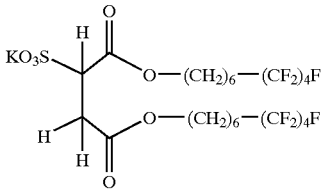
FS-213
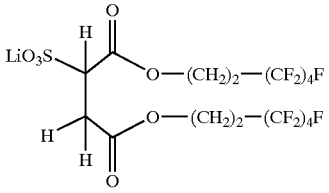
FS-214
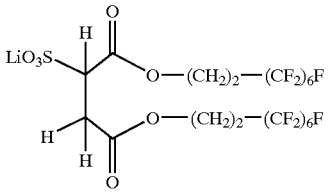
FS-215
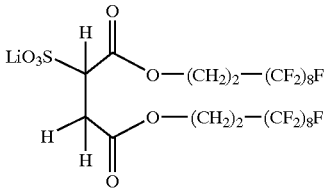
FS-216
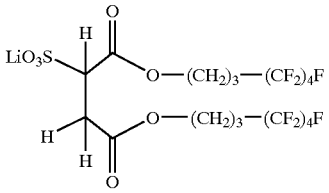
FS-217
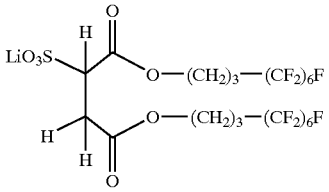
FS-218
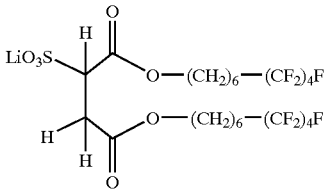
-continued
FS-219
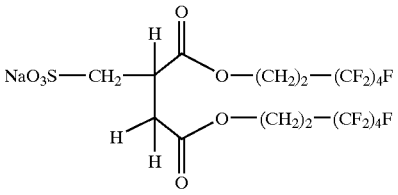
FS-220
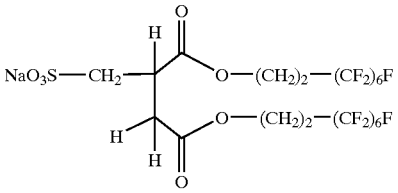
FS-221
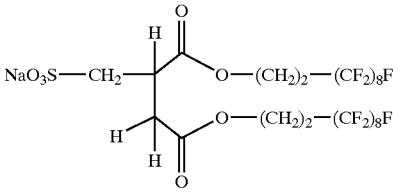
FS-222
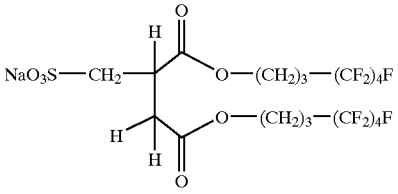
FS-223
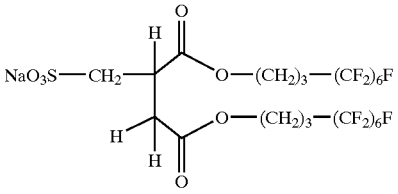
FS-224
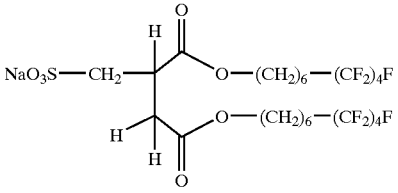
FS-225
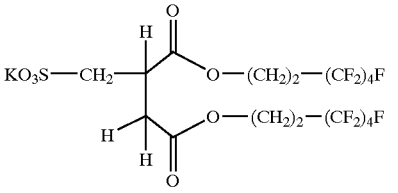
FS-226
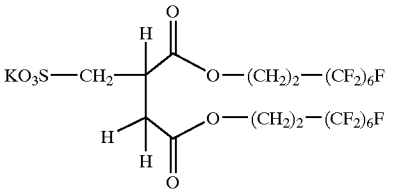

-continued
FS-227
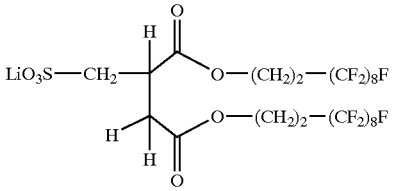
FS-228
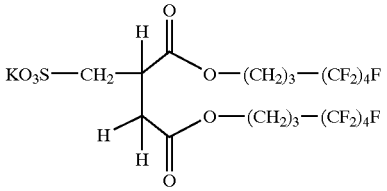
FS-229
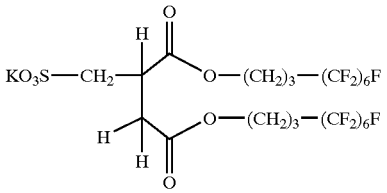
FS-230
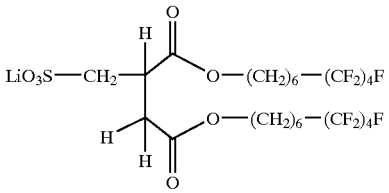
FS-231
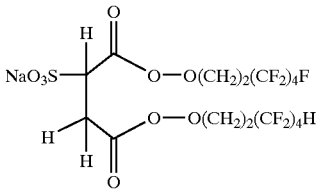
FS-232
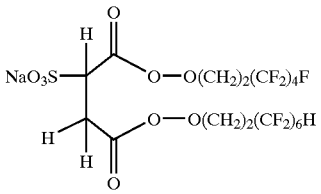
FS-233
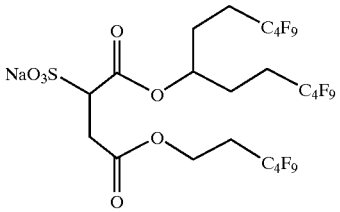
-continued
FS-234
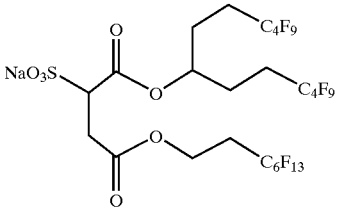
FS-235
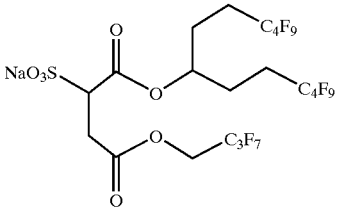
FS-236
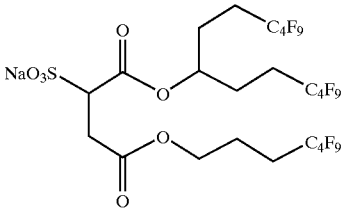
FS-237
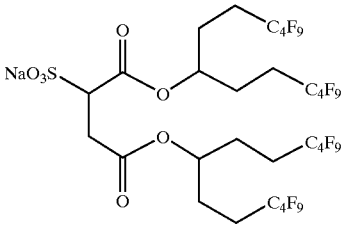
FS-238
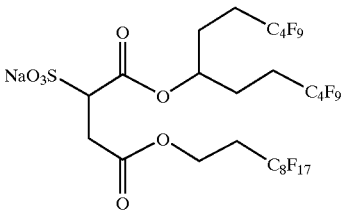
FS-239
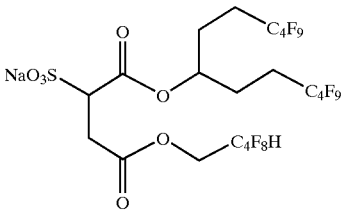
FS-240
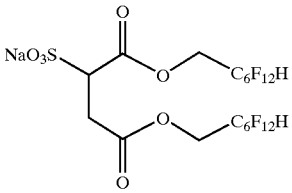

The compounds represented by the aforementioned formula (2B) can be easily synthesized by combining a usual esterification reaction and a sulfonation reaction. Moreover, the counter cation can easily be changed by using an ion exchange resin. Examples of typical synthesis methods will be mentioned below. However, the present invention is not limited by the following specific examples at all.

SYNTHESIS EXAMPLE 4

Synthesis of FS-201

4-1 Synthesis of di(3,3,4,4,5,5,6,6,6-nonafluorohexyl)maleate

Maleic anhydride (90.5 g, 0.924 mol), 3,3,4,4,5,5,6,6,6-nonafluorohexanol (500 g, 1.89 mol) and p-toluenesulfonic acid monohydrate (17.5 g, 0.09 mol) were refluxed with heating in toluene (1000 ml) for 20 hours, while the produced water was evaporated. Then, the reaction mixture was cooled to room temperature and further added with toluene. The organic phase was washed with water, and the solvent was evaporated under reduced pressure to obtain the target substance (484 g, yield: 86%) as transparent liquid.

4-2 Synthesis of FS-201

Di(3,3,4,4,5,5,6,6,6-nonafluorohexyl)maleate (514 g, 0.845 mol), sodium hydrogensulfite (91.0 g, 0.875 mol) and water/ethanol (250 mL, 1:1 (v/v)) were mixed and refluxed for 6 hours with heating. Then, the reaction mixture was added with ethyl acetate (500 mL) and saturated sodium chloride aqueous solution (120 mL) to perform extraction. The organic phase was collected and added with sodium sulfate for dehydration. The sodium sulfate was removed by filtration, and the filtrate was concentrated, then added with acetone (2.5 L) and heated. After the insoluble matter was removed by filtration, the filtrate was cooled to 0° C. and slowly added with acetonitrile (2.5 L) The deposited solid was collected by filtration, and the obtained crystals were dried at 80° C. under reduced pressure to obtain the target compound (478 g, yield: 79%) as white crystals.

The $^1$H-NMR data of the obtained compound are as follows.

$^1$H-NMR (DMSO-$d_6$): δ 2.49–2.62 (m, 4H), 2.85–2.99 (m, 2H), 3.68 (dd, 1H), 4.23–4.35 (m, 4H).

SYNTHESIS EXAMPLE 5

Synthesis of FS-219

5-1 Synthesis of di(3,3,4,4,5,5,6,6,6-nonafluorohexyl)itaconate

Itaconic anhydride (13.5 g, 0.12 mol), 3,3,4,4,5,5,6,6,6-nonafluorohexanol (69.8 g, 0.26 mol) and p-toluenesulfonic acid monohydrate (1.14 g, 6 mmol) were refluxed with heating in toluene (500 mL) for 12 hours, while the produced water was evaporated. Then, the reaction mixture was cooled to room temperature and further added with ethyl acetate. The organic phase was washed with 1 mol/L aqueous solution of sodium hydroxide and a saturated aqueous solution of sodium chloride to obtain the target substance (51.3 g, yield: 69%) as an oily compound.

5-2 Synthesis of FS-219

Di(3,3,4,4,5,5,6,6,6-nonafluorohexyl)itaconate (20.0 g, 32 mmol), sodium hydrogensulfite (4.0 g, 38 mmol) and water/ethanol (25 mL, 1:1 (v/v)) were mixed and refluxed for 6 hours with heating. Then, the reaction mixture was further added with ethyl acetate, and the organic layer was washed with saturated sodium chloride aqueous solution. Then, the solvent was evaporated under reduced pressure, and the residue was recrystallized from acetonitrile. The obtained crystals were dried at 80° C. under reduced pressure to obtain the target compound (20.6 g, yield: 89%) as white crystals.

The $^1$H-NMR data of the obtained compound are as follows.

$^1$H-NMR (DMSO-$d_6$): δ 2.49–2.78 (m, 5H), 3.04–3.13 (m, 2H), 3.47 (br, 2H), 4.23 (t, 4H).

Hereafter, the compounds represented by the following formula (2C) will be explained in detail.

Formula (2C)

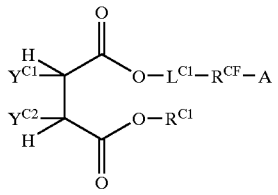

In the aforementioned formula (2C), $R^{C1}$ represents a substituted or unsubstituted alkyl group, and $R^{CF}$ represents a perfluoroalkylene group. A represents a hydrogen atom or a fluorine atom, and $L^{C1}$ represents a substituted or unsubstituted alkylene group, a substituted or unsubstituted alkyleneoxy group or a divalent bridging group consisting of a combination of these. One of $Y^{C1}$ and $Y^{C2}$ represents a hydrogen atom, and the other represents $-L^{C2}-SO_3M$, where $L^{C2}$ represents a single bond or a substituted or unsubstituted alkylene group and M represents a cation.

In the aforementioned formula (2C), $R^{C1}$ represents a substituted or unsubstituted alkyl group. The substituted or unsubstituted alkyl group represented by $R^{C1}$ may be linear or branched, and may have a cyclic structure. As the substituent, Substituent T described later can be used. The substituent is preferably an alkenyl group, an aryl group, an alkoxyl group, a halogen atom (preferably Cl), a carboxylic acid ester group, a carbonamido group, a carbamoyl group, an oxycarbonyl group, a phosphoric acid ester group or the like.

$R^{C1}$ is preferably an unsubstituted alkyl group, more preferably an unsubstituted alkyl group having 2–24 carbon atoms, further preferably an unsubstituted alkyl group having 4–20 carbon atoms, particularly preferably an unsubstituted alkyl group having 6–24 carbon atoms.

$R^{CF}$ represents a perfluoroalkylene group. The perfluoroalkylene group used herein means an alkylene group all of which hydrogen atoms are replaced with fluorine atoms. The perfluoroalkylene group may be straight or branched, or it may have a cyclic structure. $R^{CF}$ preferably has 1–10 carbon atoms, more preferably 1–8 carbon atoms.

A represents a hydrogen atom or a fluorine atom, preferably a fluorine atom.

$L^{C1}$ represents a substituted or unsubstituted alkylene group, a substituted or unsubstituted alkyleneoxy group or a divalent bridging group consisting of a combination of these. The preferred range of the substituent is the same as that of the substituent mentioned for $R^{C1}$. $L^{C1}$ preferably has 4 or less carbon atoms, and it is preferably an unsubstituted alkylene group.

One of $Y^{C1}$ and $Y^{C2}$ represents a hydrogen atom, and the other represents $-L^{C2}-SO_3M$, where M represents a cation. Examples of the cation represented by M include, for example, alkali metal ions (lithium ion, sodium ion, potassium ion etc.), alkaline earth metal ions (barium ion, calcium ion etc.), ammonium ions and so forth. Among these, more preferred are lithium ion, sodium ion, potassium ion and ammonium ions, and still more preferred are lithium ion, sodium ion and potassium ion. It can be suitably selected depending on the total carbon atom number, substituents and branching degree of the alkyl group of the compounds of the formula (2C) and so forth. When the total carbon atom number of $R^{C1}$, $R^{CF}$ and $L^{C1}$ is 16 or more, M is preferably lithium ion in view of compatibility of solubility (especially for water) and antistatic property or coatability for uniform coating.

$L^{C2}$ represents a single bond or a substituted or unsubstituted alkylene group. The preferred range of the substituent is the same as that of the substituent for $R^{C1}$.

$L^{C2}$ is preferably a single bond or an alkylene group having 2 or less carbon atoms, more preferably a single bond or an unsubstituted alkylene group, further preferably a single bond or methylene group, particularly preferably a single bond.

Among the compounds represented by the aforementioned formula (2C), compounds represented by the following formula (2C-1) are preferred.

Formula (2C-1)

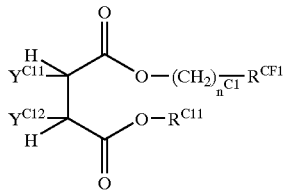

In the aforementioned formula (2C-1), $R^{C11}$ represents a substituted or unsubstituted alkyl group having 6 or more carbon atoms. $R^{CF1}$ represents a perfluoroalkyl group having 6 or less carbon atoms. One of $Y^{C11}$ and $Y^{C12}$ represents a hydrogen atom, and the other represents $SO_3M^C$, where $M^C$ represents a cation. $n^{C1}$ represents an integer of 1 or more.

In the aforementioned formula (2C-1), $R^{C11}$ represents a substituted or unsubstituted alkyl group having 6 or more carbon atoms in total. However, $R^{C11}$ is not an alkyl group substituted with a fluorine atom. The substituted or unsubstituted alkyl group represented by $R^{C11}$ may be linear or branched, or may have a cyclic structure. Examples of the substituent include an alkenyl group, an aryl group, an alkoxyl group, a halogen atom other than fluorine, a carboxylic acid ester group, a carbonamido group, a carbamoyl group, an oxycarbonyl group, a phosphoric acid ester group and so forth.

The substituted or unsubstituted alkyl group represented by $R^{C11}$ preferably has 6–24 carbon atoms in total. Preferred examples of the unsubstituted alkyl group having 6–24 carbon atoms include n-hexyl group, n-heptyl group, n-octyl group, tert-octyl group, 2-ethylhexyl group, n-nonyl group, 1,1,3-trimethylhexyl group, n-decyl group, n-dodecyl group, cetyl group, hexadecyl group, 2-hexyldecyl group, octadecyl group, eicosyl group, 2-octyldodecyl group, docosyl group, tetracosyl group, 2-decyltetradecyl group, tricosyl group, cyclohexyl group, cycloheptyl group and so forth. Further, preferred examples of the substituted alkyl group having 6–24 carbon atoms in total including carbon atoms of substituent include 2-hexenyl group, oleyl group, linoleyl group, linolenyl group, benzyl group, β-phenethyl group, 2-methoxyethyl group, 4-phenylbutyl group, 4-acetoxyethyl group, 6-phenoxyhexyl group, 12-phenyldodecyl group, 18-phenyloctadecyl group, 12-(p-chlorophenyl)dodecyl group, 2-(diphenyl phosphate)ethyl group and so forth.

The substituted or unsubstituted alkyl group represented by $R^{C11}$ more preferably has 6–18 carbon atoms in total. Preferred examples of the unsubstituted alkyl group having 6–18 carbon atoms include n-hexyl group, cyclohexyl group, n-heptyl group, n-octyl group, 2-ethylhexyl group, n-nonyl group, 1,1,3-trimethylhexyl group, n-decyl group, n-dodecyl group, cetyl group, hexadecyl group, 2-hexyldecyl group, octadecyl group, 4-tert-butylcyclohexyl group and so forth. Further, preferred examples of the substituted alkyl group having 6–18 carbon atoms in total including carbon atoms of substituent include phenethyl group, 6-phenoxyhexyl group, 12-phenyldodecyl group, oleyl group, linoleyl group, linolenyl group and so forth. Among these, $R^{C11}$ is more preferably n-hexyl group, cyclohexyl group, n-heptyl group, n-octyl group, 2-ethylhexyl group, n-nonyl group, 1,1,3-trimethylhexyl group, n-decyl group, n-dodecyl group, cetyl group, hexadecyl group, 2-hexyldecyl group, octadecyl group, oleyl group, linoleyl group or linolenyl group, particularly preferably a linear, cyclic or branched unsubstituted alkyl group having 8–16 carbon atoms.

In the aforementioned formula (2C-1), $R^{CF1}$ represents a perfluoroalkyl group having 6 or less carbon atoms. The perfluoroalkyl group used herein means an alkyl group all of which hydrogen atoms are replaced with fluorine atoms. The alkyl group in the perfluoroalkyl group may be linear or branched, or it may have a cyclic structure. Examples of the perfluoroalkyl group represented by $R^{CF1}$ include, for example, trifluoromethyl group, pentafluoroethyl group, heptafluoro-n-propyl group, heptafluoroisopropyl group, nonafluoro-n-butyl group, undecafluoro-n-pentyl group, tridecafluoro-n-hexyl group, undecafluorocyclohexyl group and so forth. Among these, perfluoroalkyl groups having 2–4 carbon atoms (e.g., pentafluoroethyl group, heptafluoro-n-propyl group, heptafluoroisopropyl group, nonafluoro-n-butyl group etc.) are preferred, and heptafluoro-n-propyl group and nonafluoro-n-butyl group are particularly preferred.

In the aforementioned formula (2C-1), $n^{C1}$ represents an integer of 1 or more. It is preferably an integer of 1–4, particularly preferably 1 or 2.

Further, as for the combination of $n^{C1}$ and $R^{CF1}$, when $n^{C1}=1$, $R^{CF1}$ is preferably heptafluoro-n-propyl group or nonafluoro-n-butyl-group; and when $n^{C1}=2$, $R^{CF1}$ is more preferably nonafluoro-n-butyl group.

In the aforementioned formula (2C-1), one of $Y^{C11}$ and $Y^{C12}$ represents a hydrogen atom, and the other represents $SO_3M^C$, where $M^C$ represents a cation. Examples of the cation represented by $M^C$ include, for example, alkali metal ions (lithium ion, sodium ion, potassium ion etc.), alkaline earth metal ions (barium ion, calcium ion etc.), ammonium ions and so forth. Among these, particularly preferred are lithium ion, sodium ion, potassium ion and ammonium ions, and most preferred is sodium ion.

Specific examples of the compounds represented by the aforementioned formula (2C) are shown below. However, the present invention is not limited by the following specific examples at all.

FS-301
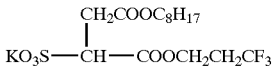
FS-302
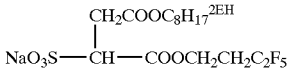
FS-303
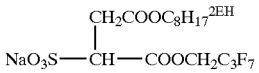
FS-304
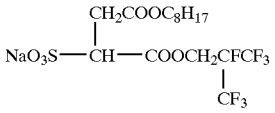
FS-305
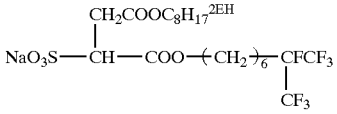
FS-306
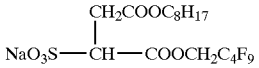
FS-307
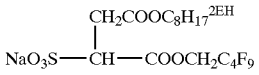
FS-308
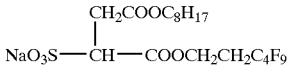
FS-309
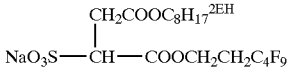
FS-310
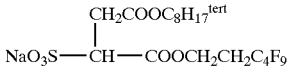
FS-311
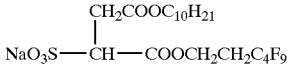
FS-312
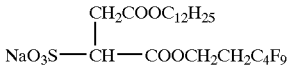
FS-313
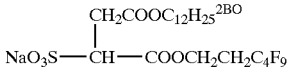
FS-314
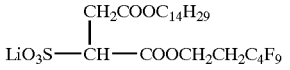
FS-315
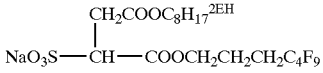
FS-316
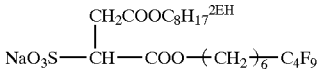
FS-317
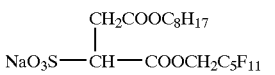
-continued
FS-318
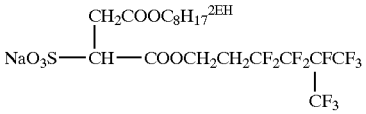
FS-319
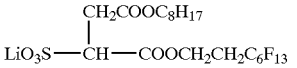
FS-320
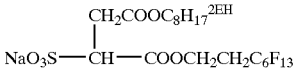
FS-321
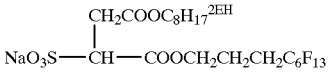
FS-322
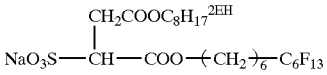
FS-323
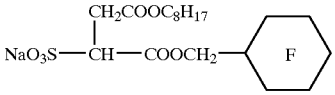
FS-324
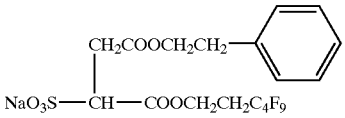
FS-325
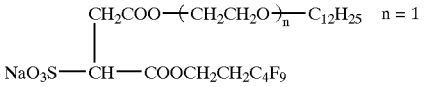
FS-326
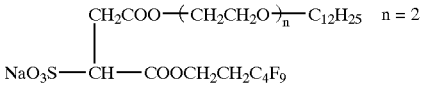
FS-327
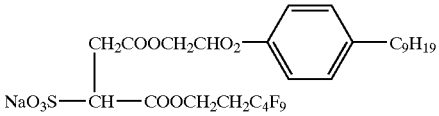
FS-328
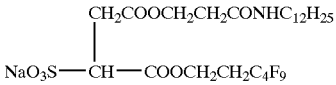
FS-329
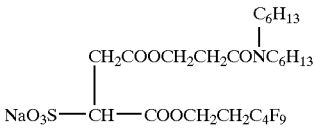
FS-330
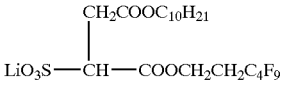
FS-331
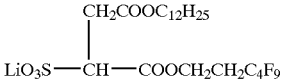
FS-332
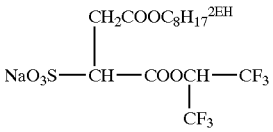

-continued

FS-333

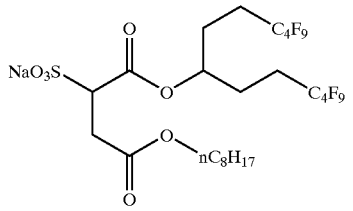

FS-334

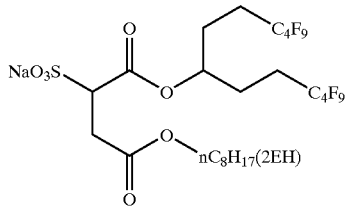

FS-335

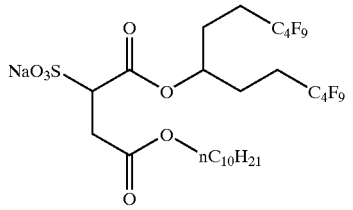

The compounds represented by the aforementioned formula (2C) can be easily synthesized by successively performing monoesterification reaction, acid halide formation, esterification reaction and sulfonation reaction using usual maleic anhydride or the like as a starting material. Further, the counter cation can easily be changed by using an ion exchange resin.

Examples of typical synthesis methods will be mentioned below. However, the present invention is not limited by the following specific examples at all.

SYNTHESIS EXAMPLE 6

Synthesis of FS-302

6-1 Synthesis of 2-ethylhexyl Maleate Chloride

Phosphorus pentachloride (4.1 g, 20 mmol) was slowly added dropwise with mono(2-ethylhexyl)maleate (4.5 g, 20 mmol) produced by Aldrich, while the temperature was maintained at 30° C. or lower. After completion of the addition, the reaction mixture was stirred at room temperature for 1 hour. Then, the reaction mixture was heated at 60° C., and pressure was reduced by using an aspirator. The produced oxyphosphorous chloride was evaporated to obtain 2-ethylhexyl maleate chloride (4.5 g, yield: 92%) as a brown oily compound.

6-2 Synthesis of Mono(2-ethylhexyl)mono(2,2,3,3,4,4,4-heptafluorobutyl)maleate 2,2,3,3,4,4,4-Heptafluorobutanol (66.8 g, 0.334 mol) and pyridine (29.6 mL, 0.367 mol) were dissolved in acetonitrile (180 mL) and added with mono(2-ethylhexyl)maleate chloride (90.6 g, 0.367 mol), while the internal temperature was maintained at 20° C. or lower with cooling on an ice bath. After completion of the addition, the reaction mixture was stirred at room temperature for 1 hour and added with ethyl acetate (1000 mL). The organic phase was washed with 1 mol/L aqueous hydrochloric acid and a saturated sodium chloride aqueous solution. Then, the organic phase was collected, the organic solvent was evaporated under reduced pressure, and residue was purified by silica gel column chromatography (hexane/chloroform=10/0 to 7/3 (v/v)) to obtain the target compound (80.3 g, yield: 59%) as a colorless transparent oily compound.

6-3 Synthesis of Sodium Mono(2-ethylhexyl)mono(2,2,3,3,4,4,4-heptafluorobutyl)sulfosuccinate (FS-302)

Mono(2-ethylhexyl)mono(2,2,3,3,4,4,4-heptafluorobutyl)maleate (80.3 g, 0.196 mol), sodium hydrogensulfite (20.4 g, 0.196 mol) and water/ethanol (80 mL, 1:1 (v/v)) were mixed and refluxed for 10 hours with heating. Then, the reaction mixture was added with ethyl acetate (1000 mL), and the organic phase was washed with saturated sodium chloride aqueous solution. Thereafter, the organic layer was collected, and the organic solvent was evaporated under reduced pressure. The residue was purified by silica gel column chromatography (chloroform/methanol=9/1 (v/v)). The corrected organic phase was washed with a saturated sodium chloride aqueous solution, and then the organic solvent was evaporated under reduced pressure to obtain the target compound (32 g, yield: 32%) as colorless transparent solid.

The $^1$H-NMR data of the obtained compound are as follows.

$^1$H-NMR (DMSO-d): δ 0.81–0.87 (m, 6H), 1.24 (m, 8H), 1.50 (br, 1H), 2.77–2.99 (m, 2H), 3.63–3.71 (m, 1H), 3.86–3.98 (m, 3H) 4.62–4.84 (br, 1H).

SYNTHESIS EXAMPLE 7

Synthesis of FS-312

7-1 Synthesis of Monodecyl Mono(3,3,4,4,5,5,6,6,6-nonafluorohexyl)maleate 3,3,4,4,5,5,6,6,6-Nonafluorohexanol (164.6 g, 623 mmol) and pyridine (49.3 mL, 623 mmol) were dissolved in chloroform (280 mL), and the mixture was added dropwise with monododecyl maleate chloride (155.8 g, 566 mmol), while the internal temperature was kept at 20° C. or lower with cooling on an ice bath. After completion or the addition, the mixture was stirred for 1 hour and added with ethyl acetate. The organic phase was washed with 1 mol/L aqueous hydrochloric acid and a saturated sodium chloride aqueous solution. Then, the organic layer was collected, and the organic solvent was evaporated under reduced pressure. The residue was purified by silica gel column chromatography (hexane/chloroform=10/0 to 7/3 (v/v)) to obtain the target compound (48.2 g, yield: 18%).

7-2 Synthesis of Sodium Monodecyl Mono(3,3,4,4,5,5,6,6,6-nonafluorohexyl)sulfosuccinate (FS-312)

Monodecyl mono(3,3,4,4,5,5,6,6,6-nonafluorohexyl) maleate (48.0 g, 90 mmol), sodium hydrogensulfite (10.4 g, 99 mmol) and water/ethanol (50 mL, 1/1 (v/v)) were mixed and refluxed for 5 hours with heating. Then, the reaction mixture was added with ethyl acetate, and the organic phase was washed with a saturated sodium chloride aqueous solution. The organic layer was collected, and the organic solvent was evaporated under reduced pressure. The residue was recrystallized from acetonitrile to obtain the target compound (12.5 g, yield: 22%) as colorless transparent solid.

The $^1$H-NMR data of the obtained compound are as follows.

$^1$H-NMR (DMSO-d): δ 0.81–0.87 (t, 3H), 1.24 (m, 18H), 1.51 (br, 2H), 2.50–2.70 (m, 2H), 2.70–2.95 (m, 2H), 3.61–3.70 (m, 1H), 3.96 (m, 2H), 4.28 (ms, 2H).

SYNTHESIS EXAMPLE 8

Synthesis of FS-309

8-1 Synthesis of Mono(2-ethylhexyl)mono(3,3,4,4,5,5,6,6,6-nonafluorohexyl)maleate 3,3,4,4,5,5,6,6,6-Nonafluorohexanol (515 g, 1.95 mol), pyridine (169 g, 2.13 mol) and triethylamine (394 mL, 3.89 mol) were dissolved in chloroform (1000 mL) and added dropwise with 2-ethylhexyl maleate chloride (530 g, 2.14 mol), while the internal temperature was kept at 20° C. or lower with cooling on an ice bath. After completion of the addition, the reaction mixture was stirred at room temperature for 1 hour and then added with chloroform. The organic phase was washed with water and a saturated sodium chloride aqueous solution. Then, the organic layer was collected, and the organic solvent was evaporated under reduced pressure. The residue was purified by silica gel column chromatography (hexane/chloroform=10/0 to 7/3 (v/v)) to obtain the target compound (508 g, yield: 50%) which was colorless and transparent.

8-2 Synthesis of Sodium Mono(2-ethylhexyl)mono(3,3,4,4,5,5,6,6,6-nonafluorohexyl)sulfosuccinate (FS-309)

Mono(2-ethylhexyl)mono(3,3,4,4,5,5,6,6,6-nonafluorohexyl)maleate (137.5 g, 0.29 mol), sodium hydrogensulfite (33.2 g, 0.32 mol) and water/ethanol (140 mL, 1/1 (v/v)) were mixed and refluxed for 2 hours with heating. Thereafter, the reaction mixture was added with ethyl acetate (1000 mL), and the organic phase was washed with a saturated sodium chloride aqueous solution. The organic layer was collected, and the organic solvent was evaporated under reduced pressure. The residue was subjected to recrystallization from toluene (800 mL). Upon cooling on an ice bath, crystals deposited. The crystals were finally separated by filtration to obtain the target compound (140 g, yield: 84%), which was colorless and transparent.

$^1$H-NMR (DMSO-$d_6$): δ 0.82–0.93 (m, 6H), 1.13–1.32 (m, 8H), 1.50 (br, 1H), 2.57–2.65 (m, 2H), 2.84–2.98 (m, 2H), 3.63–3.68 (m, 1H), 3.90 (d, 2H), 4.30 (m, 2H).

SYNTHESIS EXAMPLE 9

Synthesis of FS-332

9-1 Synthesis of Mono(2-ethylhexyl)mono(1,1,1,3,3,3-hexafluoro-2-propyl)maleate 1,1,1,3,3,3-Hexafluoro-2-propanol (HFIP, 33.7 g, 201 mmol) and pyridine (17.9 mL, 220 mmol) were dissolved in acetonitrile (80 mL) and added dropwise with mono(2-ethylhexyl)maleate chloride (41.8 g, 220 mmol), while the internal temperature was kept at 20° C. or lower by cooling the solution on an ice bath. After completion of the addition, the reaction mixture was stirred at room temperature for 1 hour and then added with ethyl acetate, and the organic phase was washed with 1 mol/L aqueous hydrochloric acid and a saturated sodium chloride aqueous solution. Then, the organic layer was collected, and the organic solvent was evaporated under reduced pressure. The residue was purified by silica gel column chromatography (hexane/chloroform=10/0 to 7/3 (v/v)) to obtain the target compound (10.6 g, yield: 14%) as a colorless transparent oily compound.

9-2 Synthesis of FS-332

Mono(2-ethylhexyl)mono(1,1,1,3,3,3-hexafluoro-2-propyl)maleate (10.6 g, 28 mmol), sodium hydrogensulfite (3.2 g, 31 mmol) and water/ethanol (10 mL, 1/1 (v/v)) were mixed and refluxed for 10 hours with heating. Then, the reaction mixture was added with ethyl acetate, and the organic phase was washed with a saturated sodium chloride aqueous solution. Thereafter, the organic layer was collected, and the organic solvent was evaporated under reduced pressure. The residue was recrystallized from acetonitrile to obtain the target compound (1.7 g, yield: 13%) as colorless transparent solid.

The $^1$H-NMR data of the obtained compound are as follows.

$^1$H-NMR (DMSO-d): δ 0.81–0.87 (m, 6H), 1.25 (m, 8H), 1.50 (br, 1H), 2.73–2.85 (m, 2H), 3.59 (m, 1H), 3.85–3.90 (m, 2H), 12.23 (br, 1H).

Hereafter, the compounds represented by the formula (2D) will be explained in detail.

$$[Rf^D\text{-}(L^D)_{nD}]_{mD}\text{-}W \qquad \text{Formula (2D)}$$

In the formula, $Rf^D$ represents a perfluoroalkyl group, $L^D$ represents an alkylene group, W represents a group having an anionic, cationic or betaine group or nonionic polar group required for imparting surface activity. $n^D$ represents' an integer of 0 or 1, and $m^D$ represents an integer of 1–3.

$Rf^D$ represents a perfluoroalkyl group having 3–20 carbon atoms, and specific examples include $C_3F_7$— group, $C_4F_9$— group, $C_6F_{13}$— group, $C_8H_{17}$— group, $C_{12}F_{25}$— group, $C_{16}F_{33}$— group and so forth.

$L^D$ group represents an alkylene group. Although the alkylene group has one or more carbon atoms, it preferably has two or more carbon atoms, and it has preferably 20 or less carbon atoms. Specific examples thereof include methylene group, ethylene group, 1,2-propylene group, 1,3-propylene group, 1,2-butylene group, 1,4-butylene group, 1,6-hexylene group, 1,2-octylene group and so forth.

In the present invention, a mixture of multiple kinds of compounds having perfluoroalkyl groups of different lengths as $Rf^D$ may be used, or only compounds having a single kind of perfluoroalkyl group may be used. Further, a mixture of multiple kinds of compounds having the same $Rf^D$ and different $L^D$ may also be used.

In the present invention, when a mixture of multiple kinds of compounds having perfluoroalkyl groups of different lengths as $Rf^D$ is used, the average chain length of the perfluoroalkyl groups is preferably 4–10, particularly preferably 4–9, in terms of a number of carbon atoms.

$n^D$ represents an integer of 0 or 1, and it is preferably 1. $m^D$ represents an integer of 1–3, and when $m^D$ is 2 or 3, groups of $[Rf^D\text{-}(L^D)n^D]$ may be identical or different. When W is not phosphoric acid ester group, it is preferred that $m^D$=1, when W represents a phosphoric acid group, $m^D$ may be any of 1–3, and when it is a mixture in which $m^D$=1–3, the average of $m^D$ is preferably 0.5–2.

W represents a group having an anionic, cationic or betaine group or nonionic polar group required for imparting surface activity. So long as W has such a group, W may bond to $[Rf^D\text{-}(L^D)n^D]$ in any manner. Examples of the anionic group required for imparting surface activity include sulfonic acid group and an ammonium or metal salt thereof, carboxylic acid group and an ammonium or metal salt thereof, phosphonic acid group and an ammonium or metal salt thereof, sulfuric acid ester group and an ammonium or metal salt thereof, and phosphoric acid ester group and an ammonium or metal salt thereof.

Examples of the cationic group required for imparting surface activity include a quaternary alkylammonium group such as trimethylammoniumethyl group and trimethylammoniumpropyl group; and an aromatic ammonium group such as a dimethylphenylammoniumalkyl group and N-methylpyridinium group. These groups contain a suitable counter ion. Examples thereof include a halide ion, benzenesulfonate anion, toluenesulfonate anion and so forth, and toluenesulfonate anion is preferred.

Examples of the betaine group required for imparting surface activity include groups having a betaine structure such as $—N^+(CH_3)_2CH_2COO^-$ and $—N^+(CH_3)_2CH_2CH_2COO^-$.

Examples of the nonionic group required for imparting surface activity include a polyoxyalkylene group, a polyhydric alcohol group and so forth, and a polyoxyalkylene group such as polyethylene glycol and polypropylene glycol is preferred. However, the terminal of these groups may be a group other than a hydrogen atom, for example, an alkyl group.

In the aforementioned formula (2D), $Rf^D$ is preferably a perfluoroalkyl group having 4–16 carbon atoms, more preferably a perfluoroalkyl group having 6–16 carbon atoms. $L^D$ preferably represents an alkylene group having 2–16 carbon atoms, more preferably an alkylene group having 2–8 carbon atoms, particularly preferably ethylene group. $n^D$ is preferably 1.

$L^D$ and the group required for imparting surface activity may bond to each other in any manner. For example, they can bond to each other via an alkylene chain, an arylene or the like, and these groups may have a substituent. These groups may have oxy group, thio group, sulfonyl group, sulfoxide group, sulfonamido group, amido group, amino group or the like on the backbone or side chain.

Specific examples of the compounds represented by the aforementioned formula (2D) are shown below. However, the present invention is not limited by the following examples at all.

FS-401

$C_8F_{17}CH_2CH_2SO_3^-Li^+$

FS-402

$C_8F_{17}CH_2CH_2SO_3^-Na^+$

FS-403

$C_8F_{17}CH_2CH_2SO_3^-K^+$

FS-404

$C_6F_{13}CH_2CH_2SO_3^-K^+$

FS-405

$C_{10}F_{21}CH_2CH_2SO_3^-Li^+$

FS-406

$C_8F_{17}CH_2CH_2SCH_2COO^-Na^+$

FS-407

$C_8F_{17}CH_2CH_2OCH_2COO^-K^+$

FS-408

$C_8F_{17}CH_2CH_2SCH_2CH_2COO^-Na^+$

FS-409

$C_8F_{17}CH_2CH_2SCH_2CH_2COO^-Li^+$

FS-410

$C_8F_{17}CH_2COO^-K^+$

FS-411

$F(CF_2CF_2)nCH_2CH_2SO_3^-Na^+$ n = 3–7

FS-412

$F(CF_2CF_2)nCH_2CH_2SO_3^-Li^+$ n = 3–7

FS-413

$C_8F_{17}CH_2CH_2SO_2N(CH_2CH_2O)_4(CH_2)_4SO_3^-Na^+$
|
$C_3H_7$

-continued

FS-414

$F(CF_2CF_2)nCH_2CH_2O(CH_2CH_2O)_x—(CH_2)_4SO_3^-Na^+$ n = 1–7
x = 4

FS-415

$C_8F_{17}CH_2CH_2OPO(O^-Na^+)_2$

FS-416

$C_8F_{17}CH_2CH_2SO_2NCH_2COO^-Na^+$
|
$C_3H_7$

FS-417

$C_8F_{17}CH_2CH_2SO_2NCH_2CH_2OPO(O^-Na^+)_2$
|
$C_3H_7$

FS-418

$[F(CF_2CF_2)nCH_2CH_2O]xPO(O^-M^+)_y$ $M^+ = H^+, NH_4^+, Na^+, Li^+$ x + y = 3, n = 1–7

FS-419

$[F(CF_2CF_2)nCH_2CH_2O]xPO(O^-M^+)_y(OCH_2CH_2OH)_z$ $M^+ = H^+, NH_4^+ Na^+, Li^+$ x + y + z = 3, n = 1–7

FS-420

$F(CF_2CF_2)nCH_2SO_3^-M^+$ $M^+ = H^+, NH_4^+, Na^+, Li^+, K^+$ n = 1–9

FS-421

$C_6F_{13}CH_2CH_2SO_3^-M^+$ $M^+ = H^+, NH_4^+, Na^+, Li^+, K^+$

FS-422

$F(CF_2CF_2)nCH_2CH_2SCH_2CH_2COO^-Li^+$ n = 1–9

FS-423

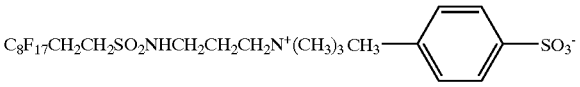

FS-424

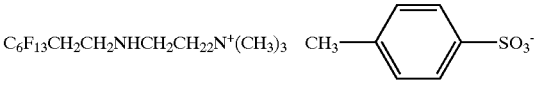

FS-425

$C_8F_{17}CH_2CH_2SO_2NHCH_2CH_2CH_2OCH_2CH_2N^+(CH_3)_3$

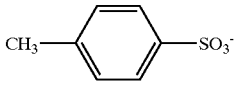

FS-426

$F(CF_2CF_2)nCH_2CH_2SO_2NHCH_2CH_2CH_2N^+(CH_3)_3$

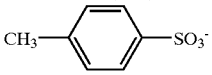

n = 1–7

FS-427

$F(CF_2CF_2)nCH_2CH_2SO_2NHCH_2CH_2CH_2OCH_2CH_2N^+(CH_3)_3$

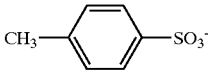

n = 1–7

FS-428

$F(CF_2CF_2)nCH_2CH_2N^+(CH_3)_3Cl^-$ n = 1–9

FS-429

$F(CF_2CF_2)nCH_2CH_2NHCH_2CH_2N^+(CH_3)_3I^-$ n = 1–7

FS-430

$C_6F_{13}CH_2CH_2O(CH_2CH_2O)nH$ n = 5–10

-continued

FS-431

$C_8F_{17}CH_2CH_2O(CH_2CH_2O)nH$ n = 10–15

FS-432

$C_8F_{17}CH_2CH_2O(CH_2CH_2O)nH$ n = 15–20

FS-433

$C_{10}F_{21}CH_2CH_2O(CH_2CH_2O)nH$ n = 15–20

FS-434

$C_8F_{17}CH_2CH_2SO_2N(C_3H_7)CH_2CH_2O(CH_2CH_2O)nH$ n = 15

FS-435

$F(CF_2CF_2)_mCH_2CH_2O(CH_2CH_2O)nH$ m = 3–7, n = 5–10

FS-436

$C_8F_{17}CH_2CH_2SO_2N(C_2H_5)(CH_2CH_2O)nH$ n = 5–10

FS-437

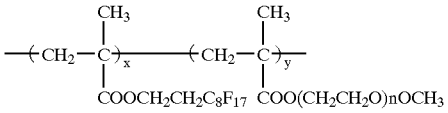

x/y = 20/80
n = 5–10

FS-438

$F(CF_2CF_2)nCH_2CH_2O(CH_2CH_2O)xH$ n = 1–7, x = 0–15

FS-439

$F(CF_2CF_2)nCH_2CH_2O(CH_2CH_2O)xH$ n = 1–9, x = 0–25

FS-440

$F(CF_2CF_2)nCH_2CH_2S(CH_2CH_2O)xH$ n = 1–9, x = 0–25

FS-441

$C_6F_{13}CH_2CH_2SO_2N(C_3H_7)CH_2CH_2O(CH_2CH_2O)xH$ x = 0–15

FS-442

$C_8F_{17}CH_2CH_2SO_2NH(CH_2)_3N^+(CH_3)_2CH_2CH_2COO^-$

The compounds represented by the aforementioned formula (2D) can be produced by usual synthetic methods, and those widely marketed as so-called telomer type perfluoroalkyl group-containing surfactants can also be used. Examples thereof include Zonyl FSP, FSE, FSJ, NF, TBS, FS-62, FSA, FSK (these are ionic surfactants), Zonyl 9075, FSO, FSN, FSN-100, FS-300, FS-310 (these are nonionic surfactants) produced by DUPONT, S-111, S-112, S-113, S-121, S-131, S-132 (these are ionic surfactants), S-141, S-145 (these are nonionic surfactants) produced by Asahi Glass, Unidyne DS-101, DS-102, DS-202, DS-301 (these are ionic surfactants), DS-401, DS-403 (these are nonionic surfactants) produced by Daikin Industries, and so forth.

Further, among the aforementioned various compounds, the ionic surfactants can be used in the forms of various kinds of salts obtained by ion exchange, neutralization or the like, or in the presence of one or more kinds of counter ions, depending on the purpose of use, required various characteristics and so forth.

Hereafter, Substituent T, which is an example of the substituent that may be contained in the groups that may have a substituent in the aforementioned formulas, will be explained.

Examples of Substituent T include, for example, an alkyl group having preferably 1–20 carbon atoms, more preferably 1–12 carbon atoms, particularly preferably 1–8 carbon atoms (e.g., methyl group, ethyl group, isopropyl group, tert-butyl group, n-octyl group, n-decyl group, n-hexadecyl group, cyclopropyl group, cyclopentyl group, cyclohexyl group etc.), an alkenyl group having preferably 2–20 carbon atoms, more preferably 2–12 carbon atoms, particularly preferably 2–8 carbon atoms (e.g., vinyl group, allyl group, 2-butenyl group, 3-pentenyl group etc.), an alkynyl group having preferably 2–20 carbon atoms, more preferably 2–12 carbon atoms, particularly preferably 2–8 carbon atoms (e.g., propargyl group, 3-pentynyl group etc.), an aryl group having preferably 6–30 carbon atoms, more preferably 6–20 carbon atoms, particularly preferably 6–12 carbon atoms (e.g., phenyl group, p-methylphenyl group, naphthyl group etc.), a substituted or unsubstituted amino group having preferably 0–20 carbon atoms, more preferably 0–10 carbon atoms, particularly preferably 0–6 carbon atoms (e.g., unsubstituted amino group, methylamino group, dimethylamino group, diethylamino group, dibenzylamino group etc.), an alkoxy group having preferably 1–20 carbon atoms, more preferably 1–12 carbon atoms, particularly preferably 1–8 carbon atoms (e.g., methoxy group, ethoxy group, butoxy group etc.), an aryloxy group having preferably 6–20 carbon atoms, more preferably 6–16 carbon atoms, particularly preferably 6–12 carbon atoms (e.g., phenyloxy group, 2-naphthyloxy group etc.), an acyl group having preferably 1–20 carbon atoms, more preferably 1–16 carbon atoms, particularly preferably 1–12 carbon atoms (e.g., acetyl group, benzoyl group, formyl group, pivaloyl group etc.) an alkoxycarbonyl group having preferably 2–20 carbon atoms, more preferably 2–16 carbon atoms, particularly preferably 2–12 carbon atoms (e.g., methoxycarbonyl group, ethoxycarbonyl group etc.), an aryloxycarbonyl group having preferably 7–20 carbon atoms, more preferably 7–16 carbon atoms, particularly preferably 7–10 carbon atoms (e.g., phenyloxycarbonyl group etc.), an acyloxy group having preferably 2–20 carbon atoms, more preferably 2–16 carbon atoms, particularly preferably 2–10 carbon atoms (e.g., acetoxy group, benzoyloxy group etc.), an acylamino group having preferably 2–20 carbon atoms, more preferably 2–16 carbon atoms, particularly preferably 2–10 carbon atoms (e.g., acetylamino group, benzoylamino group etc.) an alkoxycarbonylamino group having preferably 2–20 carbon atoms, more preferably 2–16 carbon atoms, particularly preferably 2–12 carbon atoms (e.g., methoxycarbonylamino group etc.), an aryloxycarbonylamino group having preferably 7–20 carbon atoms, more preferably 7–16 carbon atoms, particularly preferably 7–12 carbon atoms (e.g., phenyloxycarbonylamino group etc.), a sulfonylamino group having preferably 1–20 carbon atoms, more preferably 1–16 carbon atoms, particularly preferably 1–12 carbon atoms (e.g., methanesulfonylamino group, benzenesulfonylamino group etc.), a sulfamoyl group having preferably 0–20 carbon atoms, more preferably 0–16 carbon atoms, particularly preferably 0–12 carbon atoms (e.g., sulfamoyl group, methylsulfamoyl group, dimethylsulfamoyl group, phenylsulfamoyl group etc.), a carbamoyl group having preferably 1–20 carbon atoms, more preferably 1–16 carbon atoms, particularly preferably 1–12 carbon atoms (e.g., unsubstituted carbamoyl group, methylcarbamoyl group, diethylcarbamoyl group, phenylcarbamoyl group etc.), an alkylthio group having preferably 1–20 carbon atoms, more preferably 1–16 carbon atoms, particularly preferably 1–12 carbon atoms (e.g., methylthio group, ethylthio group etc.), an arylthio group having preferably 6–20 carbon atoms, more preferably 6–16 carbon atoms, particularly preferably 6–12 carbon atoms (e.g., phenylthio group etc.), a sulfonyl group having preferably 1–20 carbon atoms, more preferably 1–16 carbon atoms, particularly preferably 1–12 carbon atoms (e.g., mesyl group, tosyl group etc.), a sulfinyl group having preferably 1–20 carbon atoms, more preferably 1–16 carbon atoms, particularly preferably 1–12 carbon atoms (e.g., methanesulfinyl group, benzenesulfinyl group etc.), a ureido group having preferably 1–20 carbon atoms, more preferably 1–16 carbon atoms, particularly preferably 1–12 carbon atoms (e.g., unsubstituted ureido group, methylureido group, phenylureido group etc.), a phosphoric acid amido group having preferably 1–20 carbon atoms, more preferably 1–16 carbon atoms, particularly preferably 1–12 carbon atoms (e.g., diethylphosphoric acid amido group, phenylphosphoric acid amido group etc.), a hydroxyl group, a mercapto group, a halogen atom (e.g., fluorine atom, chlorine atom, bromine atom, iodine atom), a cyano group, a sulfo group, a carboxyl group, a nitro group, a hydroxamic acid group, a sulfino group, a hydrazino group, an imino group, a heterocyclic group having preferably 1–30 carbon atoms, more preferably 1–12, for example, such a heterocyclic group containing nitrogen atom, oxygen atom, sulfur atom or the like as a hetero atom (e.g., imidazolyl group, pyridyl group, quinolyl group, furyl group, piperidyl group, morpholino group, benzoxazolyl group, benzimidazolyl group, benzothiazolyl group etc.), a silyl group having preferably 3–40 carbon atoms, more preferably 3–30 carbon atoms, particularly preferably 3–24 carbon atoms (e.g., trimethylsilyl group, triphenylsilyl group, etc.) and so forth. These substituents may be further substituted with other substituents. Further, when two or more substituents exist, they may be identical to or different from each other or one another. If possible, they may bond to each other to form a ring.

The silver halide photographic light-sensitive material of the present invention is a silver halide photographic light-sensitive material having one or more layers including at least one light-sensitive silver halide emulsion layer on a support, which is characterized by having at least one of layer containing a compound represented by the aforementioned formula (1) and a fluorine-containing surfactant. In a preferred embodiment of the silver halide photographic light-sensitive material of the present invention, it has a light-insensitive hydrophilic colloid layer as an outermost layer, and this outermost layer contains at least one kind of the compound represented by the aforementioned formula (1) and the fluorine-containing surfactant. The layer can be formed by coating an aqueous coating solution containing at least one kind of the compound represented by the aforementioned, formula (1) and the fluorine-containing surfactant on or above a support. As for the compound represented by the aforementioned formula (1), a single kind of the compound may be used, or two or more kinds of the compounds may be used as a mixture. Further, those components may be used together with other surfactants. Surfactants that can be used together include various surfactants of anionic type, cationic type and nonionic type. Moreover, the surfactants used together may be polymer surfactants. The surfactants used together are more preferably anionic surfactants or nonionic surfactants. The surfactants that can be used together include, besides the aforementioned anionic type surfactants, for example, those disclosed in JP-A-62-215272 (pages 649–706), Research Disclosure (RD) Items 17643, pages 26–27 (December, 1978) 18716, page 650 (November, 1979), 307105, pages 875–876 (November, 1989) and so forth.

As another component that may be contained in the aqueous coating composition, a polymer compound can be mentioned as a typical example. The polymer compound may be a polymer soluble in an aqueous medium (henceforth referred to as "soluble polymer") or may be dispersion of a polymer in water (so-called "polymer latex"). The soluble polymer is not particularly limited, and examples thereof include, for example, gelatin, polyvinyl alcohol, casein, agar, gum arabic, hydroxyethylcellulose, methylcellulose, carboxymethylcellulose and so forth. Examples of the polymer latex include dispersions of homopolymers and copolymers of various vinyl monomers [e.g., acrylate derivatives, methacrylate derivatives, acrylamide derivatives, methacrylamide derivatives, styrene derivatives, conjugated diene derivatives, N-vinyl compounds, O-vinyl compounds, vinylnitrile and others vinyl compounds (e.g., ethylene, vinylidene chloride)], and dispersions of condensation type polymers (e.g., polyesters, polyurethanes, polycarbonates, polyamides). Specific examples of polymer compounds of this type include the polymer compounds disclosed in JP-A-62-215272 (pages 707–763), Research Disclosure (RD) Items 17643, page 651 (December, 1978), 18716, page 650 (November, 1979), 307105, pages 873–874 (November, 1989) and so forth.

The aforementioned aqueous coating composition may contain various other compounds, and they may be dissolved or dispersed in the medium. For example, when it is used for forming a layer constituting a photographic light-sensitive material, there can be mentioned various couplers, ultraviolet absorbers, anti-color mixing agents, antistatic agents, scavengers, antifoggants, hardeners, dyes, fungicides and so forth. Further, as described above, the aforementioned aqueous coating composition is preferably used for forming a hydrophilic colloid layer as an uppermost layer of the photographic light-sensitive material, and in this case, the coating composition may contain, besides the hydrophilic colloid (e.g., gelatin), the compound represented by the formula (1) and the fluorine-containing surfactant, other surfactants, matting agents, lubricants, colloidal silica, gelatin plasticizers and so forth.

The amounts of the compound represented by the formula (1) and the fluorine-containing surfactant are not particularly limited, and they can be arbitrarily determined depending on structure or use of compounds to be used, types and amounts of materials contained in the aqueous composition, composition of the medium and so forth. When the aforementioned aqueous coating composition is used as a coating solution for a hydrophilic colloid (gelatin) layer as an uppermost layer of the silver halide photographic light-sensitive material, for example, the concentration of the fluorine-containing surfactant is preferably 0.003–0.5 weight % in the coating composition, or preferably 0.03–5 weight % with respect to the gelatin solid content. The concentration of the compound represented by the formula (1) is preferably 0.003–0.5 weight % in the coating composition.

The silver halide photographic light-sensitive material of the present invention can be produced by coating one or more kinds of the aforementioned aqueous coating compositions on or above a support. The method for coating the coating compositions is not particularly limited, and it may be any of the slide bead coating method, slide curtain coating method, extrusion curtain coating method and extrusion bead coating method. Among these, the slide bead coating method is preferred.

Hereafter, various materials used for the silver halide photographic light-sensitive material of the present invention will be explained by exemplifying a silver halide color photographic light-sensitive material.

As for shape of silver halide grains in a silver halide grain emulsion that can be used for the silver halide photographic light-sensitive material of the present invention, they may be those having regular crystals such as cubic, octahedral or tetradecahedral crystals, those having irregular crystals such as spherical or tabular crystals or those having crystal defects such as twinned crystal faces, or those having composite forms thereof. Tabular grains are particularly preferred.

It is preferred that, in a tabular grain emulsion, grains having an aspect ratio of 3 or more provide 50% or more of the total projected area thereof. The projected area and aspect ratio of a tabular grain can be measured from a shadowed electron micrograph of it taken together with a reference latex sphere by the carbon replica method. A tabular grain usually has a hexagonal, triangular or circular shape when viewed in a direction perpendicular to the main plane thereof, and the aspect ratio is a value obtained by dividing a diameter of a circle having the same area as the projected area of the grain (diameter as circle) with the thickness of the grain. A higher ratio of hexagon as the shape of the tabular grains is more preferred, and the ratio of the lengths of adjacent sides of the hexagon is preferably 1:2 or less.

As for the effect of the present invention, a higher aspect ratio provides more preferred photographic performance. Therefore, it is more preferred that 50% or more of the total projected area of the tabular grains in the emulsion is provided by grains having an aspect ratio of 8 or more, more preferably 12 or more. However, if the aspect ratio becomes too large, the variation coefficient of the aforementioned grain size distribution increases. Accordingly, it is usually preferred that grains should have an aspect ratio of 50 or less.

The mean grain diameter of the silver halide grains is preferably 0.2–10.0 $\mu$m, more preferably 0.5–5.0 $\mu$m, as a diameter as circle. The diameter as circle is a diameter of a circle having the same area as the projected area of the parallel main planes. The project area of a grain can be obtained by measuring an area of the grain on an electron microphotograph and correcting it according to magnification of the photography. The mean diameter as sphere is preferably 0.1–5.0 $\mu$m, more preferably 0.6–2.0 $\mu$m. These ranges provide the most superior relationship of sensitivity/granularity ratio of the light-sensitive emulsion. In case of tabular grains, the mean thickness thereof is preferably 0.05–1.0 $\mu$m. The mean diameter as circle used herein means an average of diameters as circle of 1000 or more grains arbitrarily collected from a uniform emulsion. The same shall apply to the mean thickness.

The silver halide grains may be monodispersed or polydispersed.

The tabular grains in the emulsion preferably have facing (111) main planes and side faces that connect the main planes. At least one twin plane is preferably interposed between the main planes. In the tabular grain emulsion used in the present invention, it is, preferred that two twin planes are observed in each of the tabular grains. The spacing of the two twin planes can be made less than 0.012 $\mu$m as described in U.S. Pat. No. 5,219,720. Further, the value obtained by dividing the distance between (111) main planes with the twin plane spacing can be made at least 15 as described in JP-A-5-249585. In the present invention, as for the side faces connecting the facing (111) main planes of the tabular grains in the emulsion, 75% or less of the total side faces are preferably composed of (111) faces. The expression of "75% or less of the total side faces are composed of (111) faces" used herein means that crystallographic faces other than the (111) faces exist at a proportion higher than 25% of the total side faces. While such other crystallographic faces can generally be understood as being (100) faces, other faces such as (110) faces and faces with a higher index may also be included. In the present invention, if 70% or less of the total side faces are composed of (111) faces, marked effect can be obtained.

Examples of solvent for the silver halide that can be used in the present invention include (a) organic thioethers described in U.S. Pat. Nos. 3,271,157, 3,531,289, 3,574,628, JP-A-54-1019, JP-A-54-158917 etc., (b) thiourea derivatives described in JP-A-53-82408, JP-A-55-77737, JP-A-55-2982 etc., (c) silver halide solvents having a thiocarbonyl group between an oxygen atom or a sulfur atom and a nitrogen atom described in JP-A-53-144319, (d) imidazoles described in JP-A-54-100717, (e) ammonia, (f) thiocyanates and so forth.

Particularly preferred solvents are thiocyanates, ammonia and tetramethylthiourea. The amount of the solvent to be used varies depending on the type of the solvent, and in case of thiocyanates, for example, the amount is preferably $1\times10^{-4}$ mol to $1\times10^{-2}$ mol per mol of the silver halide.

As for the method of changing the face index of a side face of tabular grain in emulsion, EP515894A1 etc. can be referred to. The polyalkyleneoxide compounds described in U.S. Pat. No. 5,252,453 etc. can also be used. As an effective method, it is possible to use face index modifiers described in U.S. Pat. Nos. 4,680,254, 4,680,255, 4,680,256, 4,684,607 etc. Usual photographic spectral sensitization dyes can also be used as face index modifiers similar to those mentioned above.

The silver halide emulsion can be prepared by various methods so long as it satisfies the requirements described above. In general, the preparation of a tabular grain emulsion basically includes three steps of nucleation, ripening and growth. In the nucleation step of the tabular grain emulsion used in the present invention, it is extremely effective to use gelatin with a small methionine content as described in U.S. Pat. Nos. 4,713,320 and 4,942,120, perform the nucleation at a high pBr as described in U.S. Pat. No. 4,914,014 and perform nucleation within a short time period as described in JP-A-2-222940. In the ripening step of the tabular grain emulsion, it may be effective to perform the ripening in the presence of a base at a low concentration as described in U.S. Pat. No. 5,254,453 or at a high pH as described in U.S. Pat. No. 5,013,641. In the growth step of the tabular grains in the emulsion, it is particularly effective to perform the growth at a low temperature as described in U.S. Pat. No. 5,248,587 or use fine silver iodide grains as described in U.S. Pat. No. 4,672,027 and 4,693,964. Furthermore, it is also preferable to attain the growth by ripening with addition of silver bromide, silver iodobromide or silver chloroiodobromide fine grain emulsion. It is also possible to supply the aforementioned fine grain emulsion by using a stirring machine described in JP-A-10-43570.

The silver halide emulsion preferably contains silver iodobromide, silver iodochloride, silver bromochloride or silver iodochlorobromide. More preferably, it comprises silver iodobromide or silver iodochlorobromide. In case of silver iodochlorobromide, although the emulsion may contain silver chloride, the silver chloride content is preferably 8 mol % or less, more preferably 3 mol % or less or 0 mol %. As for the silver iodide content, since variation coefficient of the grain size distribution is preferably 25% or less, the silver iodide content is preferably 20 mol % or less. By reducing the silver iodide content, it becomes easy to make small the variation coefficient of the grain size distribution in the tabular grain emulsion. In particular, variation coefficient of grain size distribution in the tabular grain emulsion is preferably 20% or less, and the silver iodide content is preferably 10 mol % or less. Irrespective of the silver iodide content, the variation coefficient of silver iodide content distribution among the grains is preferably 20% or less, particularly preferably 10% or less.

The silver halide emulsion preferably has a certain structure of silver iodide distribution in the grains. In this case, the structure of the silver iodide distribution may be double, triple or quadruple structure, or a structure of further higher order.

The structure of the grains in the silver halide emulsion is also preferably, for example, a triple structure consisting of silver bromide/silver iodobromide/silver bromide or a further higher order structure. The boarders of silver iodide contents in the structures may be definite borders, or the content may be changed continuously and gradually. In general, in measurement of silver iodide content using powder X-ray diffractometry, definite two peaks of different silver iodide contents are not detected, and there is obtained an X-ray diffraction profile having a portion raised along the direction to a higher silver iodide content.

Further, it is preferred that the silver iodide content is preferably higher in an internal portion than that of a surface portion, and the silver iodide content of an internal portion is higher than that of a surface portion by, preferably 5 mol % or more, more preferably 7 mol % or more.

When the silver halide emulsion comprises tabular grains, it is preferable to use tabular grains having dislocation lines. Dislocation lines in tabular grains can be observed by a direct method described in, for example, J. F. Hamilton, Phot. Sci. Eng., 11, 57 (1967) or T. Shiozawa, J. Soc. Phot. Sci. Japan, 35, 213 (1972), which is performed at a low temperature by using a transmission electron microscope. That is, silver halide grains are carefully extracted from an emulsion so as not to produce a pressure that forms dislocation lines in the grains and placed on a mesh for electron microscopic observation. Then, the sample is observed by a transmission method while being cooled to prevent damages (e.g., print out) caused by electron rays. In this method, as the thickness of a grain increases, it becomes more difficult to transmit electron rays through it. Therefore, grains can be observed more clearly by using an electron microscope of high voltage type (200 kV or higher for a grain having a thickness of 0.25 $\mu$m). A photograph of grains obtained by this method shows positions and number of dislocation lines in each grain when the grain is viewed in a direction perpendicular to the main plane.

The average number of dislocation lines is preferably 10 or more, more preferably 20 or more, per grain. If dislocation lines are densely present or cross each other when observed, it is sometimes impossible to accurately count the number of dislocation lines per grain. Even in such cases, however, dislocation lines can be roughly counted to such an extent as in a unit of ten lines, i.e., 10 lines, 20 lines, 30 lines and so on. Accordingly, these cases can be clearly distinguished from cases where only several dislocation lines are present. The average number of dislocation lines per grain is obtained as a number average by counting the dislocation lines of 100 grains or more.

The silver halide grains can be subjected to at least one of sulfur sensitization, selenium sensitization, gold sensitization, palladium sensitization and noble metal sensitization in any steps of production of the silver halide emulsion. It is preferable to combine two or more kinds of sensitization processes. Various types of emulsions can be prepared depending on the stage at which the grains are subjected to chemical sensitization. There are a type in which chemical sensitization nuclei are embedded in the inside of the grains, a type in which the nuclei are embedded in grains at shallow positions from the surfaces and a type in which the nuclei are prepared on the surfaces of the grains. The chemical sensitization nuclei can be formed at desired sites by controlling the conditions for the preparation of emulsion depending on the purpose. However, it is preferred that at least one kind of chemical sensitization nuclei should be formed in the vicinity of the surfaces of the grains.

Chemical sensitization that can be preferably performed is chalcogenide sensitization, noble metal sensitization or a combination thereof. These types of chemical sensitization can be conducted using active gelatin as described in T. H. James, The Theory of the Photographic Process, 4th ed., pages 67 to 76, Macmillan (1977), or sulfur, selenium, tellurium, gold, platinum, palladium, iridium or a combination of multiple kinds of these sensitizers can be used at pAg of 5–10 and pH of 5–8 at a temperature of 30–80° C. as described in Research Disclosure, vol. 120, Item 12008 (April, 1974), vol. 34, Item 13452 (June, 1975), U.S. Pat. Nos. 2,642,361, 3,297,446, 3,772,031, 3,857,711, 3,901,714, 4,266,018, 3,904,415 and British Patent 1,315,755. As for the noble metal sensitization, salts of noble metals such as gold, platinum, palladium and iridium can be used. In particular, gold sensitization, palladium sensitization or the combination of the both is preferred.

In the gold sensitization, it is possible to use known compounds such as chloroauric acid, potassium chloroaurate, potassium aurithiocyanate, gold sulfide and gold selenide. For the palladium sensitization, a divalent or tetravalent salt of palladium can be used. Preferred examples of the palladium compound used for the palladium sensitization include those represented as $R_2PdX_6$ or $R_2PdX_4$ wherein R represents a hydrogen atom, an alkali metal atom or an ammonium group and X represents a halogen atom, i.e., a chlorine, bromine or iodine atom. More specifically, $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$ are preferred. The gold compound and palladium compound are preferably used in combination with a thiocyanate or selenocyanate.

As the sulfur sensitizer, there can be used hypo, thiourea compounds, rhodanine compounds and sulfur-containing compounds described in U.S. Pat. Nos. 3,857,711, 4,266,018, and 4,054,457. The chemical sensitization can also be performed in the presence of a so-called chemical sensitization aid. Examples of useful chemical sensitization aid are compounds known as those capable of suppressing fog and increasing sensitivity in the process of chemical sensitization, such as azaindene, azapyridazine and azapyrimidine. Examples of the chemical sensitization aid and modifier are described in U.S. Pat. Nos. 2,131,038, 3,411,914, 3,554,757, JP-A-58-126526 and G. F. Duffin, "Chemistry of Photographic Emulsion", supra, pages 138–143.

It is preferable to also perform gold sensitization for the silver halide emulsion. The amount of a gold sensitizer is preferably $1\times10^{-4}$ to $1\times10^{-7}$ mol, more preferably $1\times10^{-5}$ to $5\times10^{-7}$ mol, per mol of silver halide. The amount of a palladium compound is preferably $1\times10^{-3}$ to $5\times10^{-7}$ mol per mol of silver halide. The amount of a thiocyan compound or selenocyan compound is preferably $5\times10^{-2}$ to $1\times10^{-6}$ mol per mol of silver halide. The amount of a preferred sulfur sensitizer used for the silver halide grains is preferably $1\times10^{-4}$ to $1\times10^{-7}$ mol, more preferably $1\times10^{-5}$ to $5\times10^{-7}$ mol, per mol of silver halide.

Selenium sensitization is a preferred sensitization technique for a silver halide emulsion. In the selenium sensitization, known unstable selenium compounds are used. Specifically, selenium compounds such as colloidal metallic selenium, selenoureas (e.g., N,N-dimethylselenourea, N,N-diethylselenourea etc.), selenoketones and selenoamides can be used. In some cases, selenium sensitization is more preferably used in combination with sulfur sensitization, noble metal sensitization or both of them. For example, it is preferable to add a thiocyanate before addition of the aforementioned spectral sensitization dye and chemical sensitizer. More preferably, it is added after the formation of grains, further preferably it is added after completion of the desalting step. It is preferable to add a thiocyanate also at the time of the chemical sensitization, that is, it is preferable to add a thiocyanate twice or more times during the chemical sensitization. As the thiocyanate, there are used potassium thiocyanate, sodium thiocyanate, ammonium thiocyanate and so forth. The thiocyanate is usually added after being dissolved in an aqueous solution or a water-miscible solvent. The amount thereof is $1\times10^{-5}$ to $1\times10^{-2}$ mol, more preferably $5\times10^{-5}$ to $5\times10^{-3}$ mol, per mol of silver halide.

As a protective colloid used at the time of preparation of the silver halide emulsion or a binder of the other hydrophilic colloid layers, gelatin may be advantageously used. However, other hydrophilic binders may also be used. For example, there can be used derivatives of gelatin, graft polymers of gelatin and other polymers, proteins such as albumin and casein; cellulose derivatives such as hydroxyethylcellulose, carboxymetholcellulose and cellulose sulfate, sodium alginate, derivatives of saccharide such as derivatives of starch; various synthetic hydrophilic polymers including homopolymers and copolymers such as polyvinyl alcohol, polyvinyl alcohol partial acetal, poly-N-vinylpyrrolidone, polyacrylic acid, polymethacrylic acid, polyacrylamide, polyvinylimidazole and polyvinylpyrazole and so forth.

As gelatin, besides lime-treated gelatin, acid-treated gelatin and enzyme-treated gelatin described in Bull. Soc. Sci. Photo. Japan. No. 16, p. 30 (1966) may also be used. In addition, a hydrolyzed product or an enzyme-decomposed product of gelatin can also be used.

It is preferable to wash the obtained emulsion with water for desalting and then disperse it in a newly prepared protective colloid. Although temperature of the washing with water can be selected depending on the purpose, it is preferably selected from the range of 5–50° C. Although pH for the washing can also be selected depending on the purpose, it is preferably 2–10, more preferably 3–8. The pAg for the washing is preferably 5–10, although it can also be selected depending on the purpose. The method for washing with water can be selected from noodle washing, dialysis using a semipermeable membrane, centrifugal separation, coagulation precipitation and ion exchange. As for the coagulation precipitation, there can be selected a method using a sulfate, a method using an organic solvent, a method using a water-soluble polymer, a method using a gelatin derivative or the like.

It is preferable to make a salt of metal ion exist during the preparation of the emulsion, for example, during grain formation, desalting or chemical sensitization or before coating depending on the purpose. The metal ion salt is preferably added during grain formation when it is doped into grains, or after grain formation and before the completion of chemical sensitization when it is used to modify the grain surface or used as a chemical sensitizer. It may be doped into an overall grain, or it is also possible to dope it into only a core, shell or epitaxial portion, or base grain. Examples of the metal ion include those of Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, Bi and so forth. These metals can be added so long as they are in the form of a salt that can be dissolved during grain formation, such as ammonium salt, acetate, nitrate, sulfate, phosphate, hydroxy acid salt, hexa-coordinated complex salt or tetra-coordinated complex salt. Examples thereof are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, $K_4Ru(CN)_6$ and so forth. The ligand of the complex compounds can be selected from halo, aquo, cyano, cyanate, thiocyanate, nitrosyl, thionitrosyl, oxo and carbonyl. These metal compounds can be used either singly or as a combination of two or more types of them.

The metal compound is preferably added after being dissolved in water or an appropriate organic solvent such as methanol or acetone. To stabilize the solution, an aqueous hydrogen halide solution (e.g., HCl, HBr etc.) or an alkali halide (e.g., KCl, NaCl, Kbr, NaBr etc.) can be added. It is also possible to add acid or alkali, if necessary. The metal compound can be added to a reaction vessel either before or during grain formation. Alternatively, the metal compound can be added to an aqueous solution of a water-soluble silver salt (e.g., $AgNO_3$) or an alkali halide (e.g., NaCl, KBr, KI), and continuously added during the formation of silver halide grains. Furthermore, a solution of the metal compound can be prepared separately from solutions of the water-soluble silver salt and alkali halide and continuously added in a proper period during the grain formation. Further, it is also possible to combine different addition methods.

It is sometimes useful to use a method of adding a chalcogenide compound during the preparation of the emulsion as described in U.S. Pat. No. 3,772,031. In addition to S, Se and Te, cyanate, thiocyanate, selenocyanic acid, carbonate, phosphate and acetate can be present.

It is preferable to use an oxidizer for silver during the process of producing the emulsion. However, silver nuclei that contribute to enhancement of the sensitivity obtained by the reduction sensitization on the surface of the grain needs to remain to some extent. A compound that converts extremely fine silver grains, which are produced as a by-product in the processes of formation of silver halide grains and chemical sensitization, into silver ions is effective. The silver ions produced may form a silver salt hardly soluble in water such as silver halide, silver sulfide or silver selenide, or a silver salt easily dissolved in water such as silver nitrate.

Preferred oxidizers are inorganic oxidizers consisting of thiosulfonates and organic oxidizers consisting of quinones.

The photographic emulsion used in the present invention can contain various compounds in order to prevent fog or stabilize photographic performance during the production process, storage or photographic process of the light-sensitive material. That is, various compounds known as an antifoggant or a stabilizer can be added, and examples thereof include, for example, thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; thioketo compounds such as oxadolinethione; azaindenes such as triazaindenes, tetrazaindenes (in particular, hydroxy-substituted (1,3,3a,7)-tetrazaindenes) and pentazaindenes. For example, the compounds described in U.S. Pat. Nos. 3,954,474 and 3,982,947 and Japanese Patent Publication (Kokoku, hereinafter referred to as JP-B) No. 52-28660 can be used. One class of preferred compounds are those described in JP-B-7-78597 (Japanese Patent Application No. 62-47225). The antifoggant and the stabilizer can be added at any of different times, for example, they can be added before, during and after the grain formation, during the washing with water, during dispersion after the washing, before, during and after the chemical sensitization and before coating, depending on the purpose. The antifoggant and the stabilizer can be added during preparation of the emulsion to achieve their original fog preventing effect and stabilizing effect, and in addition, they can be used for various purposes of, for example, controlling crystal habit of grains, decreasing grain size, decreasing solubility of grains, controlling chemical sensitization, controlling arrangement of dyes and so forth.

Techniques such as those for layer arrangement, silver halide emulsions, dye forming couplers, functional couplers such as DIR couplers, various additives and development usable for the emulsion and the photographic light-sensitive material using the emulsion are described in EP0565096A1 (published on Oct. 13, 1993) and the patents cited in it. The individual items and the corresponding portions are listed below.

1. Layer structure: page 61, lines 23–35, page 61, line 41 to page 62, line 14
2. Intermediate layer: page 61, lines 36–40
3. Interlayer effect-imparting layer: page 62, lines 15–18
4. Silver halide halogen composition: page 62, lines 21–25
5. Silver halide grain crystal habit: page 62, lines 26–30
6. Silver halide grain size: page 62, lines 31–34
7. Emulsion preparation method: page 62, lines 35–40
8. Silver halide grain size distribution: page 62, lines 41–42
9. Tabular grains: page 62, lines 43–46
10. Internal structures of grains: page 62, lines 47–53
11. Latent image formation type of emulsion: page 62, line 54 to page 63, line 5
12. Physical ripening and chemical ripening of emulsion: page 63, lines 6–9
13. Use of emulsion mixture: page 63, lines 10–13
14. Fogged emulsion: page 63, lines 14–31
15. Light-insensitive emulsion: page 63, lines 32–43
16. Silver coating amount: page 63, lines 49–50
17. Photographic additives: described in Research Disclosure (RD) Item 17643 (December, 1978), Item 18716 (November, 1979), and Item 307105 (November, 1989). The individual items and the corresponding portions of descriptions are mentioned below.

| Kind of Additive | RD 17643 | RD 18716 | RD 307105 |
|---|---|---|---|
| 1. Chemical sensitizer | p.23 | p.648, right column | p.866 |
| 2. Sensitivity enhancing agent | | p.648, right column | |
| 3. Spectral sensitizer and supersensitizer | pp.23–24 | p.648, right column to p.649, right column | pp.866–868 |
| 4. Brightening agent | p.24 | p.647, right column | p.868 |
| 5. Antifoggant and stabilizer | pp.24–25 | p.649, right column | p.868–870 |
| 6. Light absorber, filter dye and UV absorber | pp.25–26 | p.649, right column to p.650, left column | p.873 |
| 7. Anti-staining agent | p.25, right column | p.650, left column to right column | p.872 |
| 8. Dye image stabilizer | p.25 | | p.872 |
| 9. Hardener | p.26 | p.651, left column | pp.874–875 |

-continued

| Kind of Additive | RD 17643 | RD 18716 | RD 307105 |
|---|---|---|---|
| 10. Binder | p.26 | p.651, left column | pp.873–874 |
| 11. Plasticizer and lubricant | p.27 | p.650, right column | p.876 |
| 12. Coating aid and surfactant | pp.26–27 | p.650, right column | pp.875–876 |
| These may be used in combination with the fluorine-containing surfactant, or used for replacing a part of the fluorine-containing surfactant. | | | |
| 13. Antistatic agent | p.27 | p.650, right column | pp.876–877 |
| Matting agents | | | pp.878–879 |

18. Formaldehyde scavenger: page 64, lines 54–57
19. Mercapto type antifoggant: page 65, lines 1–2
20. Agents releasing fogging agent etc.: page 65, lines 3–7
21. Dyes: page 65, lines 7–10
22. General review for color couplers: page 65, lines 11–13
23. Yellow, magenta and cyan couplers: page 65, lines 14–25
24. Polymer coupler: page 65, lines 26–28
25. Diffusing dye-forming coupler: page 65, lines 29–31
26. Colored coupler: page 65, lines 32–38
27. General review for functional couplers: page 65, lines 39–44
28. Bleaching accelerator releasing coupler: page 65, lines 45–48
29. Development accelerator releasing coupler: page 65, lines 49–53
30. Other DIR couplers: page 65, line 54 to page 66, line 4
31. Coupler diffusing method: page 66, lines 5–28
32. Antiseptic and antifungal agents: page 66, lines 29–33
33. Types of light-sensitive materials: page 66, lines 34–36
34. Film thickness and swelling speed of light-sensitive layer: page 66, line 40 to page 67, line 1
35. Back layer: page 67, lines 3–8
36. General review for development treatment: page 67, lines 9–11
37. Developer and developing agent: page 67, lines 12–30
38. Developer additives: page 67, lines 31–44
39. Reversal processing: page 67, lines 45–56
40. Processing solution aperture ratio: page 67, line 57 to page 68, line 12
41. Development time: page 68, lines 13–15
42. Bleach fixing, bleaching and fixing: page 68, line 16 to page 69, line 31
43. Automatic processor: page 69, lines 32–40
44. Washing with water, rinsing and stabilization: page 69, line 41 to page 70, line 18
45. Replenishment and reuse of processing solutions: page 70, lines 19–23
46. Incorporation of developing agent into light-sensitive material: page 70, lines 24–33
47. Development temperature: page 70, lines 34–38
48. Application to film with lens: page 70, lines 39–41

The bleaching solution described in European Patent No. 602600, which contains 2-pyridinecarboxylic acid or 2,6-pyridinedicarboxylic acid, ferric salt such as ferric nitrate and persulfate, can also be preferably used. When this bleaching solution is used, it is preferable to interpose a stop step and a step of washing with water between the color development step and the bleaching step and use an organic acid such as acetic acid, succinic acid or maleic acid for a stop solution. Furthermore, for the purposes of pH adjustment and bleaching fog, the bleaching solution preferably contains 0.1–2 mol/L of an organic acid such as acetic acid, succinic acid, maleic acid, glutaric acid or adipic acid.

EXAMPLES

The present invention will be specifically explained with reference to the following examples. The materials, regents, ratios, procedures and so forth mentioned in the following examples can be optionally changed so long as such change does not depart from the spirit of the present invention. Therefore, the scope of the present invention is not limited by the following specific examples.

Example 1

Preparation and Evaluation of Silver Halide Color Photographic Light-sensitive Materials

(1) Preparation of Support

A support was prepared as follows.

1) First Layer and Undercoat Layer

Both surfaces of a polyethylene naphthalate support having a thickness of 90 μm were subjected to a glow discharge treatment with conditions of treatment atmosphere pressure: 2.66×10 Pa, $H_2O$ partial pressure in atmosphere gas: 75%, discharge frequency: 30 kHz, output: 2500 W and treatment strength: 0.5 kV·A·min/$m^2$. A coating solution having the following composition was coated as the first layer on the above support in a coated amount of 5 mL/$m^2$ according to the bar coating method described in JP-B-58-4589.

| | |
|---|---|
| Dispersion of electroconductive microparticles (aqueous dispersion having 10% concentration of $SnO_2/Sb_2O_5$ particles, secondary aggregates having average particle diameter of 0.05 μm composed of primary particles having diameter of 0.005 μm) | 50 weight parts |
| Gelatin | 0.5 weight part |
| Water | 49 weight parts |
| Polyglycerol polyglycidyl ether | 0.16 weight part |
| Polyoxyethylene sorbitan monolaurate (polymerization degree: 20) | 0.1 weight part |

After the first layer was coated on the support, the resultant support was wound around a stainless steel reel having a diameter of 20 cm and subjected to a heat treatment at 110° C. (Tg of the PEN support: 119° C.) for 48 hours in order to give thermal hysteresis to the support to subject it to an annealing treatment. Subsequently, a coating solution having the following composition was coated on the surface of the support opposite to the surface coated with the first layer by the bar coating method in a coating amount of 10 mL/$m^2$ as an undercoat layer for a silver halide emulsion.

| | |
|---|---|
| Gelatin | 1.01 weight part |
| Salicylic acid | 0.30 weight part |
| Resorcin | 0.40 weight part |
| Polyoxyethylene nonyl phenyl ether (polymerization degree: 10) | 0.11 weight part |
| Water | 3.53 weight parts |
| Methanol | 84.57 weight parts |
| n-Propanol | 10.08 weight parts |

Further, the following second layer and third layer were successively coated on the first layer.

2) Second Layer (i) Dispersion of Magnetic Substance

To an open-type kneader, 1100 weight parts of Co-coated γ-$Fe_2O_3$ magnetic substance (average length of the longer axis: 0.25 μm, $S_{BET}$: 39 $m^2$/g, Hc: 6.56×$10^4$ A/m, ós: 77.1 $Am^2$/kg, ór: 37.4 $Am^2$/kg), 220 weight parts of water and 165 weight parts of a silane coupling agent [3-(polyoxyethynyl)oxypropyltrimethoxysilane (polymerization degree: 10)] were added and well kneaded for 3 hours. The roughly dispersed viscous dispersion was dried at 70° C. for 24 hours to remove water and then subjected to a heat treatment at 110° C. for 1 hour to prepare surface-treated magnetic particles.

Further, a mixture having the following composition was kneaded again in an open-type kneader for 4 hours.

| | |
|---|---|
| Surface-treated magnetic particles mentioned above | 855 g |
| Diacetyl cellulose | 25.3 g |
| Methyl ethyl ketone | 136.3 g |
| Cyclohexanone | 136.3 g |

Further, a mixture having the following composition was finely dispersed in a sand mill (¼ G) at 2000 rpm for 4 hours. As media, glass beads having a diameter of 1 mm ô were used.

| | |
|---|---|
| Kneaded mixture mentioned above | 45 g |
| Diacetyl cellulose | 23.7 g |
| Methyl ethyl ketone | 127.7 g |
| Cyclohexanone | 127.7 g |

(ii) Preparation of Magnetic Substance-containing Intermediate Dispersion

| | |
|---|---|
| Finely dispersed magnetic substance mixture mentioned above | 674 g |
| Diacetyl cellulose solution (solid content: 4.34%, solvent: methyl ethyl ketone/cyclohexanone = 1/1) | 24280 g |
| Cyclohexanone | 46 g |

These were mixed and then stirred by Disper to prepare a magnetic substance-containing intermediate dispersion.

An α-alumina abrasive dispersion was prepared by using the following composition.

(a) Preparation of Sumicorundum AA-1.5 particle dispersion (average primary particle diameter: 1.5 μm, specific surface area: 1.3 $m^2$/g)

| | |
|---|---|
| Sumicorundum AA-1.5 | 152 g |
| Silane coupling agent KBM 903 (Shinetsu Silicone Co.) | 0.48 g |
| Diacetyl cellulose solution (solid content 4.5%, solvent: methyl ethyl ketone/cyclohexanone = 1/1) | 227.52 g |

The mixture having the above composition was finely dispersed in a ceramic-coated sand mill (¼ G) at 800 rpm for 4 hours. As media, zirconia beads having a diameter of 1 mm ö were used.

(b) Colloidal silica particle dispersion (microparticles)

"MEK-ST" manufactured by Nissan Chemical Industries Ltd. was used.

This was a dispersion of colloidal silica having average primary particle diameter of 0.015 μm in methyl ethyl ketone as a dispersion medium and had a solid content of 30%.

(iii) Preparation of Second Layer Coating Solution

| | |
|---|---|
| Magnetic substance-containing intermediate dispersion mentioned above | 19053 g |
| Diacetyl cellulose solution (solid content 4.5%, solvent: methyl ethyl ketone/cyclohexanone = 1/1) | 264 g |
| Colloidal silica dispersion "MEK-ST" (solid content 30%, Dispersion b) | 128 g |
| AA-1.5 dispersion (Dispersion a) | 12 g |
| Millionate MR-400 (manufactured by Nippon Polyurethane Co., Ltd.) diluted solution (solid content 20%, diluting solvent: methyl ethyl ketone/cyclohexanone = 1/1) | 203 g |
| Methyl ethyl ketone | 170 g |
| Cyclohexanone | 170 g |

The coating solution obtained by mixing and stirring the above was coated in a coating amount of 29.3 mL/m$^2$ by means of a wire bar. Drying of the coated layer was performed at 110° C. The thickness of the dried magnetic layer was 1.0 $\mu$m.

3) Third Layer (Higher Fatty Acid Ester Lubricant-Containing Layer)

(i) Preparation of Lubricant Stock Dispersion

The following Solution A was heated to 100° C. for dissolution, added to Solution B and then dispersed by a high pressure homogenizer to prepare a stock dispersion of lubricant.

| | |
|---|---|
| Solution A | |
| Compound shown below $C_6H_{13}CH(OH)(CH_2)_{10}COOC_{50}H_{101}$ | 399 weight parts |
| Compound shown below $n\text{-}C_{50}H_{101}O(CH_2CH_2O)_{16}H$ | 171 weight parts |
| Cyclohexanone | 830 weight parts |
| Solution B | |
| Cyclohexanone | 8600 weight parts |

(ii) Preparation of Spherical Inorganic Particle Dispersion

Spherical inorganic particle dispersion [c1] was prepared with the following composition.

| | |
|---|---|
| Isopropyl alcohol | 93.54 weight parts |
| Silane coupling agent KBM 903 (Shinetsu Silicone Co., $(CH_3O)_3Si—(CH_2)_3—NH_2$) | 5.53 weight parts |
| Compound 1 | 2.93 weight parts |

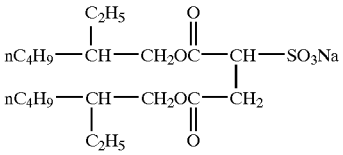

| | |
|---|---|
| Seahostar KEP 50 (amorphous spherical silica, average particle diameter: 0.5 $\mu$m, Nippon Shokubai Co., Ltd) | 88.00 weight parts |
| Diacetone alcohol | 252.93 weight parts |

The above mixture was dispersed with cooling on ice and stirring for 3 hour by using an ultrasonic wave homogenizer "SONIFIER 450 (BRANSON Co., Ltd.)" to obtain Spherical inorganic particle dispersion c1.

(iii) Preparation of Spherical Organic Polymer Particle Dispersion

Spherical organic polymer particle dispersion [c2] was prepared with the following composition.

| | |
|---|---|
| XC99-A8808 (spherical crosslinked polysiloxane particles, average particle diameter: 0.9 $\mu$m, Toshiba Silicone Co., Ltd.) | 60 parts by weight |
| Methyl ethyl ketone | 120 parts by weight |
| Cyclohexanone | 120 parts by weight |

(solid content: 20%, solvent: methyl ethyl ketone/cyclohexanone = 1/1)

A mixture of the above was dispersed with cooling on ice and stirring for 2 hours by using the ultrasonic wave homogenizer "SONIFIER 450 (BRANSON Co., Ltd.)" to obtain Spherical organic polymer particle dispersion c2.

(iv) Preparation of Coating Solution for Third Layer

The following components were added to 542 g of the aforementioned lubricant stock dispersion to obtain a coating solution for third layer.

| | |
|---|---|
| Diacetone alcohol | 5950 g |
| Cyclohexanone | 176 g |
| Ethyl acetate | 1700 g |
| Seahostar KEP 50 dispersion [c1] mentioned above | 53.1 g |
| Spherical polymer particle dispersion [c2] mentioned above | 300 g |
| Megafack F-178K (Dainippon Ink and Chemicals, solid content: 30%) | 4.8 g |
| BYK 310 (BYK Chemi Japan Co., Ltd., solid content 25%) | 5.3 g |

The above coating solution for third layer was coated on the second layer in a coating amount of 10.35 mL/m$^2$ and dried at 110° C. and then at 97° C. for 3 minutes.

(2) Coating of Light-sensitive Layer

Then, layers having the following compositions were coated as stacked layers on the undercoat layer side of the above support to prepare a color negative film.

(Composition of Light-sensitive Layer)

The materials used in the layers are indicated with the following abbreviations.

| |
|---|
| ExC: Cyan coupler |
| ExM: Magenta coupler |
| ExY: Yellow coupler |
| UV: Ultraviolet absorber |
| HBS: High boiling point organic solvent |
| H: Gelatin hardener |

Specific compounds are indicated with the numerals following these abbreviations, and the chemical formulas thereof are mentioned later.

The numerals given on the right of the components indicate coating amounts in a unit of g/m$^2$. With respect to silver halide, the coating amount is indicated in terms of silver.

| | | |
|---|---|---|
| First layer (1st antihalation layer) | | |
| Black colloidal silver | Silver | 0.122 |
| Silver iodobromide (0.07 μm) emulsion | Silver | 0.01 |
| Gelatin | | 0.919 |
| ExM-1 | | 0.066 |
| ExC-1 | | 0.002 |
| ExC-3 | | 0.002 |
| Cpd-2 | | 0.001 |
| F-8 | | 0.010 |
| HBS-1 | | 0.005 |
| HBS-2 | | 0.002 |
| Second layer (2nd antihalation layer) | | |
| Black colloidal silver | Silver | 0.055 |
| Gelatin | | 0.425 |
| ExF-1 | | 0.002 |
| F-8 | | 0.012 |
| Solid disperse dye ExF-7 | | 0.120 |
| HBS-1 | | 0.074 |
| Third layer (intermediate layer) | | |
| ExC-2 | | 0.050 |
| Cpd-1 | | 0.090 |
| Polyethyl acrylate latex | | 0.200 |
| HBS-1 | | 0.100 |
| Gelatin | | 0.700 |
| Fourth layer (low sensitivity red-sensitive emulsion layer) | | |
| Em-D | Silver | 0.577 |
| Em-C | Silver | 0.347 |
| ExC-1 | | 0.188 |
| ExC-2 | | 0.011 |
| ExC-3 | | 0.075 |
| ExC-4 | | 0.121 |
| ExC-5 | | 0.010 |
| ExC-6 | | 0.007 |
| ExC-8 | | 0.050 |
| ExC-9 | | 0.020 |
| Cpd-2 | | 0.025 |
| Cpd-4 | | 0.025 |
| HBS-1 | | 0.114 |
| HBS-5 | | 0.038 |
| Gelatin | | 1.474 |
| Fifth layer (medium sensitivity red-sensitive emulsion layer) | | |
| Em-B | Silver | 0.431 |
| Em-C | Silver | 0.432 |
| ExC-1 | | 0.154 |
| ExC-2 | | 0.068 |
| ExC-3 | | 0.018 |
| ExC-4 | | 0.103 |
| ExC-5 | | 0.023 |
| ExC-6 | | 0.010 |
| ExC-8 | | 0.016 |
| ExC-9 | | 0.005 |
| Cpd-2 | | 0.036 |
| Cpd-4 | | 0.028 |
| HBS-1 | | 0.129 |
| Gelatin | | 1.086 |
| Sixth layer (high sensitivity red-sensitive emulsion layer) | | |
| Em-A | Silver | 1.108 |
| ExC-1 | | 0.180 |
| ExC-3 | | 0.035 |
| ExC-6 | | 0.029 |
| ExC-8 | | 0.110 |
| ExC-9 | | 0.020 |
| Cpd-2 | | 0.064 |
| Cpd-4 | | 0.077 |
| HBS-1 | | 0.329 |

-continued

| | | |
|---|---|---|
| HBS-2 | | 0.120 |
| Gelatin | | 1.245 |
| Seventh layer (intermediate layer) | | |
| Cpd-1 | | 0.094 |
| Cpd-6 | | 0.369 |
| Solid disperse dye ExF-4 | | 0.030 |
| HBS-1 | | 0.049 |
| Polyethyl acrylate latex | | 0.088 |
| Gelatin | | 0.886 |
| Eighth layer (layer imparting interlayer effect to red-sensitive layer) | | |
| Em-J | Silver | 0.293 |
| Em-K | Silver | 0.293 |
| Cpd-4 | | 0.030 |
| ExM-2 | | 0.120 |
| ExM-3 | | 0.016 |
| ExM-4 | | 0.026 |
| ExY-1 | | 0.016 |
| ExY-4 | | 0.036 |
| ExC-7 | | 0.026 |
| HBS-1 | | 0.090 |
| HBS-3 | | 0.003 |
| HBS-5 | | 0.030 |
| Gelatin | | 0.610 |
| Ninth layer (low sensitivity green-sensitive emulsion layer) | | |
| Em-H | Silver | 0.329 |
| Em-G | Silver | 0.333 |
| Em-I | Silver | 0.088 |
| ExM-2 | | 0.378 |
| ExM-3 | | 0.047 |
| ExY-1 | | 0.017 |
| ExC-7 | | 0.007 |
| HBS-1 | | 0.098 |
| HBS-3 | | 0.010 |
| HBS-4 | | 0.077 |
| HBS-5 | | 0.548 |
| Cpd-5 | | 0.010 |
| Gelatin | | 1.470 |
| Tenth layer (medium sensitivity green-sensitive emulsion layer) | | |
| Em-F | Silver | 0.457 |
| ExM-2 | | 0.032 |
| ExM-3 | | 0.029 |
| ExM-4 | | 0.029 |
| ExY-3 | | 0.007 |
| ExC-6 | | 0.010 |
| ExC-7 | | 0.012 |
| ExC-8 | | 0.010 |
| HBS-1 | | 0.065 |
| HBS-3 | | 0.002 |
| HBS-5 | | 0.020 |
| Cpd-5 | | 0.004 |
| Gelatin | | 0.446 |
| Eleventh layer (high sensitivity green-sensitive emulsion layer) | | |
| Em-E | Silver | 0.794 |
| ExC-6 | | 0.002 |
| ExC-8 | | 0.010 |
| ExM-1 | | 0.013 |
| ExM-2 | | 0.011 |
| ExM-3 | | 0.030 |
| ExM-4 | | 0.017 |
| ExY-3 | | 0.003 |
| Cpd-3 | | 0.004 |
| Cpd-4 | | 0.007 |
| Cpd-5 | | 0.010 |
| HBS-1 | | 0.148 |
| HBS-5 | | 0.037 |
| Polyethyl acrylate latex | | 0.099 |
| Gelatin | | 0.939 |

-continued

| | | |
|---|---|---|
| Twelfth layer (yellow filter layer) | | |
| Cpd-1 | | 0.094 |
| Solid disperse dye ExF-2 | | 0.150 |
| Solid disperse dye ExF-5 | | 0.010 |
| Oil soluble dye ExF-6 | | 0.010 |
| HBS-1 | | 0.049 |
| Gelatin | | 0.630 |
| Thirteenth layer (low sensitivity blue-sensitive emulsion layer) | | |
| Em-O | Silver | 0.112 |
| Em-M | Silver | 0.320 |
| Em-N | Silver | 0.240 |
| ExC-1 | | 0.027 |
| ExC-7 | | 0.013 |
| ExY-1 | | 0.002 |
| ExY-2 | | 0.890 |
| ExY-4 | | 0.058 |
| Cpd-2 | | 0.100 |
| Cpd-3 | | 0.004 |
| HBS-1 | | 0.222 |
| HBS-5 | | 0.074 |
| Gelatin | | 2.058 |
| Fourteenth layer (high sensitivity blue-sensitive emulsion layer) | | |
| Em-L | Silver | 0.714 |
| ExY-2 | | 0.211 |
| ExY-4 | | 0.068 |
| Cpd-2 | | 0.075 |
| Cpd-3 | | 0.001 |
| HBS-1 | | 0.071 |
| Gelatin | | 0.678 |
| Fifteenth layer (1st protective layer) | | |
| Silver iodobromide (0.07 μm) emulsion | Silver | 0.301 |
| UV-1 | | 0.211 |
| UV-2 | | 0.132 |
| UV-3 | | 0.198 |
| UV-4 | | 0.026 |
| F-11 | | 0.009 |
| S-1 | | 0.086 |
| HBS-1 | | 0.175 |
| HBS-4 | | 0.050 |
| Gelatin | | 1.984 |
| Sixteenth layer (2nd protective layer) | | |
| H-1 | | 0.400 |
| B-1 (diameter: 0.8 μm) | | 0.050 |
| B-2 (diameter: 3.0 μm) | | 0.150 |
| B-3 (diameter: 3.0 μm) | | 0.050 |
| S-1 | | 0.200 |
| Gelatin | | 0.750 |

Furthermore, W-1 to W-4, B-4 to B-6, F-1 to F-19, lead salt, platinum salt, iridium salt and rhodium salt were optionally added to the layers in order to improve storage stability, processing property, pressure durability, antifungal and antibacterial properties, antistatic property and coatability.

Preparation of Dispersion of Organic Solid Disperse Dye

ExF-2 of the twelfth layer was dispersed as follows.

| | |
|---|---|
| Wet cake of ExF-2 (containing 17.6 weight % of water) | 2.800 kg |
| Sodium octylphenyldiethoxymethane-sulfonate (31 weight % aqueous solution) | 0.376 kg |
| F-15 (7% aqueous solution) | 0.011 kg |
| Water | 4.020 kg |
| Total (adjusted to pH = 7.2 with NaOH) | 7.210 kg |

Slurry having the above composition was roughly dispersed by stirring with a dissolver and further dispersed by using an agitator mill LMK-4 at a peripheral speed of 10 m/s, discharge rate of 0.6 kg/minute and zirconia bead (diameter: 0.3 mm) charging ratio of 80% until the relative absorbance of the dispersion became 0.29 to obtain solid microparticle dispersion. The mean particle size of the dye microparticles was 0.29 μm.

In the same manner, solid dispersions of ExF-4 and ExF-7 were obtained. The mean particle sizes of dye microparticles were 0.28 μm and 0.49 μm, respectively. ExF-5 was dispersed by the microprecipitation dispersion method described in EP549489A, Example 1. The mean particle size was 0.06 μm.

TABLE 1

| Emulsion | Average content of silver iodide (mol %) | Diameter as sphere (μm) | Aspect ratio | Diameter as circle (μm) | Grain thickness (μm) | Shape |
|---|---|---|---|---|---|---|
| Em-A | 4 | 0.92 | 14 | 2 | 0.14 | Tabular |
| Em-B | 5 | 0.8 | 12 | 1.6 | 0.13 | Tabular |
| Em-C | 4.7 | 0.51 | 7 | 0.85 | 0.12 | Tabular |
| Em-D | 3.9 | 0.37 | 2.7 | 0.4 | 0.15 | Tabular |
| Em-E | 5 | 0.92 | 14 | 2 | 0.14 | Tabular |
| Em-F | 5.5 | 0.8 | 12 | 1.6 | 0.13 | Tabular |
| Em-G | 4.7 | 0.51 | 7 | 0.85 | 0.12 | Tabular |
| Em-H | 3.7 | 0.49 | 3.2 | 0.58 | 0.18 | Tabular |
| Em-I | 2.8 | 0.29 | 1.2 | 0.27 | 0.23 | Tabular |
| Em-J | 5 | 0.8 | 12 | 1.6 | 0.13 | Tabular |
| Em-K | 3.7 | 0.47 | 3 | 0.53 | 0.18 | Tabular |
| Em-L | 5.5 | 1.40 | 9.8 | 2.6 | 0.27 | Tabular |
| Em-M | 8.8 | 0.64 | 5.2 | 0.85 | 0.16 | Tabular |
| Em-N | 3.7 | 0.37 | 4.6 | 0.55 | 0.12 | Tabular |
| Em-O | 1.8 | 0.19 | — | — | — | Cubic |

In Table 1, Emulsions Em-A to Em-C were added with optimum amounts of Spectral sensitization dyes 1 to 3 and optimally sensitized by gold sensitization, sulfur sensitization and selenium sensitization. Emulsion Em-J was added with optimum amounts of Spectral sensitization dyes 7 and 8 and optimally sensitized by gold sensitization, sulfur sensitization and selenium sensitization. Emulsion Em-L was added with optimum amounts of Spectral sensitization dyes 9–11 and optimally sensitized by gold sensitization, sulfur sensitization and selenium sensitization. Emulsion Em-O was added with optimum amounts of Spectral sensitization dyes 10–12 and optimally sensitized by gold sensitization and sulfur sensitization. Emulsions Em-D, Em-H, Em-I, Em-K, Em-M and Em-N were added with optimum amounts of spectral sensitization dyes shown in Table 2 and optimally sensitized by gold sensitization, sulfur sensitization and selenium sensitization.

TABLE 2

| Emulsion | Spectral sensitization dye | Added amount (mol/mol of silver) |
|---|---|---|
| Em-D | Spectral sensitization dye 1 | $5.44 \times 10^{-4}$ |
| | Spectral sensitization dye 2 | $2.35 \times 10^{-4}$ |
| | Spectral sensitization dye 3 | $7.26 \times 10^{-6}$ |
| Em-H | Spectral sensitization dye 8 | $6.52 \times 10^{-4}$ |
| | Spectral sensitization dye 13 | $1.35 \times 10^{-4}$ |
| | Spectral sensitization dye 6 | $2.48 \times 10^{-5}$ |
| Em-I | Spectral sensitization dye 8 | $6.09 \times 10^{-4}$ |
| | Spectral sensitization dye 13 | $1.26 \times 10^{-4}$ |
| | Spectral sensitization dye 6 | $2.32 \times 10^{-5}$ |
| Em-K | Spectral sensitization dye 7 | $6.27 \times 10^{-4}$ |
| | Spectral sensitization dye 8 | $2.24 \times 10^{-4}$ |

TABLE 2-continued

| Emulsion | Spectral sensitization dye | Added amount (mol/mol of silver) |
|---|---|---|
| Em-M | Spectral sensitization dye 9 | $2.43 \times 10^{-4}$ |
| | Spectral sensitization dye 10 | $2.43 \times 10^{-4}$ |
| | Spectral sensitization dye 11 | $2.43 \times 10^{-4}$ |
| Em-N | Spectral sensitization dye 9 | $3.28 \times 10^{-4}$ |
| | Spectral sensitization dye 10 | $3.28 \times 10^{-4}$ |
| | Spectral sensitization dye 11 | $3.28 \times 10^{-4}$ |

The sensitizing dyes mentioned in Table 2 are illustrated below.

Sensitizing dye 1

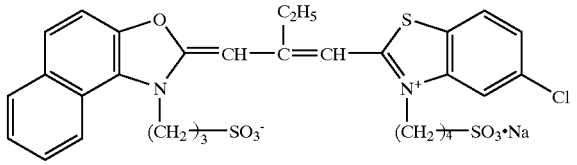

Sensitizing dye 2

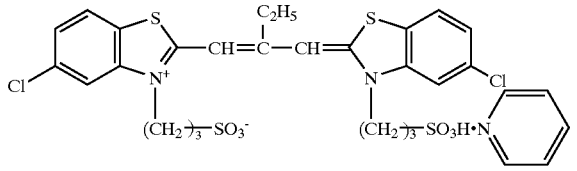

Sensitizing dye 3

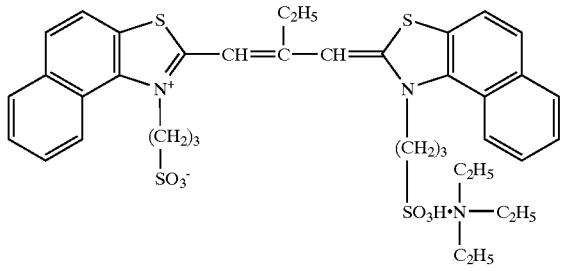

Sensitizing dye 4

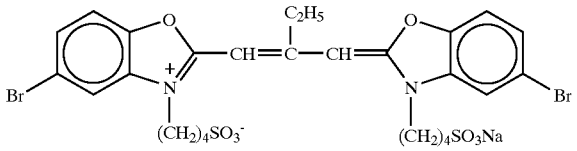

Sensitizing dye 5

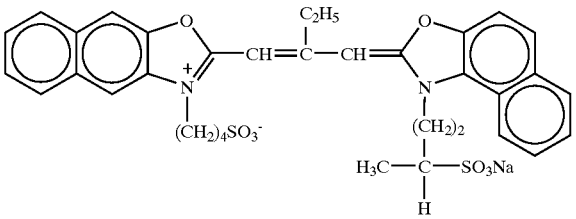

Sensitizing dye 6

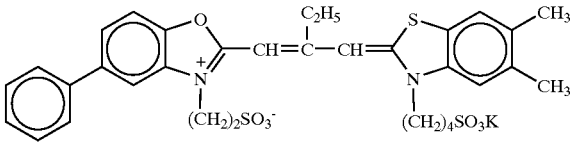

Sensitizing dye 7

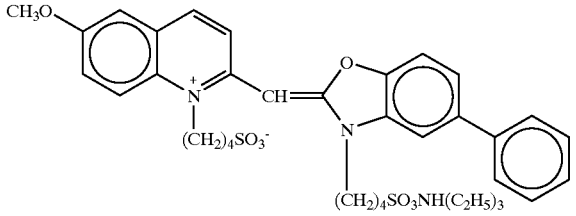

Sensitizing dye 8

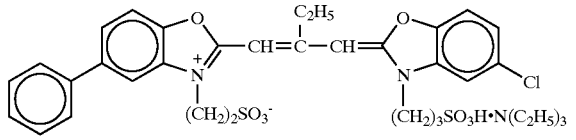

Sensitizing dye 9

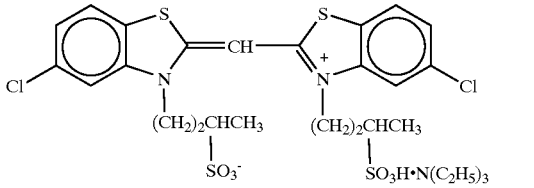

Sensitizing dye 10

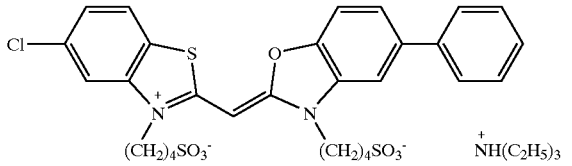

Sensitizing dye 11

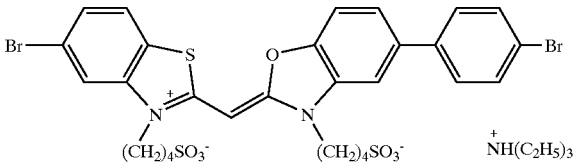

Sensitizing dye 12

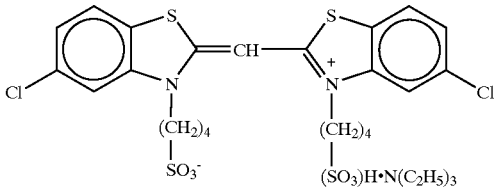

Sensitizing dye 13

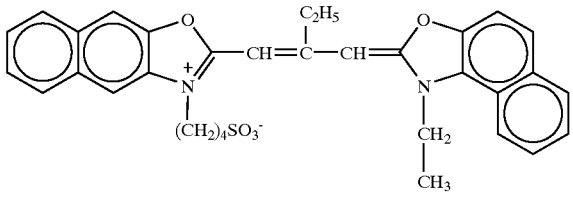

For the preparation of tabular grains, low molecular weight gelatin was used according to the example of JP-A-1-158426. Emulsions Em-A to Em-K contained optimum amounts of Ir and Fe. Emulsions Em-L to Em-O were subjected to reduction sensitization during the grain formation. When the tabular grains were observed with a high voltage electron microscope, dislocation lines were observed as described in JP-A-3-237450. As for Emulsions Em-A to Em-C and Em-J, dislocation was introduced by using an iodide ion-releasing agent according to the example of JP-A-6-11782. As for Emulsion Em-E, dislocation was introduced by using silver iodide fine grains prepared immediately before addition in a separate chamber equipped with a magnetic coupling induction type stirring machine described in JP-A-10-43570.

The compounds used for the layers are mentioned below.

ExC-1

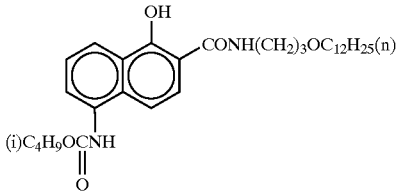

ExC-2

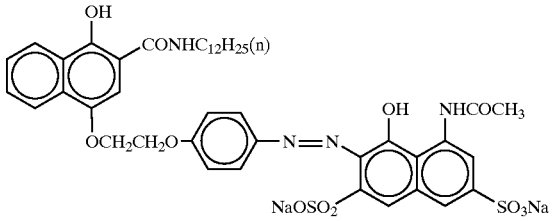

ExC-3

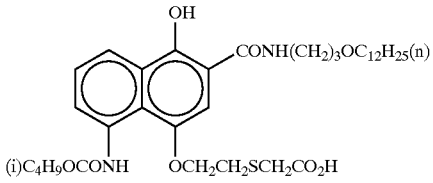

ExC-4

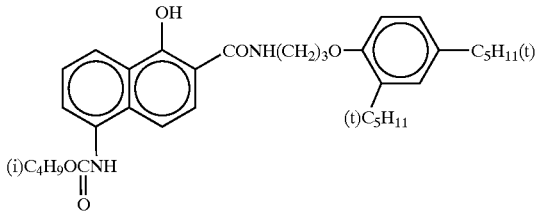

ExC-5

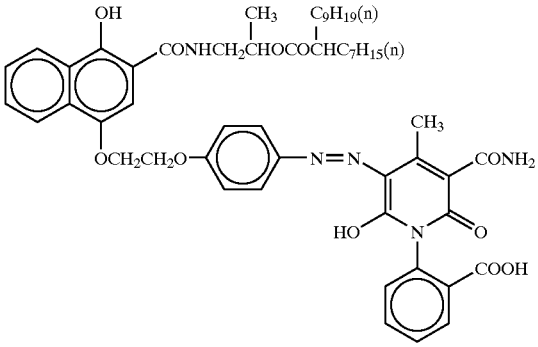

ExC-6

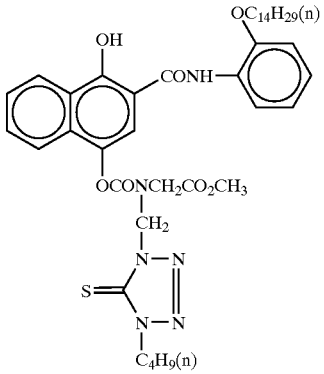

-continued
ExC-7
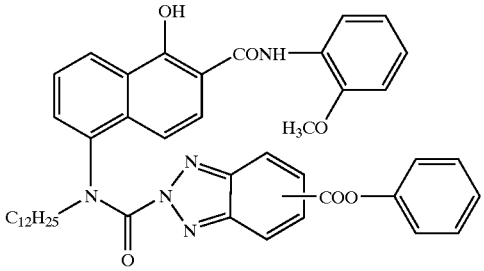
ExC-8
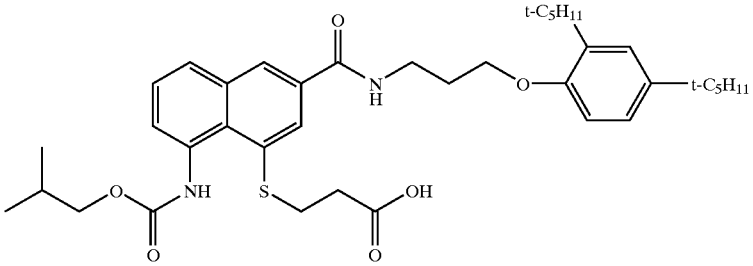
ExC-9
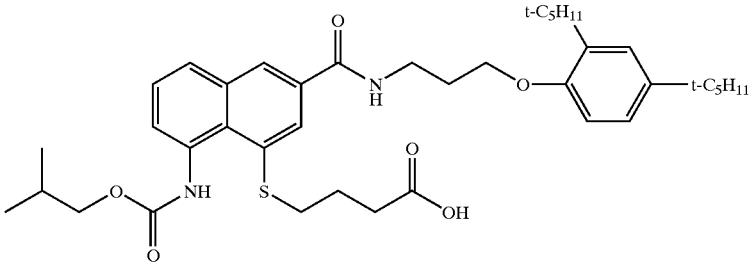
ExM-1
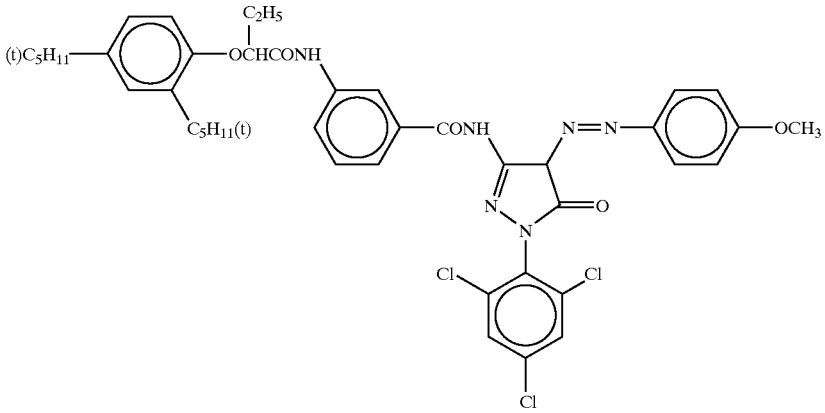
ExM-2
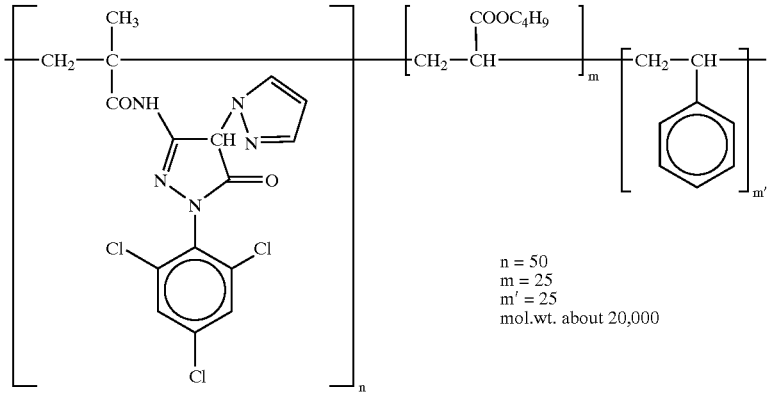
n = 50
m = 25
m′ = 25
mol.wt. about 20,000

-continued
ExM-3
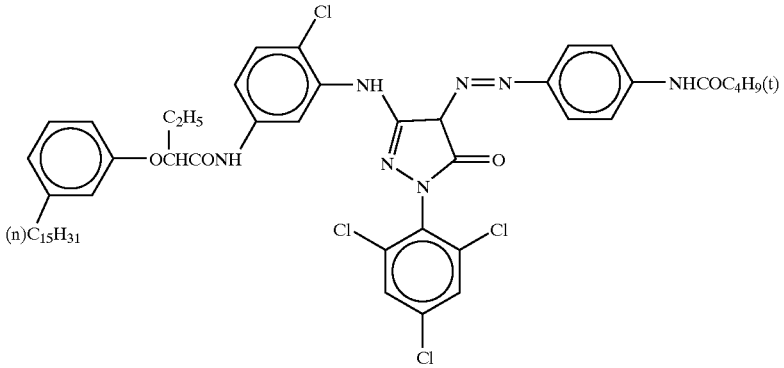
ExM-4
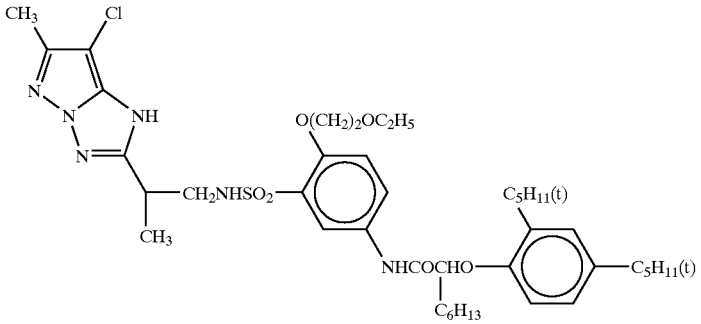
ExY-1
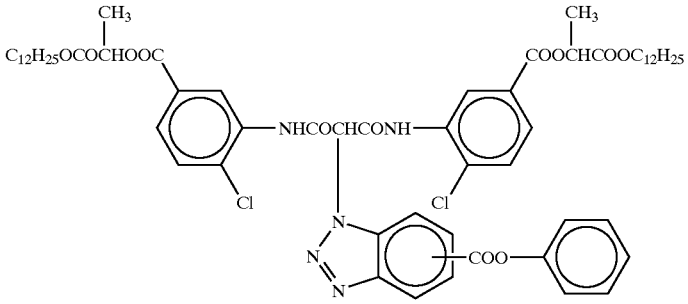
ExY-2
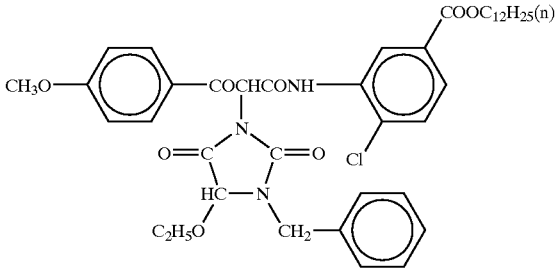
ExY-3
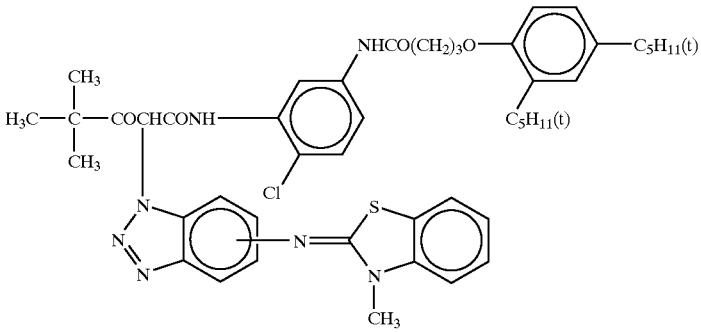

-continued
ExY-4
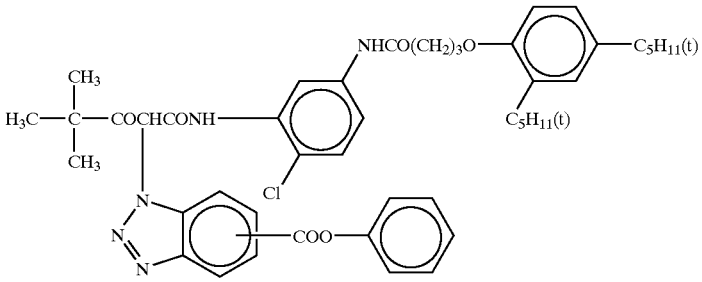
Cpd-1
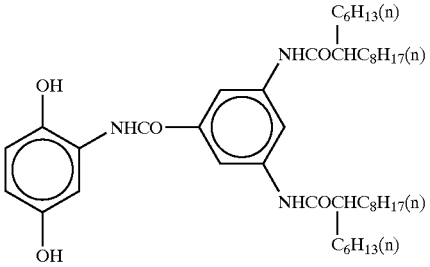
Cpd-2
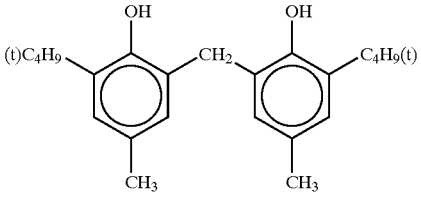
Cpd-3
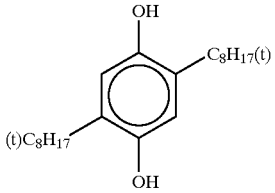
Cpd-4
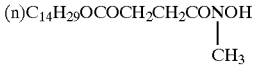
Cpd-5
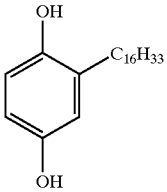
Cpd-6
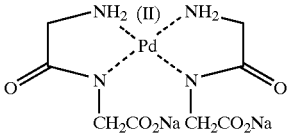
UV-1
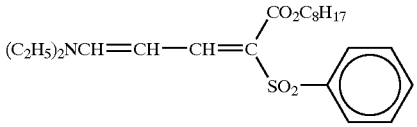
UV-2
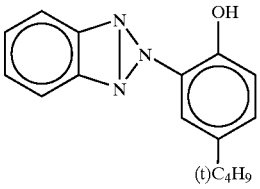
UV-3
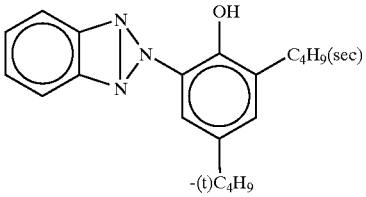
UV-4
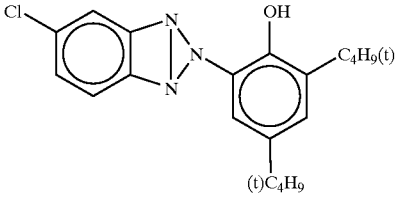
B-1
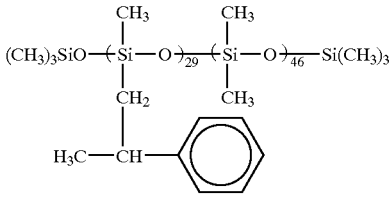
(Molar ratio)
Average molecular weight: about 8,000
B-2
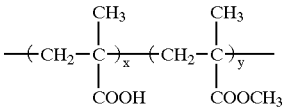
x/y = 40/60 (weight ratio)
Average molecular weight: about 20,000

-continued
B-3
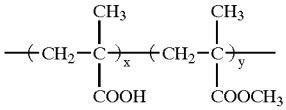
x/y = 10/90 (weight ratio)
Average molecular weight: about 35,000
HBS-1
Tricresyl phosphate
HBS-2
Di-n-butyl phthalate
HBS-3
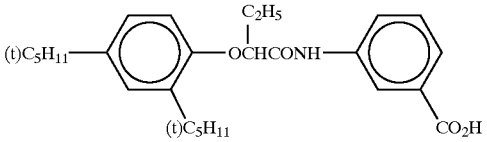
HBS-4
Tri(2-ethylhexyl) phosphate
HBS-5
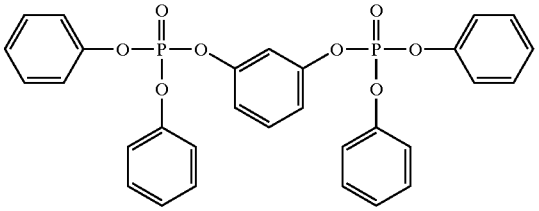
S-1
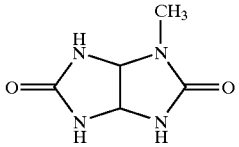
H-1
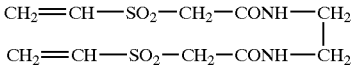
F-1
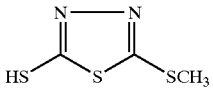
F-2
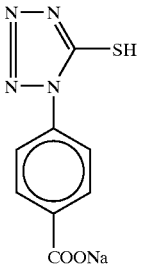
F-3
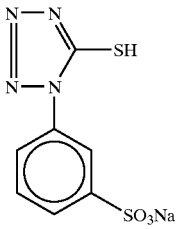
F-4
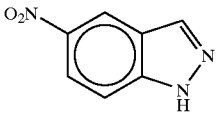
F-5
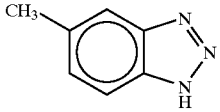
F-6
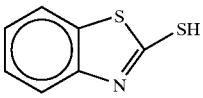
F-7
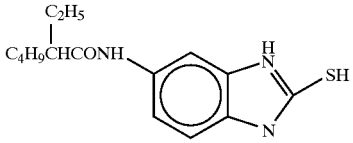
F-8
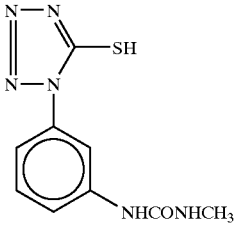

-continued
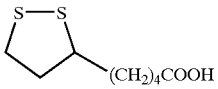
F-9
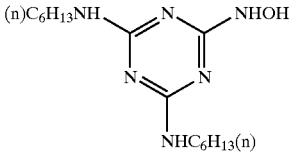
F-10
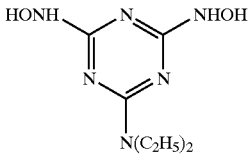
F-11
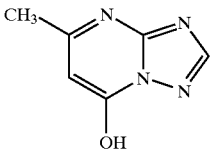
F-12
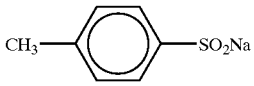
F-13
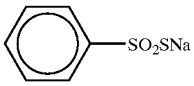
F-14
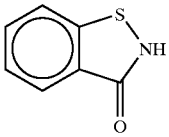
F-15
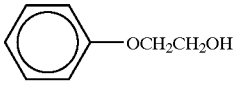
F-16
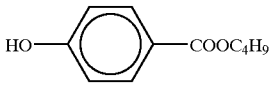
F-17
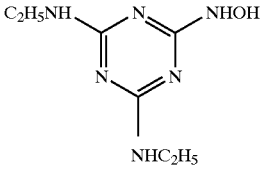
F-18
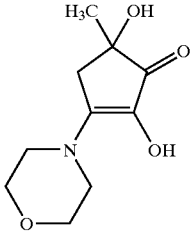
F-19
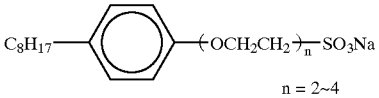
n = 2~4
W-1
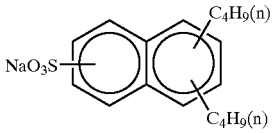
W-2
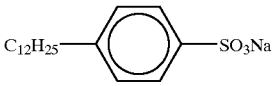
W-3
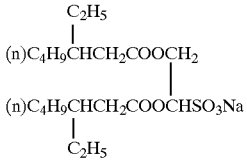
W-4
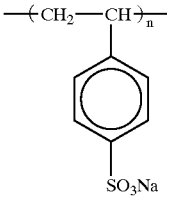
Average molecular weight: about 750,000
B-4
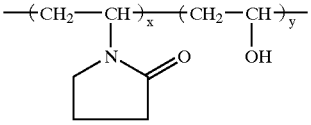
x/y = 70/30 (weight ratio)
Average molecular weight: about 17,000
B-5
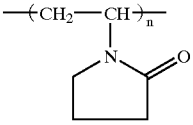
Average molecular weight: about 10,000.
B-6

-continued

ExF-1

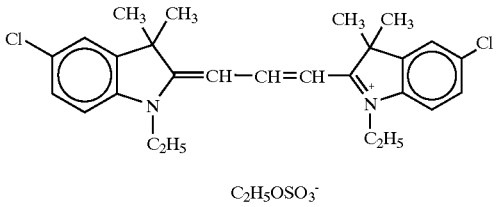

ExF-2

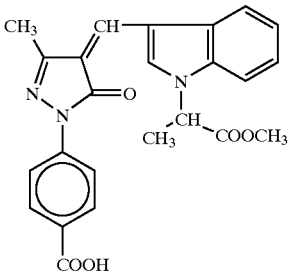

ExF-4

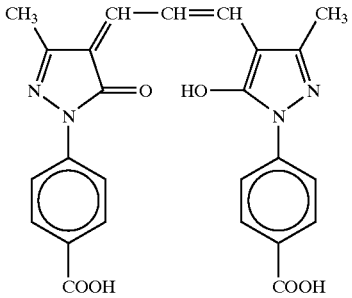

ExF-5

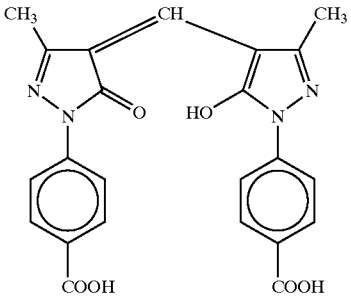

ExF-6

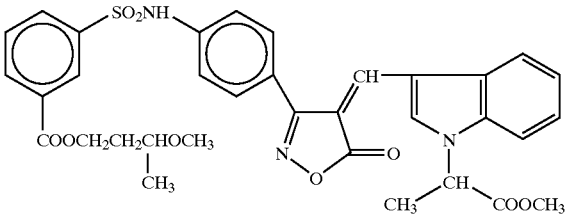

ExF-7

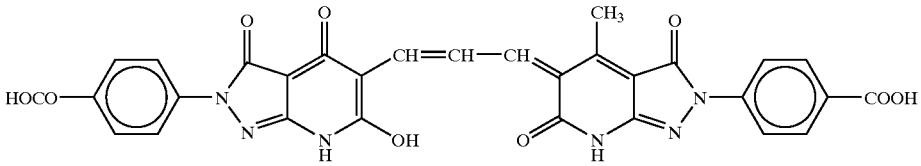

The aforementioned silver halide color photographic light-sensitive material was designated as Sample 100.

In addition to Sample 100, Sample 101 was prepared in the same manner as that for Sample 100 except that 0.009 g/m$^2$ of the following FC-1 and 0.056 g/m$^2$ of W-1 were added to the sixteenth layer. Comparative Samples 102 to 104, 119 and 120 and Samples 105 to 118 according to the present invention were prepared by adding each of the surfactants mentioned in Table 3 instead of FC-1 and W-1 in the sixteenth layer of Sample 101 in such an amount that the amount added to each layer should be the same amount as that of FC-1 in the sixteenth layer of Sample 101 in terms of the fluorine amount.

<Evaluation>

(1) Electrification Controlling Ability Test

Electrification controlling ability of Samples 101 to 120 was evaluated. As for two sheets of each sample in a size of 35 mm×120 mm, surfaces opposite to the surfaces coated with emulsions were adhered with a double-sided adhesive tape, nipped and transported between earthed facing rollers wound with nylon ribbons in an environment at a temperature of 25° C. and relative humidity of 10%. Then, they were entered into a Faraday cage to measure electrification quantity. The results of the measurement of electrification quantity are each indicated with an electrification sequence index. The electrification sequence index is a value calculated by multiplying by $10^9$ a value obtained by subtracting electrification quantity of each of Samples 101 to 120 from that of Sample 100. A sample showing an electrification sequence index of less than −1.0 was determined to have practically sufficient electrification sequence controlling ability. The results are shown in Table 3.

The symbols used in the column of electrification sequence controlling ability in Table 3 have the following meanings.

TABLE 3

| Sample No. | Surfactant | Fluorine-containing surfactant | Electrification sequence index | Electrification sequence controlling ability | Note |
|---|---|---|---|---|---|
| 101 | W-1 | FC-1 | −4.5 | ◎ | Comparative |
| 102 | W-1 | FC-2 | −3.2 | ◎ | Comparative |
| 103 | W-1 | FC-3 | −1.8 | Δ | Comparative |
| 104 | W-1 | FC-4 | −2.3 | ○ | Comparative |
| 105 | WS-1 | FS-201 | −3.2 | ◎ | Invention |
| 106 | WS-2 | FS-113 | −4.9 | ◎ | Invention |
| 107 | WS-9 | FS-219 | −3.1 | ◎ | Invention |
| 108 | WS-10 | FS-320 | −2.1 | ○ | Invention |
| 109 | WS-11 | FS-423 | −4.7 | ◎ | Invention |
| 110 | WS-14 | FS-113 | −4.8 | ◎ | Invention |
| 111 | WS-15 | FS-113 | −4.6 | ◎ | Invention |
| 112 | WS-18 | FS-219 | −3.2 | ◎ | Invention |
| 113 | WS-21 | FS-201 | −3.1 | ◎ | Invention |
| 114 | WS-22 | FS-113 | −4.8 | ◎ | Invention |
| 115 | WS-23 | FS-219 | −3.2 | ◎ | Invention |
| 116 | WS-24 | FS-113 | −4.7 | ◎ | Invention |
| 117 | WS-27 | FS-201 | −3.1 | ◎ | Invention |
| 118 | Lipolan PJ-400 | FS-113 | −4.9 | ◎ | Invention |
| 119 | W-1 | FS-113 | −4.8 | ◎ | Comparative |
| 120 | W-4 | FS-113 | −4.7 | ◎ | Comparative |

X: The electrification sequence index was 0 to −1.0, and no electrification sequence controlling ability was observed.
Δ: The electrification sequence index was −1.1 to −2.0, and weak electrification sequence controlling ability was observed.
○: The electrification sequence index was −2.1 to −3.0, and significant electrification sequence controlling ability was observed.
◎: The electrification sequence index was −3.1 or less, and strong electrification sequence controlling ability was observed.

Comparative Compound FC-1

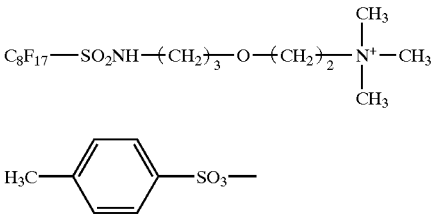

Comparative Compound FC-2

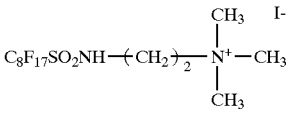

Comparative Compound FC-3

$C_8F_{17}SO_3K$

Comparative Compound FC-4

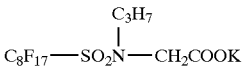

As clearly seen from the results shown in Table 3, all of the samples according to the present invention showed sufficient electrification controlling ability, and in particular, even Samples 106 and 107 utilizing a fluorine-containing surfactant having a short fluorinated alkyl group also showed sufficient electrification controlling ability. On the other hand, Comparative Sample 103 did not show sufficient electrification controlling ability, although it utilized a fluorine-containing surfactant having a fluorinated alkyl group having 8 carbon atoms.

Further, surfaces of the samples according to the present invention were analyzed by XPS (X-ray photoelectron spectroscopy) to quantify F atom/carbon atom ratio on the surfaces. As a result, good correlation was observed between the electrification controlling ability and the surface fluorine amount, and thus it was found that the surfactants of the present invention effectively distribute fluorine atoms on the sample surfaces.

(2) Evaluation of Repelling Characteristic

Samples 201 to 220 mentioned in Table 4 were further produced, which contained the same components as Samples 101 to 120, respectively, except that the particle diameter of B-1 contained in each sixteenth layer of Samples 101 to 120 was changed to 3 μm. Samples 201 to 220 were prepared by coating the layers by the slide bead coating method at a rate of 1.7 m/second and immediately drying them. Then, number of repelling portions (spots of coated layer showing repellency) observed on the coated surface was counted by visual inspection, and repelling degree was calculated based on the counted number. The repelling degree used herein means a percentage of a number of repelling portions of each sample with respect to the number of repelling portions observed in Sample 201, and a sample showing a repelling degree of 50 or less was determined to have repelling inhibition effect. The results are shown in Table 4 mentioned below.

The symbols used in the column of coatability have the following meanings.

TABLE 4

| Sample No. | Surfactant | Fluorine-containing surfactant | Repelling degree | Coat-ability | Note |
|---|---|---|---|---|---|
| 201 | W-1 | FC-1 | 100 | Δ | Comparative |
| 202 | W-1 | FC-2 | 125 | X | Comparative |
| 203 | W-1 | FC-3 | 45 | ○ | Comparative |
| 204 | W-1 | FC-4 | 90 | Δ | Comparative |
| 205 | WS-1 | FS-201 | 15 | ◎ | Invention |
| 206 | WS-2 | FS-113 | 5 | ◎ | Invention |
| 207 | WS-9 | FS-219 | 45 | ○ | Invention |
| 208 | WS-10 | FS-320 | 35 | ○ | Invention |
| 209 | WS-11 | FS-423 | 30 | ○ | Invention |
| 210 | WS-14 | FS-113 | 47 | ○ | Invention |
| 211 | WS-15 | FS-113 | 27 | ○ | Invention |
| 212 | WS-18 | FS-219 | 29 | ○ | Invention |
| 213 | WS-21 | FS-201 | 44 | ○ | Invention |
| 214 | WS-22 | FS-113 | 20 | ◎ | Invention |
| 215 | WS-23 | FS-219 | 37 | ○ | Invention |
| 216 | WS-24 | FS-113 | 23 | ○ | Invention |
| 217 | WS-27 | FS-201 | 43 | ○ | Invention |
| 218 | Lipolan PJ-400 | FS-113 | 2 | ◎ | Invention |
| 219 | W-1 | FS-113 | 55 | Δ | Comparative |
| 220 | W-4 | FS-113 | 72 | Δ | Comparative |

◎: The repelling degree was 0–20.
○: The repelling degree was 21–50.
Δ: The repelling degree was 51–100.
X: The repelling degree was 101 or more.

It was demonstrated that all the samples according to the present invention had superior ability to reduce repelling.

Further, as shown by the results together with the results shown in Table 3, it is clear that the samples according to the present invention containing the compound of the formula (1) and a fluorine-containing surfactant in combination are more excellent in reconciliation of the electrification controlling ability and the reduction of repelling compared with the comparative samples.

(3) Photographic Characteristics

Samples 101 to 120 were left under conditions of a temperature 40° C. and a relative humidity of 70% for 14 hours, then exposed for 1/100 second through a continuous wedge at a color temperature of 4800° K and subjected to the color development processing described below. Density of color observed in the samples after the processing was measured by using a blue filter to evaluate photographic performance. Sensitivity was evaluated with a relative value of logarithm of reciprocal of exposure (lux·second) that gave a yellow density equal to fog density plus 0.2. All of the materials had similar photographic characteristics including sensitivity, color image density etc.

The development was performed as follows by using a FP-360B automatic processor manufactured by Fuji Photo Film Co. Ltd.

However, the FP-360B was modified such that the overflow solution of the bleaching bath should be entirely discharged to a waste solution tank without being supplied to the subsequent bath. This FP-360B was provided with evaporation correcting means described in JIII Journal of Technical Disclosure No. 94-4992 (published by the aggregate corporation, Japan Institute of Invention and Innovation).

The processing steps and the processing solution compositions are shown below.

(Processing steps)

| Step | Processing time | Processing temperature | Replenishing amount* | Tank volume |
|---|---|---|---|---|
| Color development | 3 minutes and 5 seconds | 37.8° C. | 20 mL | 11.5 L |
| Bleaching | 50 seconds | 38.0° C. | 5 mL | 5 L |
| Fixing (1) | 50 seconds | 38.0° C. | — | 5 L |
| Fixing (2) | 50 seconds | 38.0° C. | 8 mL | 5 L |
| Washing with water | 30 seconds | 38.0° C. | 17 mL | 3 L |
| Stabilization (1) | 20 seconds | 38.0° C. | — | 3 L |
| Stabilization (2) | 20 seconds | 38.0° C. | 15 mL | 3 L |
| Drying | 1 minute and 30 seconds | 60.0° C. | | |

*Replenishing amount per 1.1 m of light-sensitive material having a width of 35 mm (equivalent to one 24 Ex. film)

The stabilizer and fixer were counterflowed from (2) to (1), and the overflow of washing water was entirely introduced into the fixing bath (2). The amounts of the developer, bleaching solution and fixer carried over to the bleaching step, fixing step and washing step were 2.5 mL, 2.0 mL and 2.0 mL, respectively, per 1.1 m of light-sensitive material having a width of 35 mm. Each crossover time was 6 seconds, and this time was included in the processing time of each preceding step.

The aperture areas of the processor were 100 $cm^2$ for the color developer, 120 $cm^2$ for the bleaching solution and about 100 $cm^2$ for the other processing solutions.

The compositions of the processing solutions are shown below.

| | Tank Solution (g) | Replenisher (g) |
|---|---|---|
| (Color developer) | | |
| Diethylenetriamine-pentaacetic acid | 3.0 | 3.0 |
| Disodium cathecol-3,5-disulfonate | 0.3 | 0.3 |
| Sodium sulfite | 3.9 | 5.3 |
| Potassium carbonate | 39.0 | 39.0 |

-continued

| | Tank Solution (g) | Replenisher (g) |
|---|---|---|
| Disodium-N,N-bis-(2-sulfonatoethyl)-hydroxylamine | 1.5 | 2.0 |
| Potassium bromide | 1.3 | 0.3 |
| Potassium iodide | 1.3 mg | — |
| 4-Hydroxy-6-methyl-1,3,3a,7-tetrazaindene | 0.05 | — |
| Hydroxylamine sulfate | 2.4 | 3.3 |
| 2-Methyl-4-[N-ethyl-N-(β-hydroxyethyl)amino]-aniline sulfate | 4.5 | 6.5 |
| Water to make | 1.0 L | 1.0 L |
| pH (adjusted with potassium hydroxide and sulfuric acid) | 10.05 | 10.18 |
| (Bleaching solution) | | |
| Ferric ammonium 1,3-diaminopropanetetra-acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted with aqueous ammonia) | 4.6 | 4.0 |

(Fixing (1) Tank Solution)

Mixture of the above bleaching tank solution and the following fixing tank solution (5:95 (volume ratio), pH 6.8).

| (Fixing (2)) | Tank Solution (g) | Replenisher (g) |
|---|---|---|
| Aqueous ammonium thiosulfate solution (750 g/L) | 240 mL | 720 mL |
| Imidazole | 7 | 21 |
| Ammonium methane-thiosulfonate | 5 | 15 |
| Ammonium methanesulfinate | 10 | 30 |
| Ethylenediamine-tetraacetic acid | 13 | 39 |
| Water to make | 1.0 L | 1.0 L |
| pH (adjusted with aqueous ammonia and acetic acid) | 7.4 | 7.45 |

(Washing Water)

Tap water was applied to a mixed-bed column filled with an H type strongly acidic cation exchange resin (Amberlite IR-120B, Rohm & Haas Co.) and an OH type strongly basic anion exchange resin (Amberlite IR-400) to make its concentrations of calcium and magnesium to be 3 mg/L or less. Subsequently, 20 mg/L of sodium dichloroisocyanurate and 150 mg/L of sodium sulfate were added. The pH of the solution was in the range of 6.5–7.5.

(Stabilization Solution)

This solution was commonly used for the tank solution and the replenisher.

| | (unit: g) |
|---|---|
| Sodium p-toluenesulfinate | 0.03 |
| Polyoxyethylene p-monononylphenyl ether (average polymerization degree: 10) | 0.2 |
| 1,2-Benzoisothiazolin-3-one sodium | 0.10 |

-continued

| | (unit: g) |
|---|---|
| Disodium ethylenediaminetetraacetate | 0.05 |
| 1,2,4-Triazole | 1.3 |
| 1,4-Bis(1,2,4-triazol-1-ylmethyl)-piperazine | 0.75 |
| Water to make | 1.0 L |
| pH 8.5 | |

As explained above, according to the present invention, there can be provided silver halide photographic light-sensitive materials that have superior antistatic property by adding the compounds represented by the aforementioned formula (1) and a fluorine-containing surfactant, and these materials can be stably produced.

The present disclosure relates to the subject matter contained in Japanese Patent Application No. 130800/2002 filed on May 2, 2002, which is expressly incorporated herein by reference in its entirety.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined claims set forth below.

What is claimed is:

1. A silver halide photographic light-sensitive material having one or more layers including at least one light-sensitive silver halide emulsion layer on a support, wherein at least one of the layers contains at least one compound represented by the following formula (1)' and a fluorine-containing surfactant:

$$R^1\text{-}Z^1 \qquad \text{Formula (1)'}$$

wherein $R^1$ represents an unsubstituted alkyl group having 6–24 carbon atoms, a hydroxy-substituted alkyl group having 6–24 carbon atoms or an unsubstituted alkenyl group having 6–24 carbon atoms, and $Z^1$ represents $SO_3M$, where M represents a cation.

2. The silver halide photographic light-sensitive material according to claim 1, wherein, in the formula (1)', the carbon atom number of $R^1$ is 6–20.

3. The silver halide photographic light-sensitive material according to claim 1, wherein, in the formula (1)', $R^1$ is an alkyl group having a chain structure or an alkenyl group having a chain structure.

4. The silver halide photographic light-sensitive material according to claim 1, wherein the compound represented by the formula (1)' is contained in an amount of 60 weight % or more with respect to a coating aid in a layer containing the fluorine-containing surfactant.

5. The silver halide photographic light-sensitive material according to claim 1, wherein the compound represented by the formula (1)' is contained in an amount of 75 weight % or more with respect to a coating aid in a layer containing the fluorine-containing surfactant.

6. The silver halide photographic light-sensitive material according to claim 1, wherein the compound represented by the formula (1)' is contained in an amount of 90 weight % or more with respect to a coating aid in a layer containing the fluorine-containing surfactant.

7. A silver halide photographic light-sensitive material having one or more layers including at least one light-sensitive silver halide emulsion layer on a support, wherein at least one of the layers contains at least one compound represented by the following formula (1):

$R^1$-$Z^1$ Formula (1)

wherein $R^1$ represents an unsubstituted alkyl group having 6–24 carbon atoms, a hydroxyl-substituted alkyl group having 6–24 carbon atoms or an unsubstituted alkenyl group having 6–24 carbon atoms, and $Z^1$ represents $OSO_3M$ or $SO_3M$, where M represents a cation;

and a fluorine-containing surfactant represented by the following formula (2A):

Formula (2A)

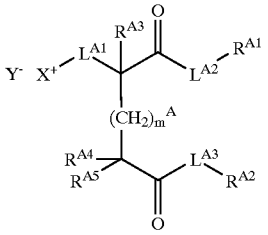

wherein $R^{A1}$ and $R^{A2}$ each represent a substituted or unsubstituted alkyl group provided that at least one of $R^{A1}$ and $R^{A2}$ represents an alkyl group substituted with one or more fluorine atoms; $R^{A3}$, $R^{A4}$ and $R^{A5}$ each independently represent a hydrogen atom or a substituent; $L^{A1}$, $L^{A2}$ and $L^{A3}$ each independently represent a single bond or a divalent bridging group; $X^+$ represents a cationic substituent; $Y^-$ represents a counter anion, but $Y^-$ may not be present when the intramolecular charge is 0 without $Y^-$; and $m^A$ represents 0 or 1.

8. The silver halide photographic light-sensitive material according to claim 7, wherein the fluorine-containing surfactant is a compound represented by the following formula (2A-1):

Formula (2A-1)

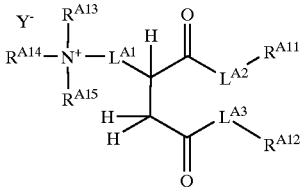

wherein $R^{A11}$ and $R^{A12}$ each represent a substituted or unsubstituted alkyl group, provided that at least one of $R^{A11}$ and $R^{A12}$ represents an alkyl group substituted with one or more fluorine atoms, and the total carbon atom number of $R^{A11}$ and $R^{A12}$ is 19 or less; $L^{A1}$ represents a single bond or a divalent bridging group; $L^{A2}$ and $L^{A3}$ each independently represent —O—, —S— or —$NR^{100}$— where $R^{100}$ represents a hydrogen atom or a substituent; $R^{13A}$, $R^{14A}$ and $R^{15A}$ each independently represent a substituted or unsubstituted alkyl group; and $Y^-$ represents a counter anion, but $Y^-$ may not be present when the intramolecular charge is 0 without $Y^-$.

9. The silver halide photographic light-sensitive material according to claim 1, wherein the fluorine-containing surfactant is a compound represented by the following formula (2A-2):

Formula (2A-2)

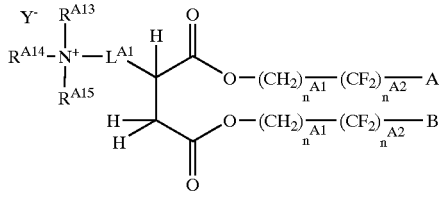

wherein $R^{13A}$, $R^{14A}$ and $R^{15A}$ each independently represent a substituted or unsubstituted alkyl group; $L^{A1}$ represents a single bond or a divalent bridging group; A and B each independently represent a fluorine atom or a hydrogen atom; $n^{A1}$ represents an integer of 1–6; $n^{A2}$ represents an integer of 3–8; and $Y^-$ represents a counter anion, but $Y^-$ may not be present when the intramolecular charge is 0 without $Y^-$.

10. The silver halide photographic light-sensitive material according to claim 7, wherein the fluorine-containing surfactant is a compound represented by the following formula (2A-3):

Formula (2A-3)

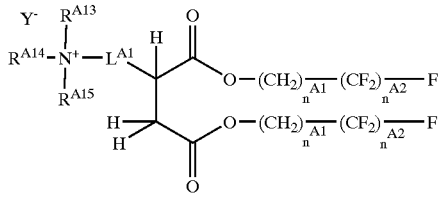

wherein $n^{A1}$ represents an integer of 1–6 and $n^{A2}$ represents an integer of 3–8, provided that $2(n^{A1}+n^{A2})$ is 19 or less; $R^{A13}$, $R^{A14}$ and $R^{A15}$ each independently represent a substituted or unsubstituted alkyl group; $L^{A1}$ represents a single bond or a divalent bridging group; and $Y^-$ represents a counter anion, but $Y^-$ may not be present when the intramolecular charge is 0 without $Y^-$.

11. A silver halide photographic light-sensitive material having one or more layers including at least one light-sensitive silver halide emulsion layer on a support, wherein at least one of the layers contains at least one compound represented by the following formula (1):

$R^1$-$Z^1$ Formula (1)

wherein $R^1$ represents an unsubstituted alkyl group having 6–24 carbon atoms, a hydroxyl-substituted alkyl group having 6–24 carbon atoms or an unsubstituted alkenyl group having 6–24 carbon atoms, and $Z^1$ represents $OSO_3M$ or $SO_3M$, where M represents a cation;

and a fluorine-containing surfactant represented by the following formula (2B):

Formula (2B)

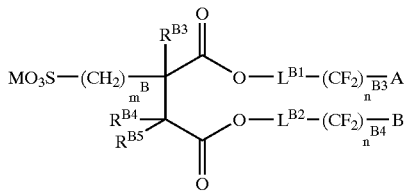

wherein $R^{B3}$, $R^{B4}$ and $R^{B5}$ each independently represent a hydrogen atom or a substituent; A and B each independently represent a fluorine atom or a hydrogen atom; $n^{B3}$ and $n^{B4}$ each independently represent an integer of 4–8; $L^{B1}$ and $L^{B2}$ each independently represent a substituted or unsubstituted alkylene group, a substituted or unsubstituted alkyleneoxy group or a divalent bridging group consisting of a combination of these; $m^B$ represents 0 or 1; and M represents a cation.

12. The silver halide photographic light-sensitive material according to claim 11, wherein the fluorine-containing surfactant is a compound represented by the following formula (2B-1):

Formula (2B-1)

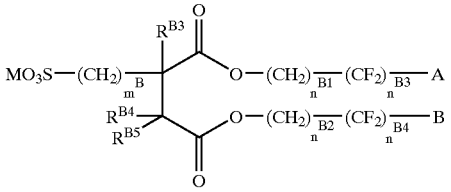

wherein $R^{B3}$, $R^{B4}$ and $R^{B5}$ each independently represent a hydrogen atom or a substituent; A and B each independently represent a fluorine atom or a hydrogen atom; $n^{B1}$ and $n^{B2}$ each independently represent an integer of 1–6; $n^{B3}$ and $n^{B4}$ each independently represent an integer of 4–8; $m^B$ represents 0 or 1; and M represents a cation.

13. The silver halide photographic light-sensitive material according to claim 11, wherein the fluorine-containing surfactant is a compound represented by the following formula (2B-2):

Formula (2B-2)

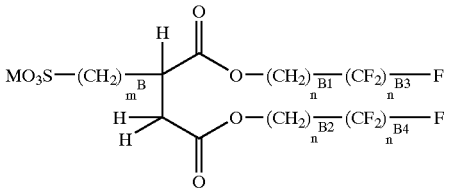

wherein $n^{B1}$ and $n^{B2}$ each independently represent an integer of 1–6; $n^{B3}$ and $n^{B4}$ each independently represent an integer of 4–8; $m^B$ represents 0 or 1; and M represents a cation.

14. The silver halide photographic light-sensitive material according to claim 11, wherein the fluorine-containing surfactant is a compound represented by the following formula (2B-3):

Formula (2B-3)

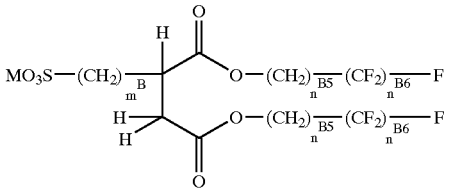

wherein $n^{B5}$ represents 2 or 3; $n^{B6}$ represents an integer of 4–6; $m^B$ represents 0 or 1; and M represents a cation.

15. A silver halide photographic light-sensitive material having one or more layers including at least one light-sensitive silver halide emulsion layer on a support, wherein at least one of the layers contains at least one compound represented by the following formula (1):

$R^1$-$Z^1$ Formula (1)

wherein $R^1$ represents an unsubstituted alkyl group having 6–24 carbon atoms, a hydroxyl-substituted alkyl group having 6–24 carbon atoms or an unsubstituted alkenyl group having 6–24 carbon atoms, and $Z^1$ represents $OSO_3M$ or $SO_3M$, where M represents a cation;

and a fluorine-containing surfactant represented by the following formula (2C):

Formula (2C)

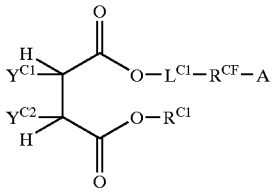

wherein $R^{C1}$ represents a substituted or unsubstituted alkyl group; $R^{CF}$ represents a perfluoroalkylene group; A represents a hydrogen atom or a fluorine atom; $L^{C1}$ represents a substituted or unsubstituted alkylene group, a substituted or unsubstituted alkyleneoxy group or a divalent bridging group consisting of a combination of these; and one of $Y^{C1}$ and $Y^{C2}$ represents a hydrogen atom, and the other represents -$L^{C2}$-$SO_3M$, where $L^{C2}$ represents a single bond or a substituted or unsubstituted alkylene group and M represents a cation.

16. The silver halide photographic light-sensitive material according to claim 15, wherein the fluorine-containing surfactant is a compound represented by the following formula (2C-1):

Formula (2C-1)

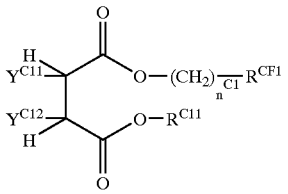

wherein $R^{C11}$ represents a substituted or unsubstituted alkyl group having 6 or more carbon atoms; $R^{CF1}$ represents a perfluoroalkyl group having 6 or less carbon atoms; one of $Y^{C11}$ and $Y^{C12}$ represents a hydrogen atom, and the other represents $SO_3M^C$, where $M^C$ represents a cation; and $n^{C1}$ represents an integer of 1 or more.

17. The silver halide photographic light-sensitive material according to claim 1, wherein the fluorine-containing surfactant is a compound represented by the following formula (2D):

$[Rf^D\text{-}(L^D)_{nD}]_{mD}\text{-}W$ Formula (2D)

wherein $Rf^D$ represents a perfluoroalkyl group; $L^D$ represents an alkylene group; W represents a group having an anionic, cationic or betaine group or nonionic polar group required for imparting surface activity; $n^D$ represents 0 or 1; and $m^D$ represents an integer of 1–3.

18. The silver halide photographic light-sensitive material according to claim 1, wherein the compound represented by the formula (1)' and the fluorine-containing surfactant are contained in an outermost layer.

19. The silver halide photographic light-sensitive material according to claim 1, which contains an anionic surfactant other than the fluorine-containing surfactant in the layer containing the compound represented by the formula (1)' and the fluorine-containing surfactant.

* * * * *